US011580948B2

(12) United States Patent
Ohtsu et al.

(10) Patent No.: US 11,580,948 B2
(45) Date of Patent: Feb. 14, 2023

(54) SOUNDPROOF SYSTEM

(71) Applicant: FUJIFILM Corporation, Tokyo (JP)

(72) Inventors: Akihiko Ohtsu, Kanagawa (JP); Shinya Hakuta, Kanagawa (JP); Shogo Yamazoe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 531 days.

(21) Appl. No.: 16/718,760

(22) Filed: Dec. 18, 2019

(65) Prior Publication Data

US 2020/0126532 A1 Apr. 23, 2020

Related U.S. Application Data

(63) Continuation of application No. PCT/JP2018/023219, filed on Jun. 19, 2018.

(30) Foreign Application Priority Data

Jun. 21, 2017 (JP) ..... JP2017-121696
Oct. 3, 2017 (JP) ..... JP2017-193295

(51) Int. Cl.
*G10K 11/172* (2006.01)
*F01N 1/02* (2006.01)
(Continued)

(52) U.S. Cl.
CPC ..... *G10K 11/172* (2013.01); *F01N 1/02* (2013.01); *G10K 11/162* (2013.01); *F24F 2013/245* (2013.01)

(58) Field of Classification Search
CPC ..... F01N 2470/02; F01N 1/02
(Continued)

(56) References Cited

U.S. PATENT DOCUMENTS 5,646,240 A * 7/1997 Oishi ..... C08L 61/26 525/509
6,082,487 A * 7/2000 Angelo ..... F01N 1/24 181/282
(Continued)

FOREIGN PATENT DOCUMENTS

JP H09212175 A 8/1997
JP H1074089 A 3/1998
(Continued)

OTHER PUBLICATIONS

The extended European search report issued by the European Patent Office dated Jun. 2, 2020, which corresponds to European Patent Application No. 18821411.8-1001 and is related to U.S. Appl. No. 16/718,760.
(Continued)

*Primary Examiner* — Alexander Krzystan
(74) *Attorney, Agent, or Firm* — Studebaker & Brackett PC

(57) ABSTRACT

A soundproof system includes a tube structure having one or more opening ends and a soundproof structure having an opening portion or a radiation surface. The following Expression (1) is satisfied in a case in which a phase difference between sound incident on the soundproof structure and sound re-radiated from the soundproof structure is defined a phase difference as θ1; for one or more maximum values of the pressure of sound formed in the tube structure, a distance between the opening portion or the radiation surface and a position where the sound pressure has a maximum value in the tube structure is L; a wavelength of the incident sound is λ; and a phase difference θ2 is defined as 2π×2L/λ:

$$|\theta 1-\theta 2|\leq\pi/2 \quad (1).$$

(Continued)

The soundproof system with a small size can obtain high transmission loss in a wide band.

18 Claims, 33 Drawing Sheets

(51) Int. Cl.
*G10K 11/162* (2006.01)
*F24F 13/24* (2006.01)

(58) Field of Classification Search
USPC ..... 181/196
See application file for complete search history.

(56) References Cited

U.S. PATENT DOCUMENTS 6,354,398 B1 * 3/2002 Angelo ..... F01N 1/24 181/256
2002/0070073 A1 * 6/2002 Matsumoto ..... F22B 37/486 181/182
2011/0127107 A1 * 6/2011 Tanase ..... F01N 1/04 181/286
2015/0137998 A1 * 5/2015 Marti ..... G10K 15/02 340/901

FOREIGN PATENT DOCUMENTS

JP H11132024 A 5/1999
JP 2005307895 A 11/2005
JP 2016095070 A 5/2016
WO 2017/076377 A1 5/2017

OTHER PUBLICATIONS

International Search Report issued in PCT/JP2018/023219; dated Aug. 28, 2018.
Written Opinion issued in PCT/JP2018/023219; dated Aug. 28, 2018.

* cited by examiner

SOUNDPROOF SYSTEM

CROSS-REFERENCE TO RELATED APPLICATIONS

This application is a Continuation of PCT International Application No. PCT/JP2018/023219 filed on Jun. 19, 2018, which claims priority under 35 U.S.C. § 119(a) to Japanese Patent Application No. 2017-121696 filed on Jun. 21, 2017 and Japanese Patent Application No. 2017-193295 filed on Oct. 3, 2017. Each of the above applications is hereby expressly incorporated by reference, in its entirety, into the present application.

BACKGROUND OF THE INVENTION

1. Field of the Invention

The present invention relates to a soundproof system comprising a tube structure and a soundproof structure. More particularly, the invention relates to a soundproof system that reduces sound in a wide frequency band to insulate sound while maintaining air ventilation in an air ventilation tube structure, such as a duct, a muffler, or a ventilation sleeve.

2. Description of the Related Art

In the related art, in some cases, sound and gas, wind, or heat pass through a structure based on the premise of ensuring air ventilation, such as a duct, a muffler, or a ventilation sleeve, at the same time. Therefore, noise control measures are required. For this reason, particularly, it is necessary to study the structure of, for example, a duct and a muffler, which are attached to noisy machines and then used, to insulate noise (see JP2005-307895A and JP2016-095070A).

A technique disclosed in JP2005-307895A is an air-conditioning and sound-absorbing system in which two or more resonance-type mufflers (for example, two or more cylinders having substantially the same length) that absorb noise substantially in the same set frequency range are attached in the middle of a pipe of an air conditioning duct and the distance d between the attachment positions (for example, the openings of the cylinders) of adjacent resonance-type mufflers is set so as to satisfy the condition of $\lambda/12+n\lambda/2 \leq d \leq 5\lambda/12+n\lambda/2$.

In general, a cylindrical air column resonance tube exhibits the highest effect in a case in which an opening portion of the cylindrical air column resonance tube is disposed in the vicinity of the antinode of sound pressure and the effect is reduced in a case in which the opening portion is disposed in the vicinity of the node of sound pressure. Therefore, in a case in which there is one resonance-type muffler, such as an air column resonance tube, the position of the resonance-type muffler is appropriately determined. In a case in which the opening portion happens to be disposed in the vicinity of the node, the transmission loss of sound is reduced. In order to avoid this situation, in the technique disclosed in JP2005-307895A, the distance d between the openings of two adjacent cylindrical air column resonance tubes having substantially the same length is set so as to satisfy the above-mentioned condition. Therefore, a mechanism in which at least one of the two cylindrical air column resonance tubes is located at a position that is away from the node and transmission loss is improved is used.

JP2016-095070A discloses a technique in which a sound absorbing tubular body with a length that is half of the length of a sleeve tube is provided in the sleeve tube of a natural ventilation port and a porous material is provided in the sound absorbing tubular body.

In the technique disclosed in JP2016-095070A, the primary natural frequencies of the sleeve tube and the sound absorbing tubular body are matched with each other and the sound pressure characteristics of the sleeve tube and the sound absorbing tubular body deviate from each other to reduce the air column resonance of the sleeve tube. A sound absorbing effect is obtained by the effect of the air column resonance of the sound absorbing tubular body. In addition, in the technique disclosed in JP2016-095070A, the porous material is inserted into the air column resonance tube to expand a sound absorption bandwidth and to efficiently absorb the frequency band sound caused by the loss of the sound insulation performance due to air column resonance, thereby broadening the sound absorbing effect.

SUMMARY OF THE INVENTION

However, in the technique disclosed in JP2005-307895A, two adjacent cylindrical air column resonance tubes having the same length are provided in the air-conditioning duct and at least one of the two cylindrical air column resonance tubes is located so as to avoid the node of sound pressure to increase the sound absorbing effect. However, in the technique disclosed in JP2005-307895A, only the principle of air column resonance is used in order to obtain the transmission loss of sound and there is a problem that the mode of the air conditioning duct is not considered. For example, in JP2005-307895A, [FIG. 2] illustrates the dependence of transmission loss on the place and is a diagram related to the transmission loss of sound with the resonance frequency of a cylinder. There is a problem that the transmission loss of sound with a non-resonance frequency is not discussed and a configuration for increasing the transmission loss at the non-resonance frequency is not considered.

That is, an object of the technique disclosed in JP2005-307895A is to provide a configuration in which two tubular air column resonance tubes having substantially the same resonance frequency are provided in the duct and, even when one of the two tubular air column resonance tubes does not function, the other tubular air column resonance tube functions. Therefore, in some cases, even in a case in which one of the two tubular air column resonance tubes is located at an optimal position, the other does not work effectively and is useless. There is a problem that the mode of the duct is not considered.

The technique disclosed in JP2016-095070A is based on the principle of air column resonance. In the technique, the size of the sound absorbing tubular body depends on the size of the sleeve tube and the air column resonance of the sleeve tube is reduced to improve the sound insulation performance. Since the sound absorbing band is limited, it is necessary to use a porous material in order to widen the band and the basic principle is based on the widening of the band by air column resonance and the porous material. That is, the technique disclosed in JP2016-095070A has the effect of broadening the resonance peak of transmission loss using an essential porous material while using air column resonance.

In general, the following is considered as one of the measures to obtain high transmission loss at a desired frequency: a resonance-type soundproof structure (for example, a Helmholtz resonator, an air column resonance cylinder, or a film-vibration-type structure) is provided to insulate sound with the resonance frequency as in the techniques disclosed in JP2005-307895A and JP2016-095070A.

However, in many cases, it is difficult to provide many soundproof members in a duct or a muffler due to space restrictions. Therefore, in some cases, it is necessary to reduce the size of the soundproof structure. In general, in a case in which sound with a low frequency is absorbed on the basis of the resonance phenomenon, the size of the soundproof structure corresponding to the sound is increased since the wavelength of the sound is long. This causes a problem that the air ventilation performance of a duct or a muffler is reduced.

In addition, the soundproof band of the resonance-type soundproof structure is generally narrow and it is difficult to remove noise at a plurality of frequencies or in a wide frequency band at the same time. In contrast, a porous sound absorbing material, such as normal urethane or glass wool, has a low soundproofing performance particularly on the low frequency side. There is a problem that, even in a case in which a porous sound absorbing material is provided in, for example, a duct, there is little effect at a frequency equal to or less than 1000 Hz. That is, these techniques according to the related art have a problem that it is difficult to insulate sound with a low frequency using a soundproof structure having a size less than a wavelength size. In addition, there is a problem that it is difficult to insulate sound in a wide band with a small structure, particularly, on the low frequency side.

An object of the invention is to provide a soundproof system that can solve the above-mentioned problems and tasks of the related art and obtain high transmission loss in a wide band with a small size.

In addition to the above-mentioned object, another object of the invention is to provide a soundproof system that includes a tube structure and a soundproof structure having an opening portion, reduces the size of the soundproof structure in the soundproof system by arranging the soundproof structure at an optimal position, has an air ventilation and soundproofing function for ensuring a high air ventilation performance, and obtains high transmission loss in a wider band than that in the related art.

Here, in the invention, "sound insulation" includes both the meaning of "sound shielding" and the meaning of "sound absorption" as acoustic characteristics and particularly means "sound shielding". In addition, "sound shielding" means "shielding sound".

That is, "sound shielding" means "preventing sound from passing".

Therefore, "sound shielding" includes "reflecting" sound (reflection of sound) and "absorbing" sound (absorption of sound (see Daijirin of Sanseido Co., Ltd. (third edition) and Acoustic Materials Association of Japan web pages http://www.onzai.or.jp/question/soundproof.html and http://www.onzai.or.jp/pdf/new/gijutsu201312_3.pdf).

In the following description, "reflection" and "absorption" are basically included in "sound insulation" and "shielding" without being distinguished from each other. The terms "reflection" and "absorption" are referred to in a case in which they need to be distinguished from each other.

In order to achieve the objects, according to a first aspect of the invention, there is provided a soundproof system comprising: a tube structure having one or more opening ends; and a soundproof structure. The soundproof structure has an opening portion or a radiation surface on which sound is incident or from which sound is radiated. The opening portion or the radiation surface of the soundproof structure is provided in the tube structure. The following Expression (1) is satisfied in a case in which a phase difference between sound incident on the soundproof structure and sound re-radiated from the soundproof structure is defined a phase difference as θ1; a range in which the phase difference θ1 is acquired is defined as a range of 0 to 2π; for one or more maximum values of pressure of sound forming a sound pressure distribution in the tube structure, a distance between the opening portion or the radiation surface of the soundproof structure and a position where the sound pressure has a maximum value in the tube structure is L; a wavelength of the sound incident on the soundproof structure is λ; and a phase difference θ2 is defined as 2π×2L/λ:

$$|\theta 1-\theta 2|\leq\pi/2 \quad (1).$$

Here, preferably, the sound forming the sound pressure distribution in the tube structure has the same frequency or wavelength as the sound incident on the soundproof structure.

Preferably, the soundproof structure is a resonator with respect to a sound wave.

Preferably, the maximum value is an antinode of a standing wave of sound formed by the tube structure.

Preferably, the tube structure has resonance and satisfies the above-mentioned Expression (1) at a frequency where the resonance occurs.

Preferably, the soundproof structure is a tubular body having the opening portion.

Preferably, the above-mentioned Expression (1) is satisfied at a frequency different from a resonance frequency of the tubular body.

Preferably, transmission loss is the maximum at the frequency satisfying the above-mentioned Expression (1).

Preferably, the following Expression (2) is satisfied in a case in which the tubular body has a resonance frequency fr [Hz], a distance between the opening portion of the tubular body and a position, where the sound pressure has the maximum value and which is closest to the opening portion in the same direction as a flow direction of sound at a highest frequency fma [Hz] among frequencies at which transmission loss is the minimum in a transmission loss spectrum of the tube structure and which are lower than the resonance frequency fr, in the tube structure is La1; and a wavelength at the frequency fma is $\lambda_{fma}$:

$$0\leq La1\leq\lambda_{fma}/4 \quad (2).$$

In order to achieve the objects, according to a second aspect of the invention, there is provided a soundproof system comprising: a tube structure having one or more opening ends; and a soundproof structure. The soundproof structure is a tubular body having an opening portion. The following Expression (2) is satisfied in a case in which the tubular body has a resonance frequency fr [Hz], a distance between the opening portion of the tubular body and a position, where sound pressure has a maximum value and which is closest to the opening portion in the same direction as a flow direction of sound at a highest frequency fma [Hz] among frequencies at which transmission loss is the minimum in a transmission loss spectrum of the tube structure and which are lower than the resonance frequency fr, in the tube structure is La1, and a wavelength at the frequency fma is $\lambda_{fma}$:

$$0\leq La1\leq\lambda_{fma}/4 \quad (2).$$

Preferably, in a case in which a back length of the tubular body is defined as d, the following Expression (3) is satisfied:

$$d<\lambda_{fma}/4 \quad (3).$$

Preferably, the opening portion of the tubular body is provided within the wavelength $\lambda_{fma}$ from the opening end of the tube structure.

Preferably, the following Expression (4) is satisfied in a case in which the tubular body has a resonance frequency fr [Hz], a distance between the opening portion of the tubular body and a position, where the sound pressure has a maximum value and which is closest to the opening portion in the same direction as a flow direction of sound at a lowest frequency fmb [Hz] among frequencies at which transmission loss is the minimum in a transmission loss spectrum of the tube structure and which are higher than the resonance frequency fr, in the tube structure is La2, and a wavelength at the frequency fmb is $\lambda_{fmb}$:

$$\lambda_{fmb}/4 \leq La2 \leq \lambda_{fmb}/2 \quad (4).$$

In order to achieve the objects, according to a third aspect of the invention, there is provided a soundproof system comprising: a tube structure having one or more opening ends; and a soundproof structure. The soundproof structure is a tubular body having an opening portion. The following Expression (4) is satisfied in a case in which the tubular body has a resonance frequency fr [Hz], a distance between the opening portion of the tubular body and a position, where sound pressure has a maximum value and which is closest to the opening portion in the same direction as a flow direction of sound at a lowest frequency fmb [Hz] among frequencies at which transmission loss is the minimum in a transmission loss spectrum of the tube structure and which are higher than the resonance frequency fr, in the tube structure is La2, and a wavelength at the frequency fmb is $\lambda_{fmb}$:

$$\lambda_{fmb}/4 \leq La2 \leq \lambda_{fmb}/2 \quad (4).$$

Preferably, the opening portion of the tubular body is provided within the wavelength $\lambda_{fmb}$ from the opening end of the tube structure.

Preferably, the opening portion of the tubular body is located at a position different from a node of a standing wave of sound formed by the tube structure.

Preferably, the opening portion or the radiation surface of the soundproof structure is provided within the wavelength $\lambda$ from the opening end of the tube structure.

Preferably, the soundproof structure is included in the tube structure.

Preferably, two or more soundproof structures are provided in the tube structure.

Preferably, the soundproof system further comprises a sound absorbing material that is provided in the tube structure.

Preferably, the sound absorbing material is provided in at least a part of the soundproof structure.

Preferably, the tube structure and the soundproof structure are integrally molded.

Preferably, the soundproof structure is attachable to and detachable from the tube structure.

Preferably, the soundproof structure is a Helmholtz resonator.

Preferably, in a case in which the soundproof structure has a resonance frequency fr [Hz], fr≤1000 Hz is satisfied.

Preferably, the tube structure is bent.

According to the soundproof system of the invention, it is possible to obtain high transmission loss in a wider band with a small size.

According to the invention, it is possible to provide a soundproof system that includes a tube structure and a soundproof structure having an opening portion, reduces the size of the soundproof structure in the soundproof system by arranging the soundproof structure at an optimal position, has an air ventilation and soundproofing function for ensuring a high air ventilation performance, and obtains high transmission loss in a wider band than that in the related art.

DESCRIPTION OF THE PREFERRED EMBODIMENTS

Hereinafter, a soundproof system according to the invention will be described in detail with reference to preferred embodiments illustrated in the accompanying drawings.

A case in which a tube structure having a right-angled connection bent tube shape (hereinafter, also referred to as an L-shaped tube shape) is used and a tubular body having a slit-shaped opening portion provided in the tube structure is used as a soundproof structure will be described below as a representative example. However, the invention is not limited thereto.

Figure 1:
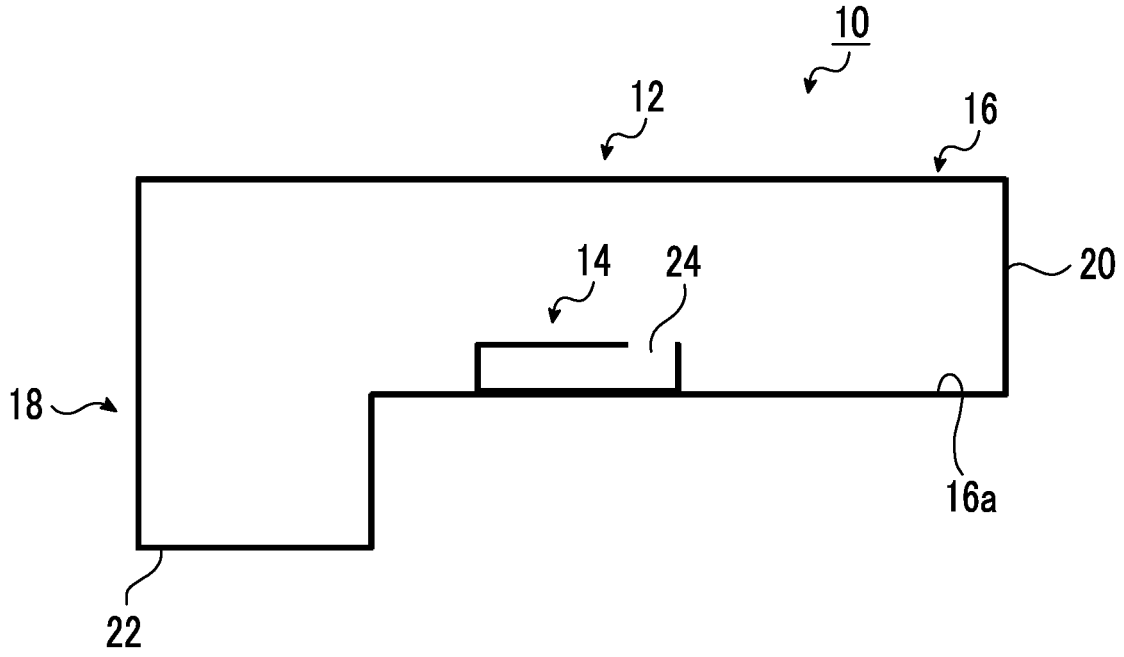
FIG. 1 is a cross-sectional view schematically illustrating an example of a soundproof system according to an embodiment of the invention.
Figure 2:
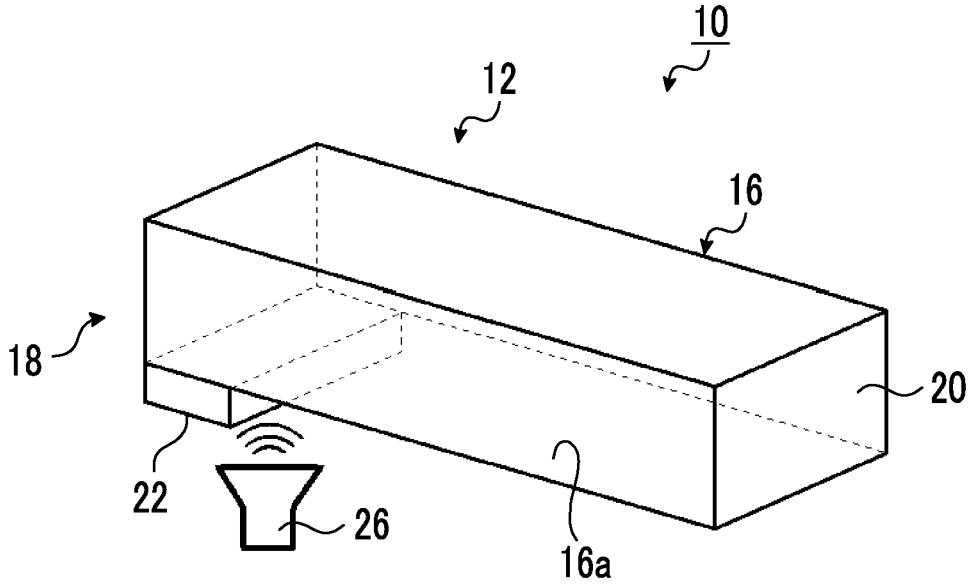
FIG. 2 is a perspective view schematically illustrating a tube structure used in the soundproof system illustrated in FIG. 1.
Figure 3:
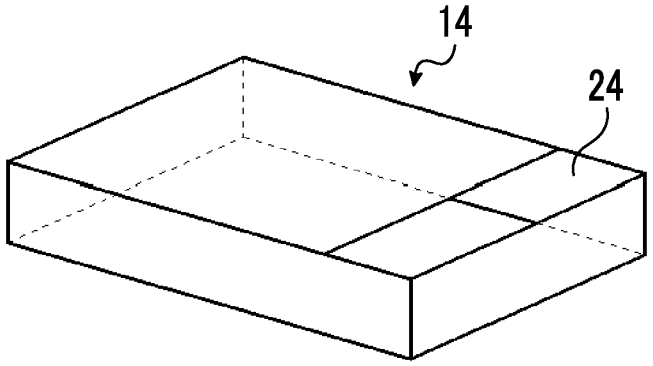
FIG. 3 is a perspective view schematically illustrating a soundproof structure used in the soundproof system illustrated in FIG. 1.

FIG. 1 is a cross-sectional view schematically illustrating an example of a soundproof system according to an embodiment of the invention. FIG. 2 is a perspective view schematically illustrating a tube structure used in the soundproof system illustrated in FIG. 1. FIG. 3 is a perspective view schematically illustrating a soundproof structure used in the soundproof system illustrated in FIG. 1.

A soundproof system 10 according to an embodiment of the invention illustrated in FIGS. 1, 2, and 3 includes an L-shaped tube structure 12, such as an L-shaped duct, and a tubular body 14 which is the soundproof structure provided the tube structure 12.

The tube structure 12 includes a straight tube portion 16 which has a rectangular shape in a cross-sectional view and a bent portion 18 which has a rectangular shape in a cross-sectional view and is bent from the straight tube portion 16 at a right angle. The straight tube portion 16 has one end that forms an opening end 20 and the other end that is connected to the bent portion 18. The bent portion 18 has one end that forms an opening end 22 and the other end that is connected to the other end of the straight tube portion 16. The tube structure 12 resonates at a specific frequency and functions as an air column resonator. In the invention, the term "bending" is not limited to a bending angle of $\pi/2$ (90°) as illustrated in FIG. 1, but means a bending angle of 5° or more.

The tubular body 14 is provided in the straight tube portion 16 of the tube structure 12 so as to be disposed on a bottom 16*a* of the straight tube portion 16. The position where the tubular body 14 is disposed in the tube structure 12 will be described in detail below. The tubular body 14 has a rectangular parallelepiped shape. The tubular body 14 is the soundproof structure that functions as an air column resonator.

As such, it is preferable that the soundproof structure is a resonator with respect to sound waves and is the tubular body 14 having an opening portion 24.

The tubular body 14 has the slit-shaped opening portion 24 that is formed along one end surface. The opening portion 24 of the tubular body 14 is an opening on which sound is incident or from which sound is radiated. Here, the opening portion 24 is disposed in the tube structure 12 (for example, in the straight tube portion 16). In addition, the tubular body 14 may have a radiation surface on which sound is incident or from which sound is radiated, instead of the opening portion 24.

In the soundproof system 10 according to the invention, the L-shaped tube structure 12 having a cylindrical shape and the soundproof structure which is the tubular body 14 are arranged such that (1) a natural resonance mode of the tube structure 12, (2) the position of the opening portion 24 of the tubular body 14 which is the soundproof structure, and (3) the back length (distance) of the tubular body 14 which is the soundproof structure are optimized.

That is, in the invention, it is possible to obtain (i) a transmission loss peak caused by air column resonance and (ii) a transmission loss peak caused by a duct coupling mode (non-resonance) which is the basic principle of the invention, which will be described below, by providing the tubular body 14 which is the soundproof structure at an optimal position in the tube structure 12. In the related art, the transmission loss peak is only the air column resonance peak. In contrast, in the invention, the parameters (1) to (3) are optimized to further obtain the peak caused by non-resonance.

In the invention, as such, it is possible to obtain the non-resonance peak, and the resonance peak and the non-resonant peak are combined to obtain not only transmission loss caused by resonance but also transmission loss caused by non-resonance. Therefore, it is possible to obtain transmission loss in a wide band, without using, for example, a porous material, unlike JP2016-095070A.

The duct coupling mode that is the mechanism of the basic principle of the invention will be described in detail with reference to FIGS. 4A to 4D and FIG. 5.

Figure 4A:
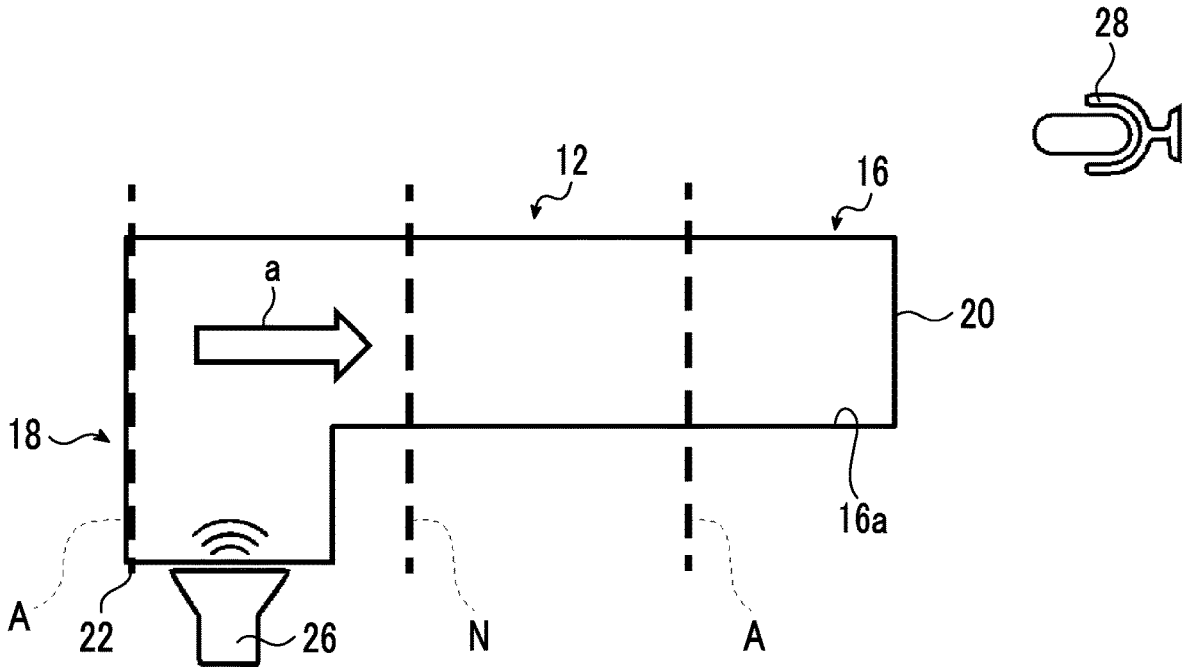
FIG. 4A is a cross-sectional view schematically illustrating a standing wave with a frequency which is formed in the tube structure used in the soundproof system illustrated in FIG. 1.
Figure 4B:
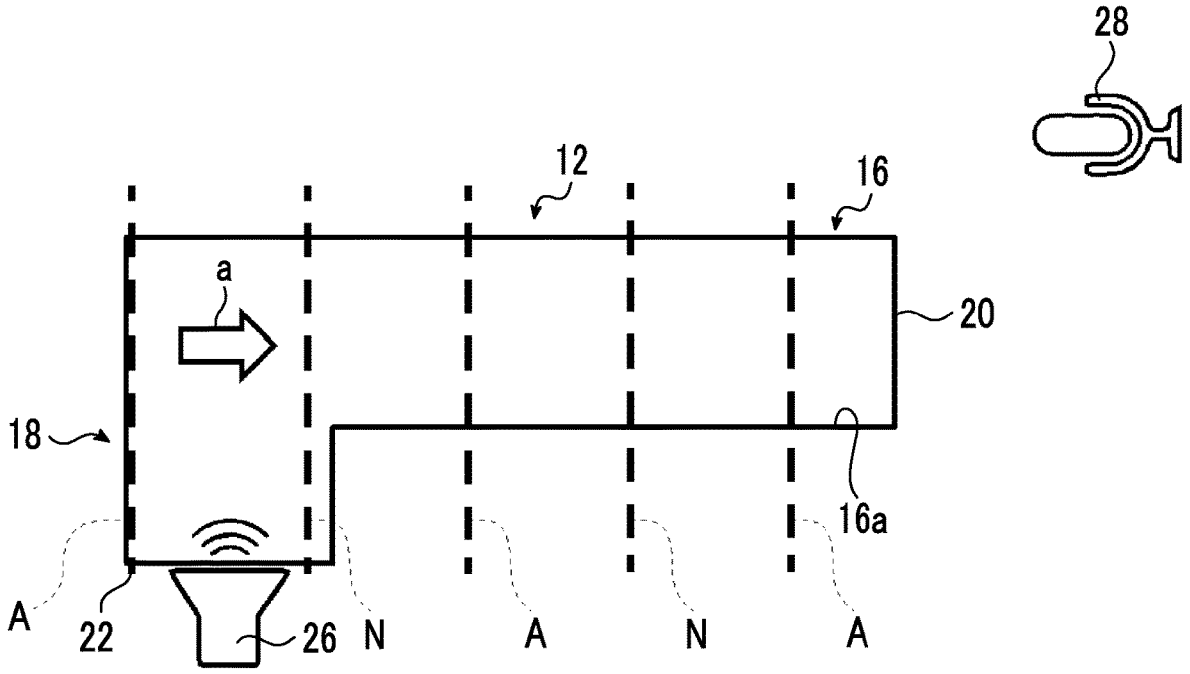
FIG. 4B is a cross-sectional view schematically illustrating a standing wave with another frequency which is formed in the tube structure used in the soundproof system illustrated in FIG. 1.
Figure 4C:
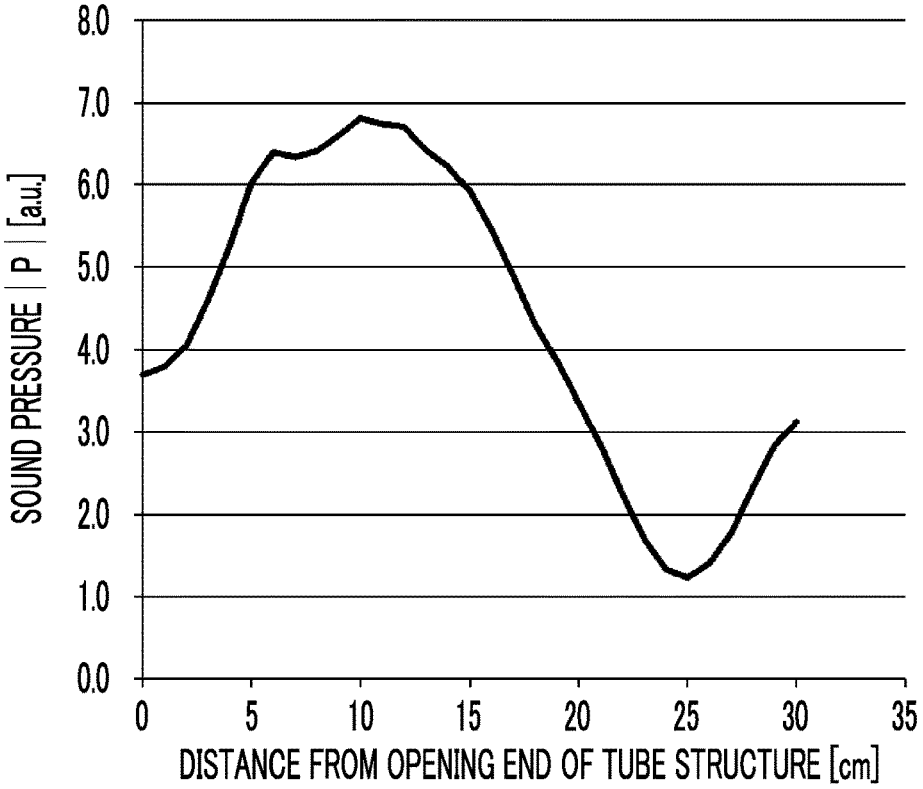
FIG. 4C is a graph illustrating the relationship between the distance from an opening end of the tube structure illustrated in FIG. 4A and a sound pressure distribution of the standing wave with a frequency.
Figure 4D:
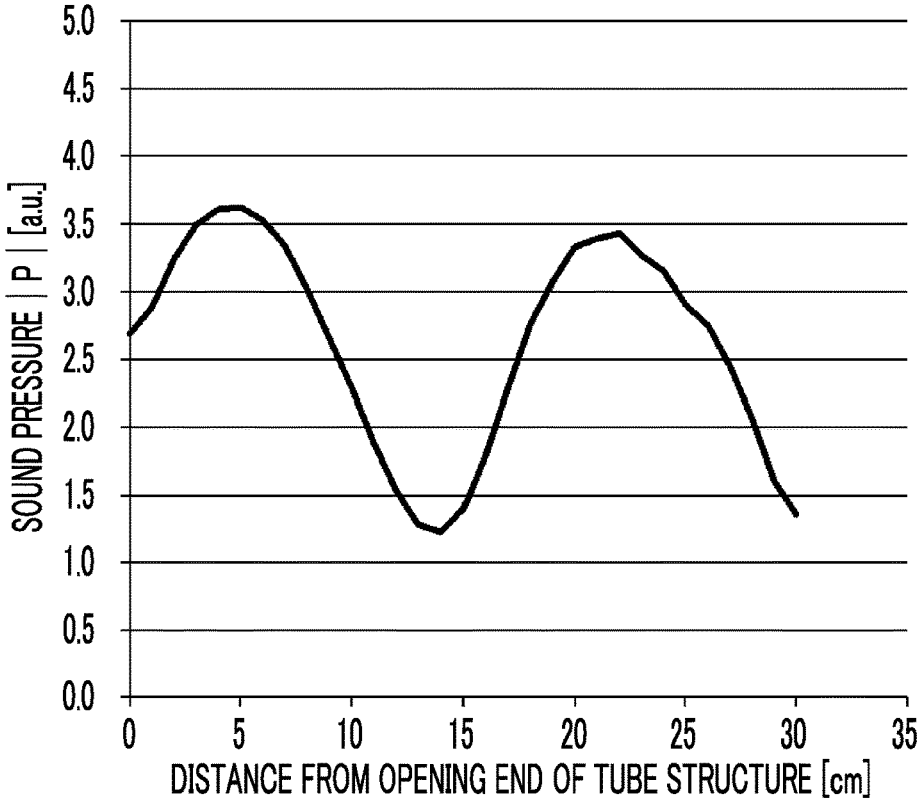
FIG. 4D is a graph illustrating the relationship between the distance from the opening end of the tube structure illustrated in FIG. 4B and a sound pressure distribution of the standing wave with another frequency.
Figure 5:
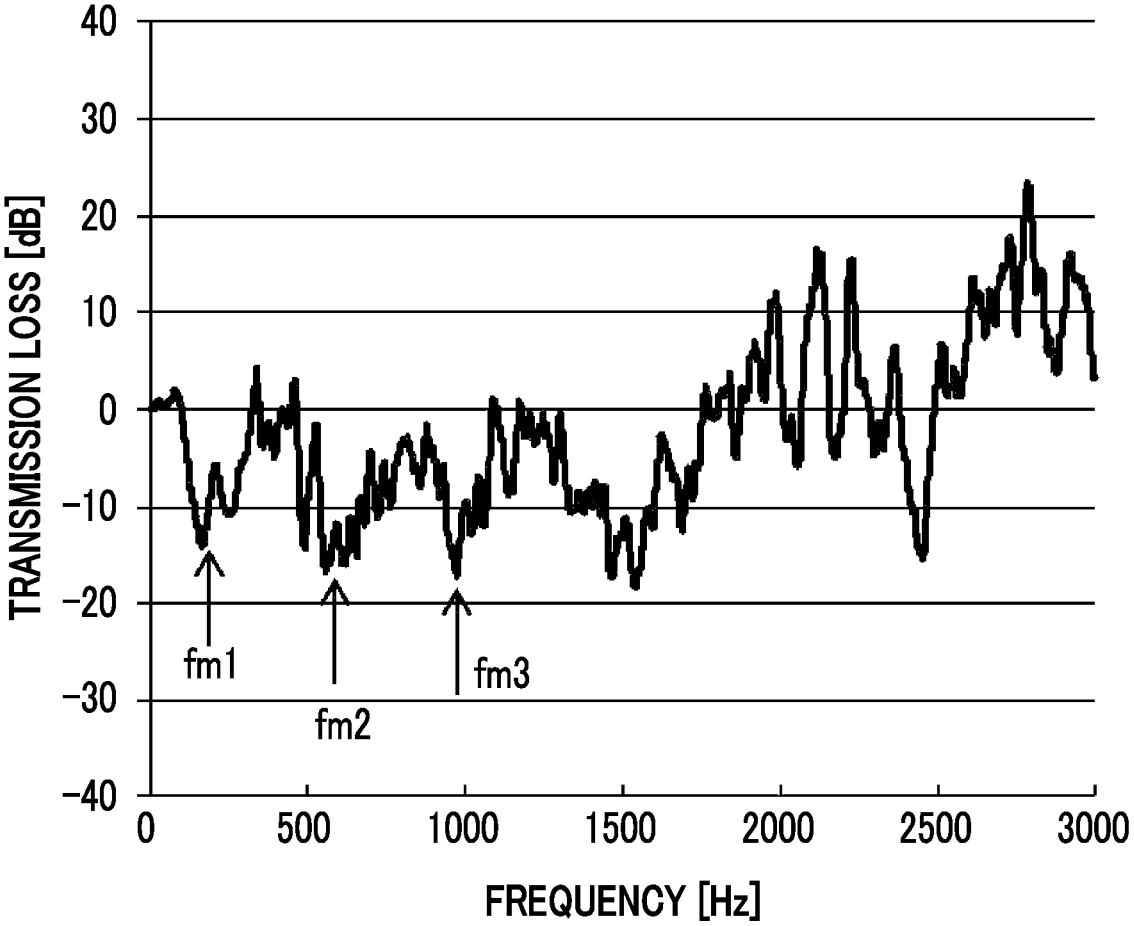
FIG. 5 is a graph illustrating the relationship between the transmission loss and frequency of the tube structure illustrated in FIGS. 4A and 4B.

FIGS. 4A and 4B are cross-sectional views schematically illustrating standing waves with different frequencies which are formed in the tube structure used in the soundproof system illustrated in FIG. 1. FIGS. 4C and 4D are graphs illustrating the relationship between the distance from the opening end of the tube structure illustrated in FIGS. 4A and 4B and the sound pressure distribution of the standing waves with different frequencies. FIG. 5 is a graph illustrating the relationship between the frequency and transmission loss of the tube structure illustrated in FIGS. 4A and 4B.

In the invention, as illustrated in FIGS. 4A and 4B, sound propagated from a sound source (speaker) 26 attached to the opening end 22 of the bent portion 18 of the tube structure 12 flows in a direction indicated by an arrow a and is radiated from the opening end 20 of the straight tube portion 16 of the tube structure 12. The sound radiated from the opening end 20 is measured by a measurement device, such as a microphone 28 that is provided close to the opening end 20.

The tube structure 12, such as a duct, having one or more opening ends 20 illustrated in FIGS. 4A and 4B has a sound frequency that is easy to transmit and a sound frequency that is difficult to transmit, which are uniquely determined by the structure size (for example, the size and dimensions) of the tube structure 12. That is, the tube structure 12 acts as a sound selection filter and the filtering performance of the sound selection filter is determined by the tube structure 12. This is caused by the phenomenon that, as illustrated in FIGS. 4A and 4B, sound with a specific frequency (600 Hz in FIG. 4A and 1000 Hz in FIG. 4B) or wavelength corresponding to the size and shape of the tube structure 12 forms a uniform and stable standing wave (that is, a mode) in the tube structure 12 and the sound forming the mode is particularly likely to be radiated from the tube structure 12. In the example illustrated in FIGS. 4A and 4B, in the dimensions of the straight tube portion 16 of the tube structure 12 are 88 mm×163 mm (cross section)×394 mm (length) and the dimensions of the bent portion 18 are 64 mm×163 mm (cross section)×27 mm (length). The example illustrated in FIG. 4A is a 600-Hz sound mode (standing wave) in this case and is a mode that has antinodes A disposed on both sides and a node N disposed between the antinodes A. The example illustrated in FIG. 4B is a 1000-Hz sound mode (standing wave) in this case and is a mode that has antinodes A disposed on both sides and at the center and nodes N disposed between adjacent antinodes A. In this embodiment, in a case in which the measurement microphone 28 measures the absolute value of sound pressure along a waveguide of the tube structure 12, the position (place) where the absolute value of the sound pressure is the maximum is defined as the antinode A of the sound pressure and the position (place) where the absolute value of the sound pressure is the minimum is defined as the node N of the sound pressure.

The graphs illustrated in FIGS. 4C and 4D show the measurement results of sound pressure (absolute value) obtained while the leading end of the measurement microphone 28 is shifted from the vicinity of the center of the cross section of the waveguide at the opening end 20 of the tube structure 12 to the back side of the tube structure 12 at an interval of 1 cm and show the measurement results at 600 Hz and the measurement results at 1000 Hz, respectively. As can be seen from the graphs illustrated in FIGS. 4C and 4D, a position indicating the maximum value of the sound pressure is the position of the antinode A of the sound pressure illustrated in FIGS. 4A and 4B and a position indicating the minimum value of the sound pressure is the position of the node N of the sound pressure illustrated in FIGS. 4A and 4B. Here, the position which is closest to the opening end 20 of the tube structure 12 and where the sound pressure has the maximum value (antinode A) is 10 cm (600 Hz) and 5 cm (1000 Hz).

In the tube structure 12, the modes that easily come out from the tube structure 12 at a plurality of frequencies are formed and the frequencies fm1, fm2 (600 Hz), fm3 (1000

Hz), • • • at which transmission loss has the minimum value appear as illustrated in FIG. 5. That is, the resonance of the tube structure 12 can be defined to occur at the frequency where transmission loss has the minimum value in the dependence of transmission loss on the frequency.

In other words, the frequency where transmission loss is the minimum may mean a frequency forming the mode. The formation of the mode means that, in a case in which the tube structure 12 is, for example, an L-shaped duct and the distance from an opening portion of the duct to an L-shaped portion is L0, a resonance phenomenon in which a $\lambda/4$ air column resonance mode appears at a frequency satisfying $L0=(2\pi+1)\lambda/4$ occurs.

In the following drawings and simulation results, the dimensions of the tube structure 12 are as described above. In addition, the position of the sound source (speaker) 26 is the position of the opening end 22 of the bent portion 18 of the tube structure 12. The microphone 28 is provided at a position that is 500 mm away from the opening end 20 and is 500 mm away from the bottom 16*a* of the straight tube portion 16 in the upward direction.

Figure 6:
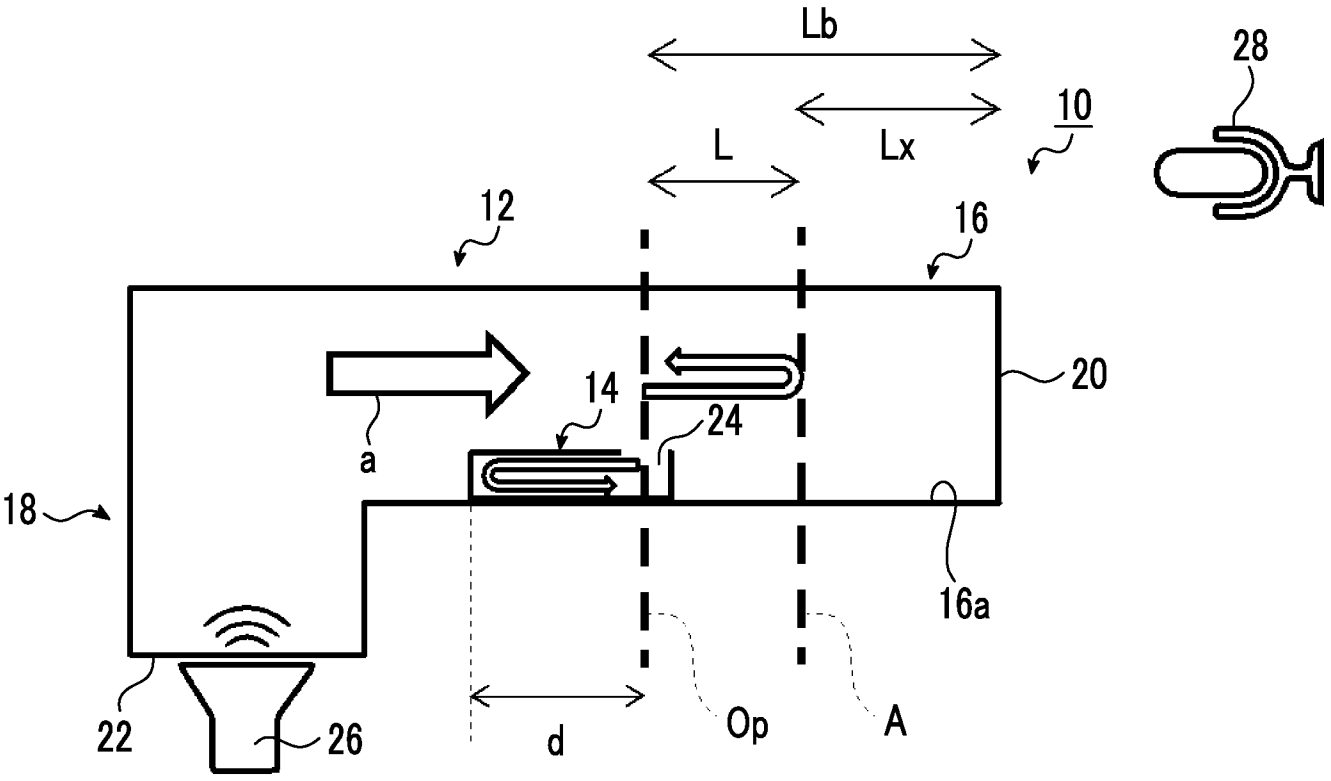
FIG. 6 is a cross-sectional view schematically illustrating the principle of sound insulation according to an embodiment of the invention in the soundproof system illustrated in FIG. 1.

The research results of the inventors proved that, in a case in which a soundproof structure, such as the tubular body 14 having the opening portion 24, was used in the tube structure 12 as illustrated in FIG. 6, a stable mode was allowed to escape to the soundproof structure (14), which made it difficult for sound to come out (that is, which made it possible to increase transmission loss). In addition, the research results proved that, for the position where the soundproof structure (14) having the opening portion 24 was disposed, there was an optimal position for allowing the stable mode to escape to the soundproof structure (14).

In other words, it is considered that the stable mode which is formed only by the tube structure 12 and is peculiar to the tube structure 12 changes in a case in which the soundproof structure, such as the tubular body 14, is provided, a duct coupling mode which is a stable mode in a connection path of the tube structure 12 and the soundproof structure (tubular body 14), is formed, and sound is closed in that portion.

Further, the effect of making it difficult for sound to further come out to the outlet side of the tube structure 12 due to the strong interference between the re-radiated sound of the sound which has escaped to the soundproof structure, such as the tubular body 14, and return sound in the tube structure 12 is obtained.

First Embodiment

The inventors have found that the following requirements were necessary in order to increase the transmission losses in (i) and (ii) at the same time.

In the first embodiment of the invention, the following Expression (1) needs to be satisfied in a case in which a phase difference between sound incident on the soundproof structure, such as the tubular body 14, and sound re-radiated from the soundproof structure (14) is defined a phase difference as $\theta1$ [rad.], the distance between the position of the opening portion 24 or the radiation surface of the soundproof structure, such as the tubular body 14, and the position, where sound pressure has the maximum value among one or more maximum values of the sound pressure formed in the tube structure 12, in the tube structure 12 is L, the wavelength of sound is $\lambda$, and a phase difference $\theta2$ [rad.] is defined as $2\pi\times2L/\lambda$ [rad.]:

$$|\theta1-\theta2|\leq\pi/2 \quad (1).$$

Here, the range in which the phase difference $\theta1$ [rad.] between the incident sound and the sound re-radiated from the soundproof structure (14) can be obtained is from 0 to $2\pi$. That is, $0\leq\theta1\leq2\pi$ is satisfied.

In the invention, the setting of the range in which the phase difference $\theta1$ can be obtained to 0 to $2\pi$ is synonymous with regarding $\theta1$ as $\theta s$, that is, $\theta1=\theta s$ in the invention even in a case in which the phase difference $\theta1$ is beyond the range of 0 to $2\pi$, for example, $\theta1=\theta s+2n\pi$ (where $0\leq\theta s\leq2\pi$, n: integer) is established. In the following description, the unit [rad.] of the phase difference is omitted.

Here, sound pressure formed in the tube structure 12 means sound pressure forming a sound pressure distribution in the tube structure 12 and is preferably means sound pressure forming standing waves in the tube structure 12. In the invention, it is preferable that the sound forming the sound pressure distribution in the tube structure 12 has the same frequency or wavelength as sound incident on the tubular body 14 which is the soundproof structure.

In addition, the frequency or wavelength of target sound in the invention means the frequency or wavelength of the sound forming the sound pressure distribution in the tube structure 12 and means the same frequency or wavelength as that of sound incident on the tubular body 14 which is the soundproof structure. It is preferable that the frequency or wavelength of the sound is, for example, a specific frequency or wavelength of sound corresponding to the size and shape of the tube structure 12 and is the frequency or wavelength of sound forming a uniform and stable standing wave (that is, a mode).

In the invention, the position of the opening portion 24 of the soundproof structure, such as the tubular body 14, means the position of the center of gravity of the opening portion 24 and the position of the radiation surface of the soundproof structure means the position of the center of gravity of the radiation surface.

The above-mentioned Expression (1) is based on the following principle.

This principle will be described in detail with reference to FIG. 6.

FIG. 6 is a cross-sectional view schematically illustrating the principle of sound insulation according to an embodiment of the invention in the soundproof system illustrated in FIG. 1.

As illustrated in FIG. 6, in the soundproof system 10 according to the invention in which the soundproof structure, such as the tubular body 14, is present in the tube structure 12, in a case in which sound passes through the tube structure 12, the sound waves flowing through the tube structure 12 are divided into sound that is incident on the soundproof structure, such as the tubular body 14, and sound that flows through the tube structure 12 without being incident on the soundproof structure.

The sound that has entered the soundproof structure, such as the tubular body 14, comes out from the tubular body 14 again and returns to the inside of the tube structure 12. In this case, there is a finite phase difference $\theta1$ between the sound that enters the tubular body 14 and the sound that comes out from the tubular body 14. For example, in a case in which the soundproof structure is the tubular body 14 (tubular structure: a structure such as a cylinder), there is a sound phase difference $\theta1=2\pi\times2d/\lambda$ that depends on the back distance d of the tubular body 14. Here, as illustrated in FIG. 6, the phase difference $\theta1$ is said to be a phase difference between sound that enters the soundproof structure, such as the tubular body 14, through the opening portion 24 and sound that is re-radiated from the opening portion 24 at a position Op of the opening portion 24. The position Op of the opening portion 24 is defined as the position of the center of gravity of an opening surface of the opening portion 24. In addition, the back length or the back distance d of the tubular body 14 is defined as the length from the position Op of the opening portion 24 which is the position of the center of gravity of the opening surface of the opening portion 24 to the end of the tubular body 14.

In contrast, for the sound that flows through the tube structure 12 without being incident on the soundproof structure, for example, there is a mode (independent standing wave) defined by the structure of the tube structure 12, or the maximum value or the antinode A of sound pressure and the minimum value or the node N of sound pressure are formed by the interference between the sound wave reflected from the opening end 20 of the tube structure 12 and the sound wave flowing toward the opening end 20 through the tube structure 12. In this case, the sound that has flowed through the tube structure 12 without being incident on the soundproof structure returns again and passes through the soundproof structure, such as the tubular body 14, in the opposite direction. In a case in which the distance between the position of the antinode A of the standing wave or the position where sound pressure has the maximum value (the position of the structure 12, for example, the position of the antinode A) and the opening portion 24 or the radiation surface of the soundproof structure is L, the phase difference θ2 that occurs in a case in which sound travels to the antinode A of the standing wave (mode) or the position where sound pressure has the maximum value and returns from the position is $2\pi\times 2L/\lambda$. Here, the phase difference θ2 is said to be the phase difference of the sound that returns to the position Op of the opening portion 24 without entering the soundproof structure, such as the tubular body 14, as illustrated in FIG. 6.

In FIG. 6, in a case in which the distance between the opening end 20 of the tube structure 12 and the position (for example, the position of the antinode A) where sound pressure has the maximum value in the tube structure 12 is defined as Lx and the distance between the opening end 20 of the tube structure 12 and the position Op of the opening portion 24 of the tubular body 14 is defined as Lb, the distance L is given as a difference (L=Lb−Lx) between the distance Lb and the distance Lx. The distance L is half of the round-trip distance of the sound flowing through the tube structure 12.

In the invention, it is preferable that the position where sound pressure has the maximum value in the tube structure 12 is the antinode A of the standing wave of sound formed by the tube structure 12.

In addition, it is preferable that the tube structure 12 has resonance and satisfies the above-mentioned Expression (1) at the resonance frequency fm.

In a case in which there is no or little difference between the phase difference of the sound which enters the soundproof structure, such as the tubular body 14, through the opening portion 24 and then comes out from the opening portion 24 again and the phase difference of the sound which flows through the tube structure 12 without entering the soundproof structure and returns to the position Op of the opening portion 24 of the soundproof structure, such as the tubular body 14, that is, there is no or little difference between the phase difference θ1 and the phase difference θ2, the amplitude of the sound that returns through the tube structure 12 increases. Therefore, sound is likely to stay inside the tube structure 12, which results in an increase in transmission loss.

Here, it is preferable that the tubular body 14 is a resonator and satisfies the above-mentioned Expression (1) at a frequency different from the resonance frequency of the tubular body 14.

In addition, it is preferable that transmission loss is the maximum at the frequency of the sound wave satisfying the above-mentioned Expression (1).

The transmission loss is the maximum in a case in which $|\theta 1-\theta 2|=0$ is established and is gradually reduced from the maximum value.

In contrast, in a case in which the value of $|\theta 1-\theta 2|$ is greater than $\pi/2$, a strong duct coupling mode is less likely to be formed than that in a case in which $|\theta 1-\theta 2|=0$ is established. In this case, transmission loss may be reduced and sound may be amplified (sound is likely to come out from the tube structure). Therefore, it is necessary to limit the value of $|\theta 1-\theta 2|$ to $\pi/2$ or less (that is, $|\theta 1-\theta 2|\leq\pi/2$).

Second Embodiment

The inventors have also found that the following requirements are satisfied in order to increase in the transmission losses in (i) and (ii) at the same time.

In a second embodiment of the invention, it is necessary to satisfy the following Expression (2) in a case in which a soundproof structure is the tubular body 14, the tubular body 14 has a resonance frequency fr [Hz], the distance between the opening portion 24 of the tubular body 14 and a position (for example, the antinode A), where sound pressure has the maximum value and which is closest to the position Op of the opening portion 24 in the same direction as the flow direction of sound at the highest frequency fma [Hz] among frequencies lower than the resonance frequency fr among frequencies fm1, fm2, fm3, . . . (see FIG. 5) at which transmission loss is the minimum in a transmission loss spectrum of the tube structure 12, in the tube structure 12 is La1, and the wavelength at the frequency fma is $\lambda_{fma}$:

$$0\leq La1\leq\lambda_{fma}/4 \quad (2).$$

The above-mentioned Expression (2) is based on the following principle.

This principle will be described in detail with reference to FIG. 7.

Figure 7:
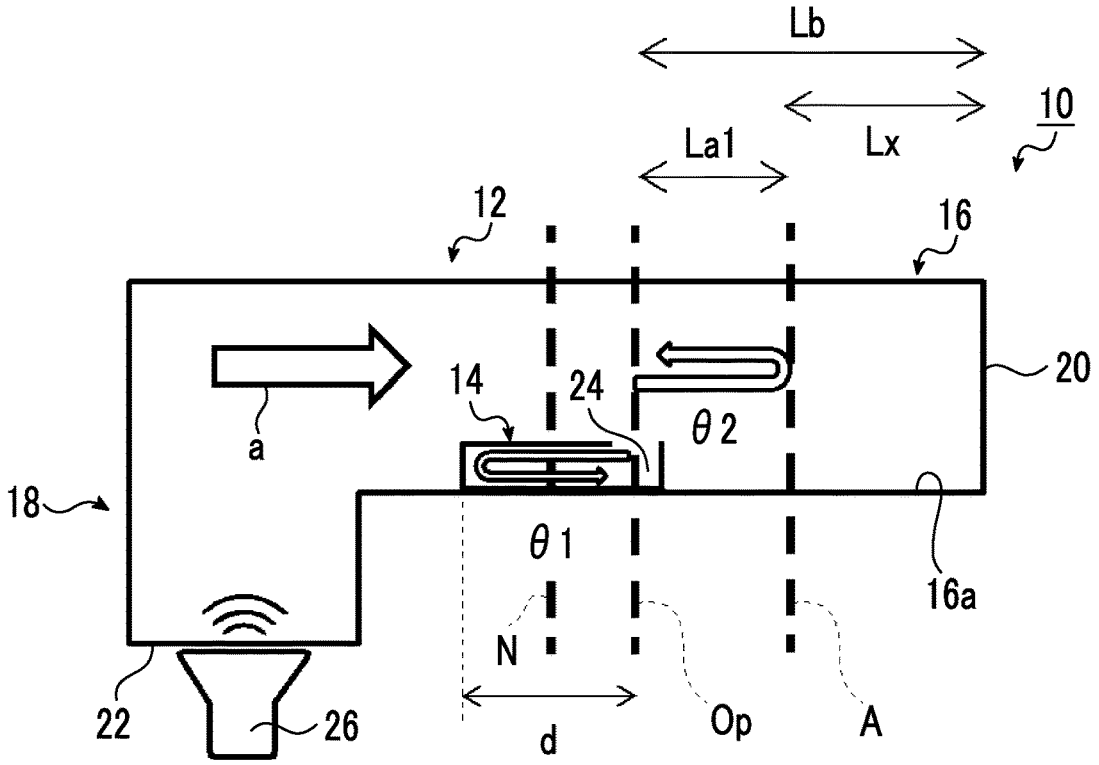
FIG. 7 is a cross-sectional view schematically illustrating the principle of sound insulation according to another embodiment of the invention in the soundproof system illustrated in FIG. 1.

FIG. 7 is a cross-sectional view schematically illustrating the principle of sound insulation according to another embodiment of the invention in the soundproof system illustrated in FIG. 1.

In the soundproof system illustrated in FIG. 7, in a case in which sound from the sound source 26 flows through the tube structure 12 and the difference between the phase difference θ1 of sound which enters the tubular body 14 through the opening portion 24 and then comes out from the opening portion 24 again and the phase difference θ2 of sound which flows through the tube structure 12 without entering the tubular body 14 and returns to the position (for example, the position of the center) Op of the opening portion 24 of the tubular body 14 is small, sound is likely to stay inside the tube structure 12 and transmission loss increases.

In addition, in the invention, the flow direction of sound can be defined as a direction from the inside of the tube structure 12 to the opening end 20 in a case in which there is one output-side opening end 20. In a case in which there are a plurality of tube structures 12 and a sound source 26, such as a noise source, is not present in the tube structure 12, sound pressure is measured in the opening end surfaces of the plurality of tube structures 12 by the measurement microphone 28 and the flow direction of sound can be defined as a direction from the opening end surface (for example, the opening surface of the opening end 22 in the example illustrated in FIG. 7) in which sound pressure is high to the opening end surface (for example, the opening surface of the opening end 20 in the example illustrated in FIG. 7) in which sound pressure is low. In a case in which the sound source 26 which is a noise source is present in the tube structure 12 (see FIG. 26 which will be described below), the flow direction of sound can be defined as a direction from the sound source 26 to the opening end 20 of the tube structure 12.

Here, as illustrated in FIG. 7, in a case in which the sound flowing through the tube structure 12 is sound with a frequency fma at which sound is likely to be transmitted through the tube structure 12 and transmission loss has the minimum value, the position (for example, the position of the antinode A) where sound that has flowed through the position Op of the opening portion 24 of the tubular body 14 is reflected to the position Op of the opening portion 24 and sound pressure has the maximum value in the tube structure 12 is closer to the opening end 20 of the tube structure 12 than the position Op of the opening portion 24. In contrast, the position (for example, the position of the node N) where the pressure of the sound with the frequency fma flowing through the tube structure 12 has the minimum value in the tube structure 12 is closer to the opening end 22 of the tube structure 12 than the opening portion 24 of the tubular body 14. Therefore, the distance La1 between the position Op of the opening portion 24 of the tubular body 14 and the position (for example, the position of the antinode A) where sound pressure has the maximum value in the tube structure 12 is equal to or less than $\lambda_{fma}/4$ which is the distance between the position (for example, the position of the antinode A) where sound pressure has the maximum value in the tube structure 12 and the position (for example, the position of the node N) where sound pressure has the minimum value in the tube structure 12.

That is, in this embodiment, the distance La1 is limited to a value that is equal to or greater than 0 and equal to or less than $\lambda_{fma}/4$ and satisfies the above-mentioned Expression (2) in order to increase the effect of insulating sound with the frequency fma lower than the resonance frequency fr.

From the above, it is preferable that the position Op of the opening portion 24 of the tubular body 14 is different from the position of the node N (is a position other than the node N).

As illustrated in FIG. 7, the distance La1 is said to be half of the round-trip distance of sound through the tube structure 12 and is given as the difference between the distance Lb and the distance Lx (L=Lb−Lx).

In this embodiment, the reason why the distance La1 is limited to the above-mentioned Expression (2) is as follows.

First, since the frequency fma which is on the low frequency side is lower than the resonance frequency of the tubular body 14, the phase difference θ1 ($=2d\times2\pi/\lambda_{fma}$) is less than π at the frequency fma. In contrast, the phase difference θ2 caused by reciprocating the distance La1 is π ($=2La1\times2\pi/\lambda_{fma}$) in a case in which the distance La1 is $\lambda_{fma}/4$.

Since θ1 is less than π, La1≤λ/4 needs to be satisfied in order to approximate the value of |θ1−θ2| to 0.

In this embodiment, in a case in which the back length (back distance) of the tubular body 14 is defined as d, it is preferable to satisfy the following Expression (3):

$$d<\lambda_{fma}/4 \quad (3).$$

The sound which has entered the tubular body 14 through the opening portion 24 and has been radiated from the opening portion 24 again reciprocates the back length d. Since the difference between the phase difference θ1 corresponding to the distance d that the sound entering the tubular body 14 reciprocates and the phase difference θ2 corresponding to the distance La1 that the sound flowing through the tube structure 12 reciprocates is small, it is preferable that the back length d of the tubular body 14 satisfies the above-mentioned Expression (3) as long as La1 satisfies the above-mentioned Expression (2). This is the reason why the back length d is limited to the above-mentioned Expression (3).

In this embodiment, it is preferable that the opening portion 24 of the tubular body 14 is provided within the wavelength $\lambda_{fma}$ from the opening end 20 of the tube structure 12.

The opening end 20 of the tube structure 12 is close to the position (for example, the position of the node N) where sound pressure has the minimum value as viewed from the position (for example, the position of the antinode A) where sound pressure has the maximum value in the tube structure 12, but does not reach the position. Therefore, the distance Lx between the opening end 20 of the tube structure 12 and the position (for example, the position of the antinode A) where sound pressure has the maximum value in the tube structure 12 is less than $\lambda_{fma}/2$. That is, $Lx<\lambda_{fma}/2$ is satisfied.

In contrast, the distance Lb between the opening end 20 of the tube structure 12 and the position Op of the opening portion 24 of the tubular body 14 is given as the sum (Lb=La1+Lx) of the distance La1 and the distance Lx. Therefore, $Lb=La1+Lx<\lambda_{fma}/4+\lambda_{fma}/2=3\lambda_{fma}/4<\lambda_{fma}$ is established and $Lb<\lambda_{fma}$ is satisfied.

That is, the distance from the opening end 20 of the tube structure 12 to the position Op of the opening portion 24 of the tubular body 14 is less than $\lambda_{fma}$. Therefore, it is preferable that the opening portion 24 of the tubular body 14 is disposed within the wavelength $\lambda_{fma}$ from the opening end 20 of the tube structure 12.

This is the reason.

Third Embodiment

In addition, the inventors have also found that the following requirements are satisfied in order to increase in the transmission losses in (i) and (ii) at the same time.

In a third embodiment of the invention, it is preferable to satisfy the following Expression (4) in a case in which a soundproof structure is the tubular body 14, the tubular body 14 has a resonance frequency fr [Hz], the distance between the opening portion 24 of the tubular body 14 and a position (for example, the antinode A), where sound pressure has the maximum value and which is closest to the position Op of the opening portion 24 in the same direction as the flow direction of sound at the lowest frequency fmb [Hz] among frequencies higher than the resonance frequency fr among the frequencies fm1, fm2, fm3, . . . (see FIG. 5) at which transmission loss is the minimum in the transmission loss spectrum of the tube structure 12, in the tube structure 12 is La2; and the wavelength at the frequency fmb is $\lambda_{fmb}$:

$$\lambda_{fmb}/4\leq La2\leq\lambda_{fmb}/2 \quad (4).$$

The above-mentioned Expression (4) is based on the following principle.

This principle will be described in detail with reference to FIG. 8.

Figure 8:
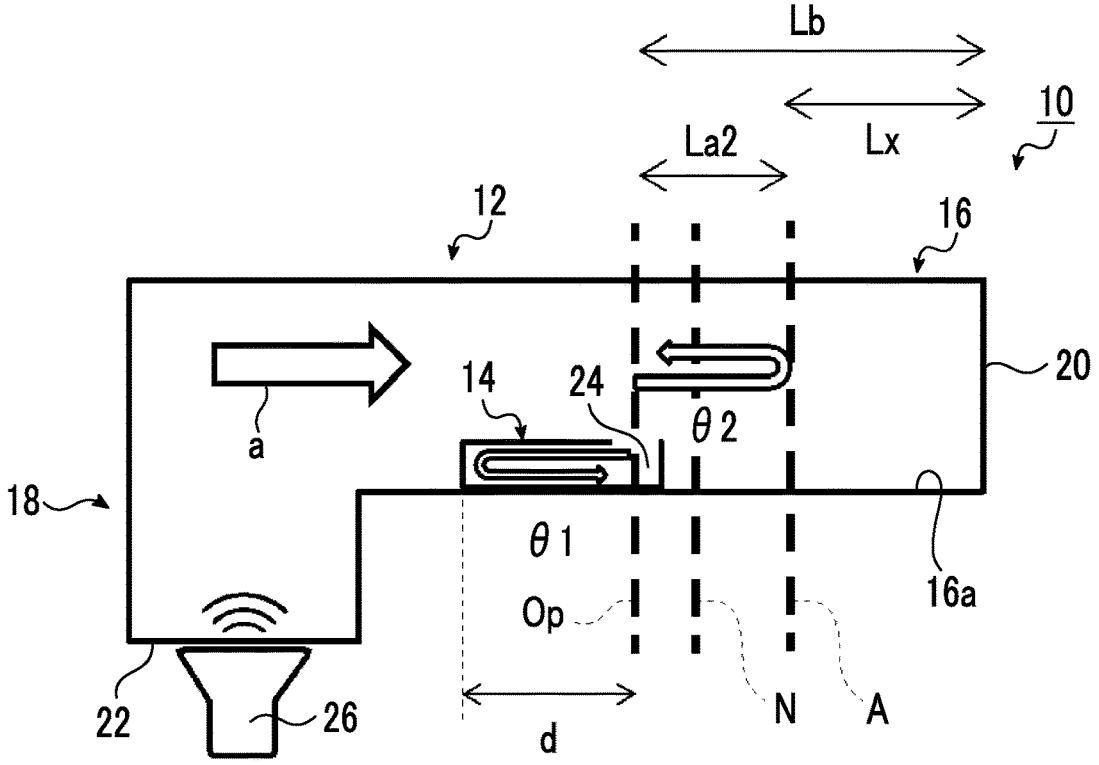
FIG. 8 is a cross-sectional view schematically illustrating the principle of sound insulation according to still another embodiment of the invention in the soundproof system illustrated in FIG. 1.

FIG. 8 is a cross-sectional view schematically illustrating the principle of sound insulation according to still another embodiment of the invention in the soundproof system illustrated in FIG. 1.

In the soundproof system illustrated in FIG. 8, as described above, in a case in which sound from the sound source 26 flows through the tube structure 12 and there is a small difference between the phase difference θ1 of sound which enters the tubular body 14 through the opening portion 24 and then comes out from the opening portion 24 again and the phase difference θ2 of sound which flows through the tube structure 12 without entering the tubular body 14 and returns to the position (for example, the position of the center) Op of the opening portion 24 of the tubular body 14, sound is likely to stay inside the tube structure 12 and transmission loss increases.

Here, as illustrated in FIG. 8, in a case in which the sound flowing through the tube structure 12 is sound with the frequency fmb at which the sound is likely to be transmitted through the tube structure 12 (that is, transmission loss has the minimum value), the position (for example, the position of the antinode A) where sound that has flowed through the position Op of the opening portion 24 of the tubular body 14 is reflected to the position Op of the opening portion 24 (that is, sound pressure has the maximum value) in the tube structure 12 is closer to the opening end 20 of the tube structure 12 than the position Op of the opening portion 24. In contrast, the position (for example, the position of the node N) where the pressure of the sound with the frequency fmb flowing through the tube structure 12 has the minimum value in the tube structure 12 is between the position Op of the opening portion 24 of the tubular body 14 and the position (for example, the position of the antinode A) where sound pressure has the maximum value in the tube structure 12. Therefore, the distance La2 between the position Op of the opening portion 24 of the tubular body 14 and the position (for example, the position of the antinode A) where sound pressure has the maximum value in the tube structure 12 is equal to or greater than $\lambda_{fmb}/4$ which is the distance between the position (for example, the position of the antinode A) where sound pressure has the maximum value in the tube structure 12 and the position (for example, the position of the node N) where sound pressure has the minimum value in the tube structure 12. In addition, as illustrated in FIG. 8, since the position (for example, the position of the node N) where sound pressure has the minimum value in the tube structure 12 is closer to the position Op of the opening portion 24 of the tubular body 14 than the position (for example, the position of the antinode A) where sound pressure has the maximum value in the tube structure 12, the distance La2 is equal to or less than $\lambda_{fmb}/2$.

That is, in this embodiment, the distance La2 is limited to a value that is equal to or greater than $\lambda_{fmb}/4$ and equal to or less than $\lambda_{fmb}/2$ and satisfies the above-mentioned Expression (4) in order to increase the effect of insulating sound with the frequency fmb higher than the resonance frequency fr.

From the above, it is preferable that the position Op of the opening portion 24 of the tubular body 14 is different from the position of the node N (is a position other than the node N).

As illustrated in FIG. 8, the distance La2 is said to be half of the round-trip distance of sound through the tube structure 12 and is given as the difference between the distance Lb and the distance Lx (L=Lb−Lx).

In this embodiment, the reason why the distance La2 is limited to the above-mentioned Expression (4) is as follows.

First, since the frequency fmb which is on the high frequency side is higher than the resonance frequency of the tubular body 14, the phase difference θ1 ($=2d\times2\pi/\lambda_{fmb}$) is greater than π at the frequency fmb. In contrast, the phase difference θ2 caused by reciprocating the distance La2 is π ($=2La2\times2\pi/\lambda_{fmb}$) in a case in which the distance $La2=\lambda_{fmb}/4$. Since θ1 is greater than π, θ2 needs to be greater than π in order to approximate the value of |θ1−θ2| to 0. Therefore, $La2\geq\lambda/4$ needs to be satisfied.

On the other hand, in a case in which the distance La2 is greater than λ/2, sound pressure exceeds an adjacent antinode. Therefore, the position of the maximum value of the sound pressure defined as described above changes. As a result, La2 defined as described above is less than λfmb/4 and is inappropriate. Therefore, $La2\leq\lambda/2$ needs to be satisfied.

In this embodiment, it is preferable that the opening portion 24 of the tubular body 14 is disposed within the wavelength $\lambda_{fmb}$ from the opening end 20 of the tube structure 12.

The opening end 20 of the tube structure 12 is close to the position (for example, the position of the node N) where sound pressure has the minimum value as viewed from the position (for example, the position of the antinode A) where sound pressure has the maximum value in the tube structure 12, but does not reach the position. Therefore, the distance Lx between the opening end 20 of the tube structure 12 and the position (for example, the position of the antinode A) where sound pressure has the maximum value in the tube structure 12 is less than $\lambda_{fmb}/2$. That is, $Lx<\lambda_{fmb}/2$ is satisfied.

In contrast, the distance Lb between the opening end 20 of the tube structure 12 and the position Op of the opening portion 24 of the tubular body 14 is given as the sum (Lb=La2+Lx) of the distance La2 and the distance Lx. Therefore, $Lb=La2+Lx<\lambda_{fmb}/2+\lambda_{fma}/2=\lambda_{fmb}$ is established and $Lb<\lambda_{fmb}$ is satisfied.

That is, the distance from the opening end 20 of the tube structure 12 to the position Op of the opening portion 24 of the tubular body 14 is less than $\lambda_{fmb}$. Therefore, it is preferable that the opening portion 24 of the tubular body 14 is provided within the wavelength $\lambda_{fmb}$ from the opening end 20 of the tube structure 12.

This is the reason.

In the second and third embodiments of the invention, similarly, it is preferable that the opening portion 24 of the tubular body 14 is provided within the wavelengths $\lambda_{fma}$ and $\lambda_{fmb}$ from the opening end 20 of the tube structure 12, respectively. Therefore, in the first embodiment, similarly, it is preferable that the opening portion 24 of the tubular body 14 is provided within the wavelength λ from the opening end 20 of the tube structure 12.

However, in the second embodiment and third embodiments of the invention, it is preferable that the opening portion 24 of the tubular body 14 is provided at a position other than the node N, for example, a position where sound pressure has the minimum value. Here, the position other than the node N means a position that is about $\lambda_{fma}/8$ or $\lambda_{fmb}/8$ away from the node N except the node N.

Figure 9:
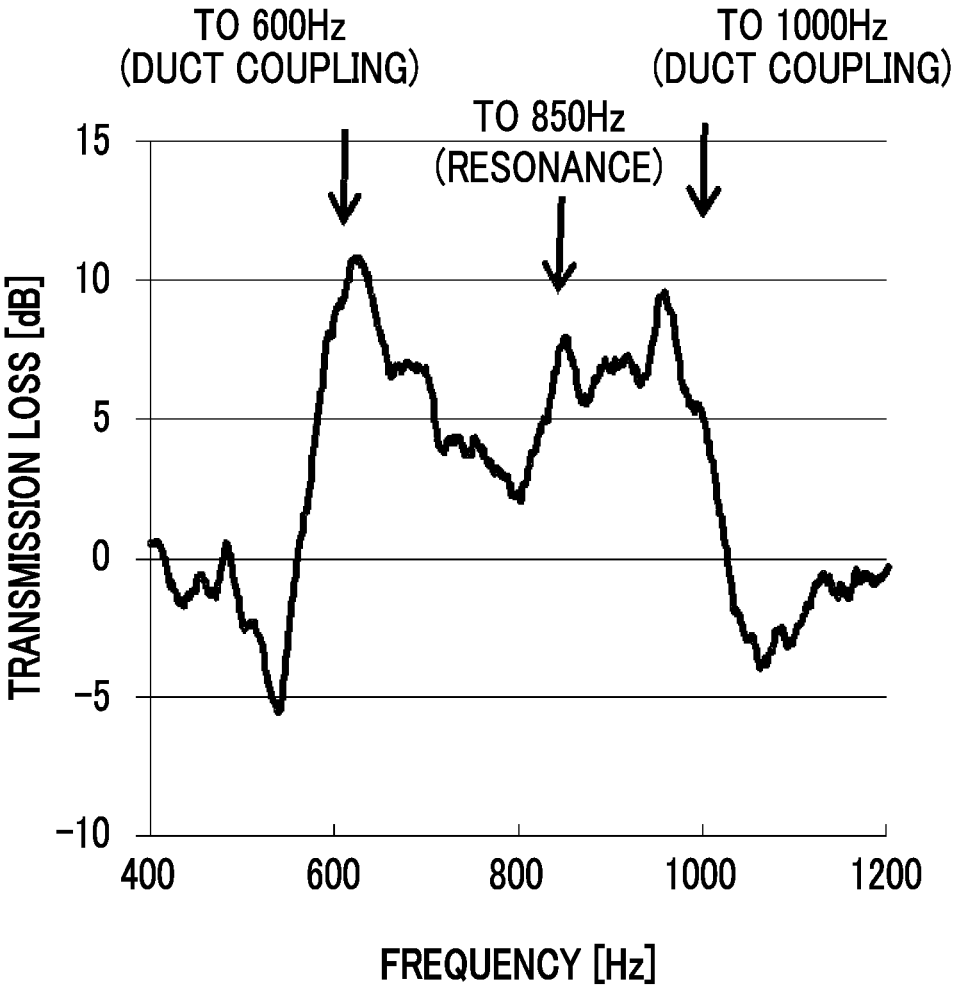
FIG. 9 is a graph illustrating the relationship between the transmission loss and frequency of the soundproof system according to the invention.

FIG. 9 is a graph illustrating the relationship between the transmission loss and frequency of the soundproof system 10 illustrated in FIG. 1 in which the tubular body 14 illustrated in FIG. 3 is provided on the bottom 16*a* of the straight tube portion 16 in the straight tube portion 16 of the tube structure 12 illustrated in FIG. 2.

The dimensions of the straight tube portion 16 and the bent portion 18 of the tube structure 12 illustrated in FIG. 2 are as described in FIGS. 4A and 4B. The dimensions of the tubular body 14 illustrated in FIG. 3 are a back length d of 100 mm, a height of 20 mm, and a width of 163 mm and the slit dimensions of the opening portion 24 are a slit width of 20 mm and a slit length of 163 mm.

For the position where the tubular body 14 is disposed in the soundproof system 10 illustrated in FIG. 1, the position Op of the opening portion 24 is 170 mm away from the opening end 20 of the tube structure 12. That is, the distance Lb is 170 mm.

Sound flows from the sound source 26 that is provided at the opening end 22 of the bent portion 18 of the tube structure 12 and the microphone 28 measures sound radiated from the opening end 20 of the straight tube portion 16 of the tube structure 12.

In the measurement results, the resonance frequency fr of the tubular body 14 is 850 Hz and the maximum frequency fma of the low frequency side (fr>fma) and the maximum frequency fmb of the high frequency side (fr<fmb) in the frequency range in which the transmission loss of the tube structure 12 is the minimum are 600 Hz and 1000 Hz, respectively. As such, in a case in which the soundproof structure, such as the tubular body 14, has the resonance frequency fr [Hz], it is preferable that fr≤1000 Hz is satisfied in order to achieve soundproofing with a small size which insulates sound with a low frequency in a wide band.

Here, $|\theta 1-\theta 2|$ at 600 Hz is 0.66 (see Example 3 which will be described below) and is equal to or less than $\pi/2$ and $|\theta 1-\theta 2|$ at 1000 Hz is 0.92 (see Example 8 which will be described below) and is equal to or less than $\pi/2$.

As a result, the value of $|\theta 1-\theta 2|$ satisfies the above-mentioned Expression (1) that is a requirement of the first embodiment of the invention.

Therefore, as illustrated in FIG. 9, the maximum value (peak) of transmission loss is obtained at 600 Hz in addition to a resonance frequency of 850 Hz and the duct coupling mode can be obtained. In addition, the maximum value (peak) of transmission loss is obtained at 1000 Hz and the duct coupling mode can be obtained. That is, in a case in which $|\theta 1-\theta 2|\pi/2$ is satisfied at a plurality of frequencies, it is possible to obtain the duct coupling mode at the same time.

In addition, the distance Lx at 600 Hz is 100 mm and the distance La1 is 70 mm. Since the wavelength $\lambda_{fma}$ at 600 Hz is 575 mm (=345×10³/600), La1 (=70 mm)<$\lambda_{fma}/4$ (=575/4=144) is satisfied.

As can be seen from the results, the above-mentioned Expression (2) which is a requirement of the second embodiment of the invention is also satisfied.

Further, the distance Lx at 1000 Hz is 50 mm and the distance La1 is 120 mm.

Since the wavelength $\lambda_{fma}$ at 1000 Hz is 345 mm (=345×10³/1000), $\lambda_{fma}/4$ (=345/4=86)<La1 (=120 mm)<$\lambda_{fma}/2$ (=345/2=173) is satisfied.

As can be seen from the results, the above-mentioned Expression (3) which is a requirement of the third embodiment of the invention is also satisfied.

In the invention, the tube structure 12 may be any structure as long as it has at least one opening end 20 and forms a tube shape and may be used for many purposes. It is preferable that the tube structure 12 has an air ventilation function. Therefore, it is preferable that the tube structure 12 has opening ends as both ends and both ends are open. In a case in which one end of the tube structure 12 is attached to the sound source, only the other end may be open and may be an opening end.

Figure 25:
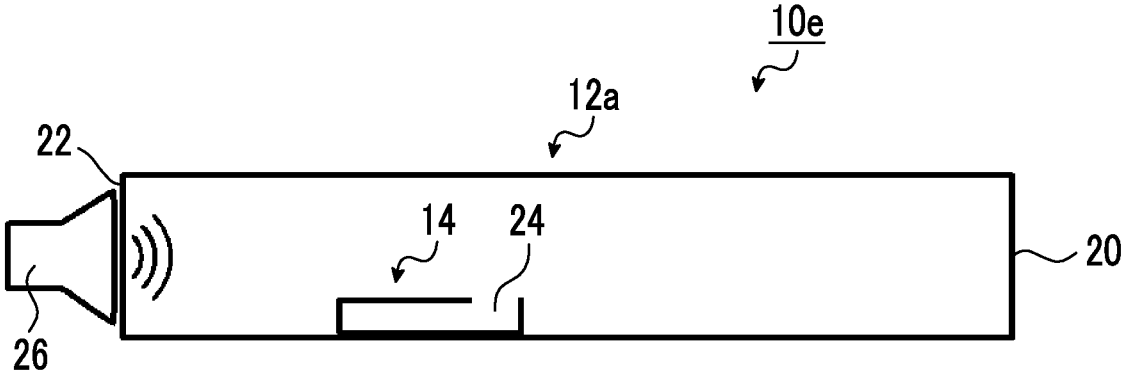
FIG. 25 is a cross-sectional view schematically illustrating an example of a soundproof system according to yet still another embodiment of the invention.
Figure 26:
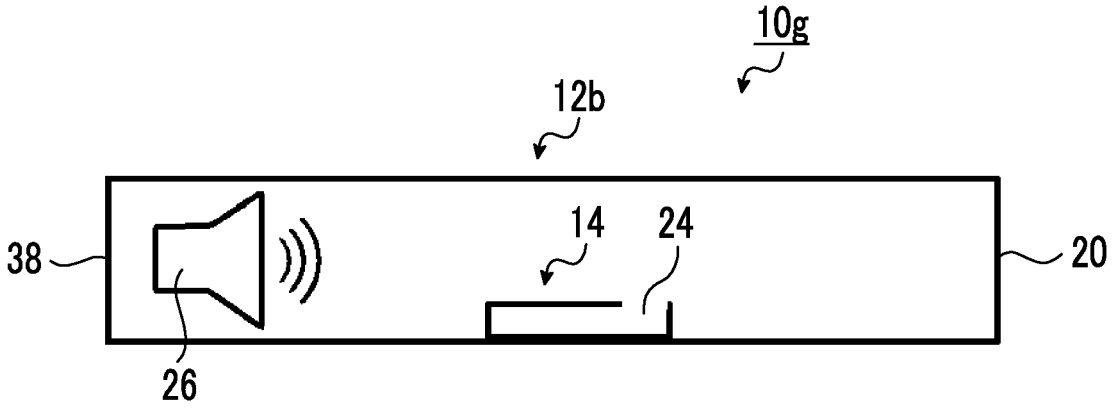
FIG. 26 is a cross-sectional view schematically illustrating an example of a soundproof system according to still yet another embodiment of the invention.

The shape of the tube structure 12 is not particularly limited. For example, the tube structure 12 may be a bent tube having a rectangular shape in a cross-sectional view as illustrated in FIG. 2. For example, the tube structure 12 may have a linear tube shape as illustrated in FIG. 25 or FIG. 26 which will be described below. It is preferable that the tube structure 12 is bent.

Figure 43:
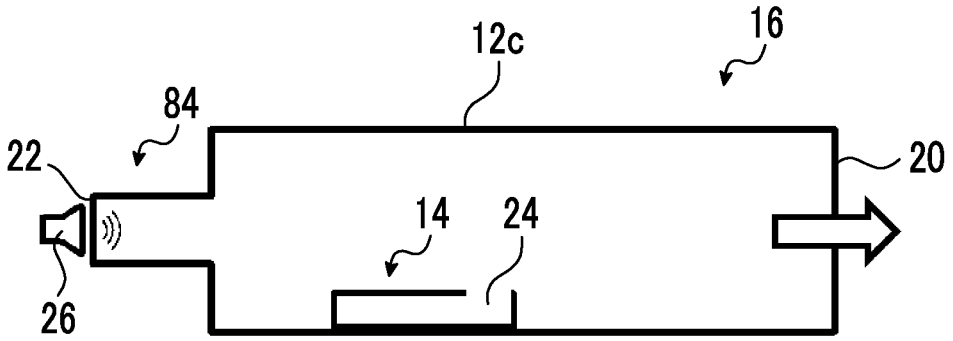
FIG. 43 is a cross-sectional view schematically illustrating an example of a soundproof system according to still yet another embodiment of the invention.
Figure 44:
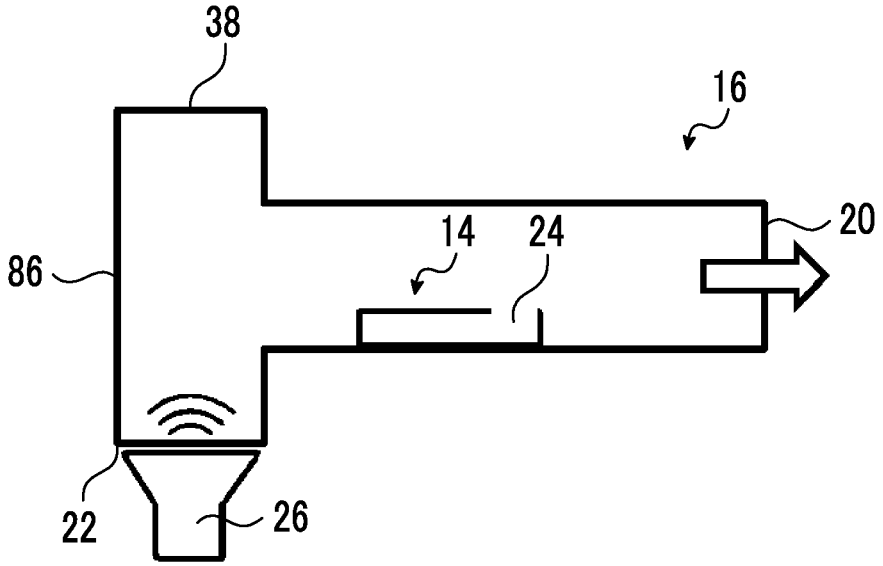
FIG. 44 is a cross-sectional view schematically illustrating an example of a soundproof system according to yet still another embodiment of the invention.
Figure 45:
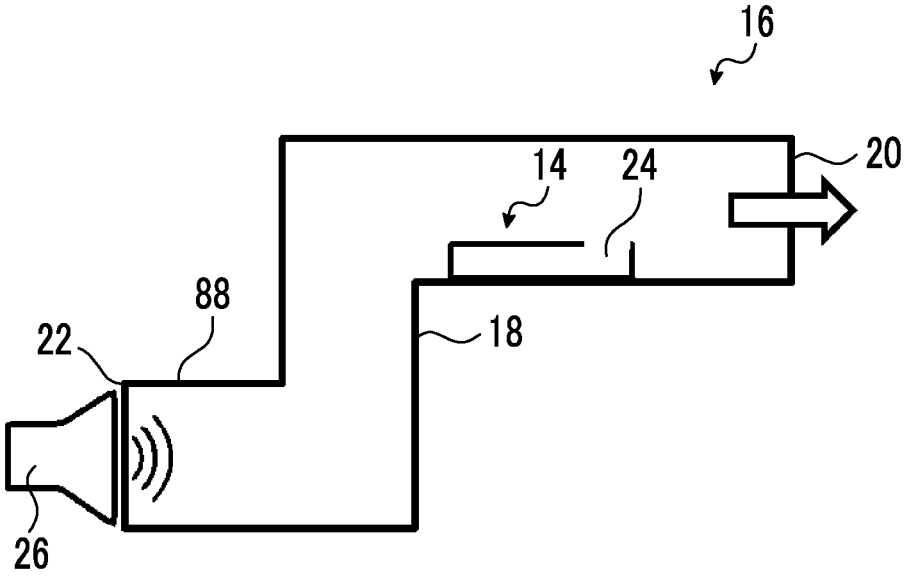
FIG. 45 is a cross-sectional view schematically illustrating an example of a soundproof system according to still yet another embodiment of the invention.

In addition, the tube structure 12 may have, for example, tube shapes illustrated in FIGS. 43, 44, and 45.

Further, the cross-sectional shape of the tube structure 12 is not particularly limited and may be any shape. For example, the cross-sectional shape of the tube structure 12 may be a regular polygon, such as a square, a regular triangle, a regular pentagon, or a regular hexagon. Furthermore, for example, the cross-sectional shape of the tube structure 12 may be a triangle including an isosceles triangle and a right triangle or a polygon, such as a rectangle including a rhombus and a parallelogram, a pentagon, or as a hexagon, or may be an irregular shape. In addition, the cross-sectional shape of the tube structure 12 may be a circle or an ellipse. Further, the cross-sectional shape of the tube structure 12 may change in the middle of the tube structure 12.

Examples of the tube structure 12 and the soundproof structure, such as the tubular body 14, include tube structures, such as ducts and mufflers, which are directly or indirectly attached to, for example, industrial apparatuses, transportation apparatuses, or general household appliances and soundproof structures, such as the tubular body 14. Examples of the industrial apparatus include copiers, blowers, air conditioners, ventilation fans, pumps, power generators, and various types of manufacturing apparatuses that emit sound, such as coating machines, rotating machines, and conveyors. Examples of the transportation apparatus include vehicles, trains, and airplanes. Examples of the general household appliance include refrigerators, washing machines, dryers, televisions, copiers, microwave ovens, game machines, air conditioners, electric fans, PCs, vacuum cleaners, and air cleaners. Examples of the tube structure 12 particularly include ducts for construction and building materials, car mufflers, and ducts attached to electronic apparatuses such as copiers. Furthermore, it is possible to use a ventilation sleeve (having any shape such as a linear shape or a crank box shape) used for building materials.

In the above-mentioned example, the tubular body 14 is used as the soundproof structure according to the invention. However, the invention is not limited thereto. Any soundproof structure may be used as long as the opening portion or the radiation surface of the soundproof structure can be disposed in the tube structure 12 or the soundproof structure may be disposed at any position in the tube structure 12.

Further, the soundproof structure, such as the tubular body 14, is preferably disposed inside the tube structure 12 and is preferably included in the tube structure 12.

The soundproof structure, such as the tubular body 14, and the tube structure 12 may be integrally molded.

The soundproof structure, such as the tubular body 14, may be attached to or detached from the tube structure 12.

For example, in the soundproof system 10 illustrated in FIG. 1, the soundproof structure, such as the tubular body 14, may be attachably and detachably fixed to the tube structure 12 by the following configuration (not illustrated): a magnet is fixed to at least a part of the outer surface of the bottom of the soundproof structure, such as the tubular body 14; a magnet having a different polarity is fixed to at least a part of the corresponding position on the inner surface of the bottom of the tube structure 12; and a set of magnets having different polarities are closely fixed to each other so as to be attachable and detachable. Alternatively, the soundproof structure, such as the tubular body 14, may be attachably and detachably fixed to the tube structure 12 by a hook-and-loop fastener, such as Magic Tape (registered trademark) (manufactured by Kuraray Fastening Co., Ltd.) or a double-sided tape instead of a set of magnets, or the soundproof structure and the tube structure 12 may be fixed by a double-sided tape.

The soundproof structure may be a structure in which at least a part of the inside of the tubular body 14 is filled with a sound absorbing material, such as glass wool, or the sound absorbing material may be provided on at least a part of the inner surface and/or the outer surface of the tubular body 14. That is, it is preferable that the soundproof structure is a structure in which the sound absorbing material is disposed in at least a part of the tubular body 14.

The sound absorbing material is not particularly limited and a known sound absorbing material can be appropriately used. For example, the following materials may be used: foamed materials, such as urethane foam, flexible urethane foam, wood, ceramic particle sintered materials, and phenol foam, and materials containing a very small amount of air; fiber, such as glass wool, rock wool, microfiber (Thinsulate manufactured by 3M Company), floor mat, carpet, melt-blown non-woven fabric, metal non-woven fabric, polyester non-woven fabric, metal wool, felt, insulation board, and glass non-woven fabric, and non-woven fabric materials; a wood wool cement board; a nanofiber-based material such as silica nanofiber; a gypsum board; various known sound absorbing materials or porous sound absorbing materials.

In addition, one or both of the surfaces of the opening portion of the soundproof structure may be covered with a sound absorbing material. For example, the opening surface of the opening portion of the soundproof structure may be covered with a film having a through-hole with a size of several microns to several millimeters. For example, it is possible to use a soundproof structure in which an opening surface of an opening portion is covered with a metal film having a fine through-hole with a diameter of about 0.1 μm to 50 μm, a thickness of 1 μm to 50 μm, and an opening ratio of about 0.01 to 0.3.

The materials forming the tube structure 12 and the soundproof structure, such as the tubular body 14, are not particularly limited as long as they have strength suitable for application to a soundproof target and have resistance to the soundproof environment of the soundproof target. The materials can be selected according to the soundproof target and the soundproof environment of the soundproof target. Examples of the materials forming the tube structure 12 and the soundproof structure, such as the tubular body 14, include metal materials, such as aluminum, titanium, magnesium, tungsten, iron, steel, chromium, chromium molybdenum, nichrome molybdenum, and alloys thereof, resin materials, such as an acrylic resin, polymethyl methacrylate, polycarbonate, polyamideimide, polyarylate, polyetherimide, polyacetal, polyetheretherketone, polyphenylene sulfide, polysulfone, polyethylene terephthalate, polybutylene terephthalate, polyimide, and triacetyl cellulose, carbon fiber reinforced plastic (CFRP), carbon fiber, and glass fiber reinforced plastic (GFRP).

In addition, a plurality of types of these materials may be combined and used.

The materials forming the tube structure 12 and the soundproof structure, such as the tubular body 14, may be the same or different from each other. In a case in which the soundproof structure, such as the tubular body 14 and the tube structure 12 are integrally molded, it is preferable that the materials forming the tube structure 12 and the soundproof structure, such as the tubular body 14, are the same.

A method for disposing the soundproof structure, such as the tubular body 14, in the tube structure 12 includes a case in which the soundproof structure, such as the tubular body 14, is disposed so as to be attachable to and detachable from the tube structure 12 and is not particularly limited. A known method may be used.

In the soundproof system according to the invention, as described above, the soundproof structure may be filled with a known sound absorbing material such as glass wool.

Figure 10:
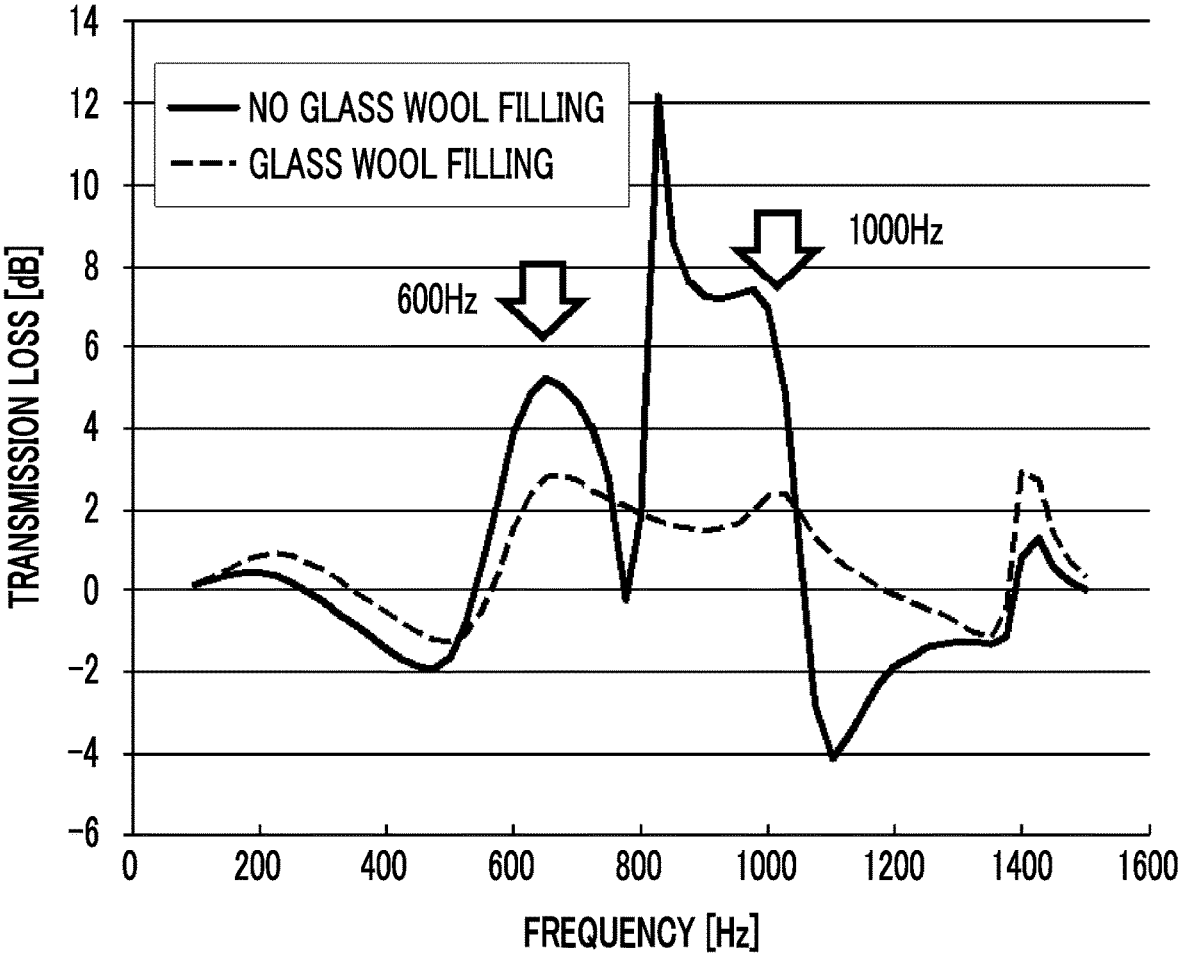
FIG. 10 is a graph illustrating the relationship between the transmission loss and frequency of a soundproof system according to another embodiment of the invention.

FIG. 10 is a graph illustrating the simulation results in a case in which the inside of the tubular body 14 of the soundproof system 10 illustrated in FIG. 1 is filled with glass wool and a case in which the inside of the tubular body 14 is not filled with the glass wool and illustrating the relationship between the transmission loss and frequency of the soundproof system 10.

In the soundproof system 10 illustrated in FIG. 1, transmission loss in a case in which the inside of the tubular body 14 was filled with glass wool (flow resistance is 20000 $Pas/m^2$) and transmission loss in a case in which the inside of the tubular body 14 was not filled glass wool were simultaneously simulated using the COMSOL MultiPhysics Ver 5.3a acoustic module. The simulation results are illustrated in FIG. 10.

In the example illustrated in FIG. 10, the tube structure 12 and the tubular body 14 having the same dimensions as described above are used except that the distance Lb between the position Op of the opening portion 24 of the tubular body 14 and the opening end 20 of the tube structure 12 is 185 mm.

In the example illustrated in FIG. 10, the value of $|\theta 1-\theta 2|$ at 600 Hz is 0.33 and is equal to or less than $\pi/2$. The value of $|\theta 1-\theta 2|$ at 1000 Hz is 1.28 and is equal to or less than $\pi/2$.

As illustrated in FIG. 10, in a case in which the tubular body 14 is filled with glass wool, duct coupling occurs at both 600 Hz and 1000 Hz. At 600 Hz, 1000 Hz, and 850 Hz which is the resonance frequency fr of the tubular body 14, transmission loss is less than that in a case in which the tubular body 14 is not filled with glass wool. However, in a case in which the tubular body 14 is filled with glass wool, the effect of broadening transmission loss is obtained in a region that is in the vicinity of frequencies of 600 Hz and 1000 Hz at which duct coupling occurs and exceeds 1000 Hz (for example, a region from 1000 Hz to 1400 Hz).

As can be seen from the above, the calculation results prove that, even in a case in which the tubular body 14 is filled with glass wool, transmission loss can be obtained in a relatively wide band at 600 Hz and 1000 Hz.

In addition, a soundproof system in which a sound absorbing material is disposed in at least a part of the inner surface and/or the outer surface of a soundproof structure will be described below.

Figure 11:
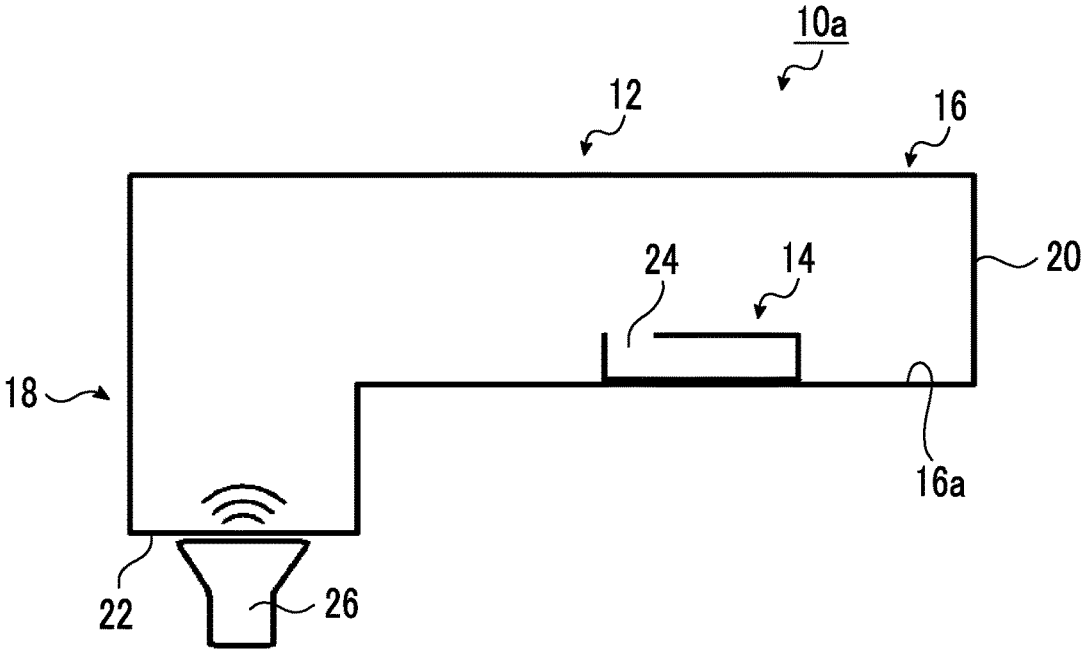
FIG. 11 is a cross-sectional view schematically illustrating another example of the soundproof system according to the invention.

As in a soundproof system **10*a* illustrated in FIG. 11, a soundproof structure, such as the tubular body 14, may be disposed in the tube structure 12 such that the position of the opening portion 24 is opposite to that in the case illustrated in FIG. 1**.

Figure 12:
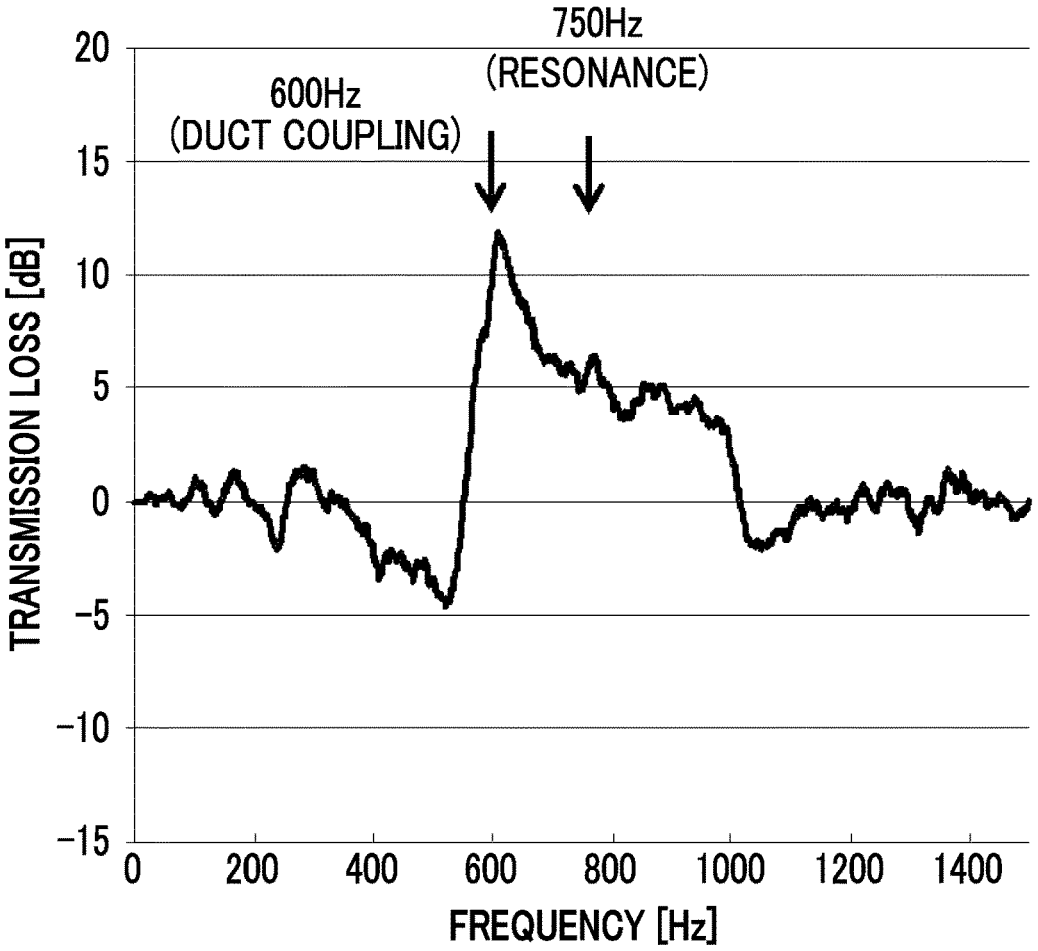
FIG. 12 is a graph illustrating the relationship between the transmission loss and frequency of an example of the soundproof system according to the invention.

FIG. 12 is a graph illustrating the experiment results in a case in which dimensions are the same as the above-mentioned dimensions of the soundproof system 10 illustrated in FIG. 1 except that the back length d of the tubular body 14 is 112 mm and illustrating the relationship between the transmission loss and frequency of the soundproof system 10.

Figure 13:
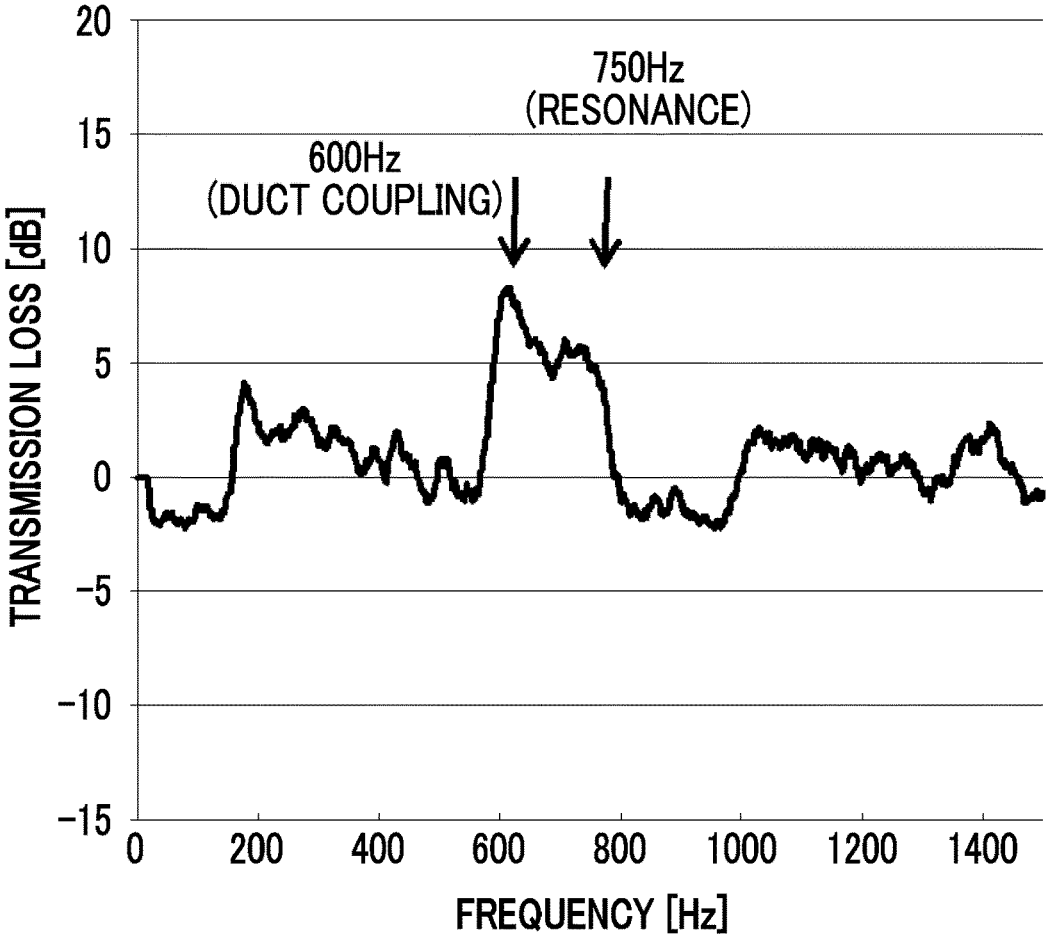
FIG. 13 is a graph illustrating the relationship between the transmission loss and frequency of the soundproof system illustrated in FIG. 11.

FIG. 13 is a graph illustrating the experiment results in a case in which the same dimensions as described above are used except that the back length d of the tubular body 14 is 112 mm in the soundproof system 10*a* illustrated in FIG. 11 and illustrating the relationship between the transmission loss and frequency of the soundproof system 10*a*.

As illustrated in FIGS. 12 and 13, since the resonance frequency fr of the tubular body 14 is 750 Hz and the distance Lb is 170 mm, the value of $|\theta 1-\theta 2|$ at 600 Hz is 0.92 and satisfies the above-mentioned Expression (1).

As can be seen from FIGS. 12 and 13, the conditions of the invention are satisfied regardless of the direction of the tubular body 14 and high transmission loss is obtained at 600 Hz at which duct coupling occurs, and the tubular body 14 may be disposed in any direction.

Figure 14:
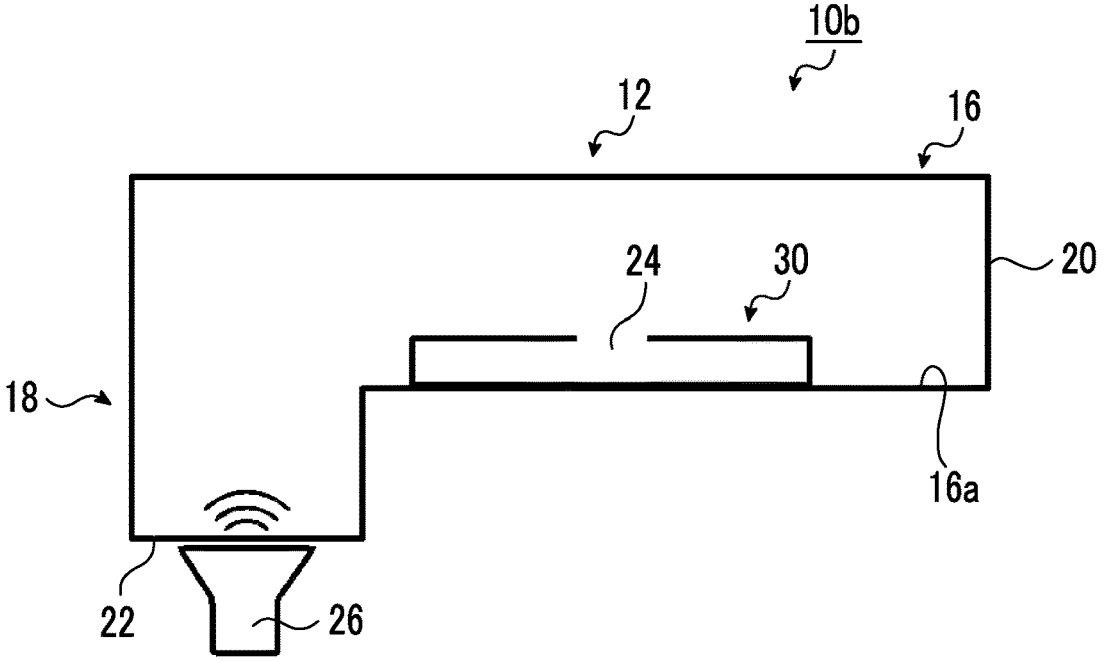
FIG. 14 is a cross-sectional view schematically illustrating an example of a soundproof system according to another embodiment of the invention.

As in a soundproof system 10*b* illustrated in FIG. 14, a tubular body 30 having an opening portion 24 at the center may be provided as the soundproof structure in the tube structure 12. Here, the dimensions of the soundproof system 10*b* are the same as the soundproof system 10 illustrated in FIG. 1 except that the back length d of the tubular body 30 is 200 mm. In this configuration, since the resonance frequency fr of the tubular body 30 is 750 Hz and the distance Lb is 170 mm, the value of $|\theta 1-\theta 2|$ at 600 Hz is 0.66 and the value of $|\theta 1-\theta 2|$ at 1000 Hz is 0.92. Therefore, the value of $|\theta 1-\theta 2|$ satisfies the above-mentioned Expression (1). In addition, the dimension of the portion 24 of the tubular body 30 is 20 mm.

Figure 15:
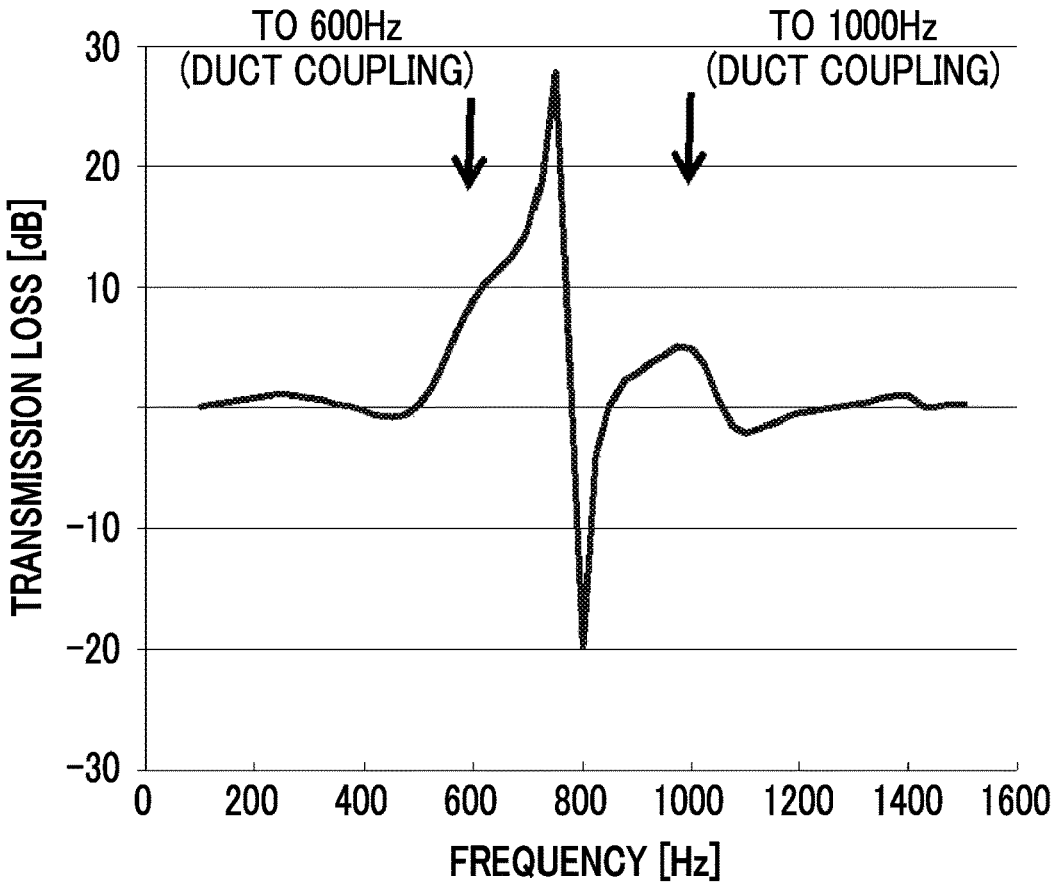
FIG. 15 is a graph illustrating the relationship between the transmission loss and frequency of the soundproof system illustrated in FIG. 14.

FIG. 15 is a graph illustrating the simulation results of the soundproof system 10*b* illustrated in FIG. 14 and illustrating the relationship between the transmission loss and frequency of the soundproof system 10*b*.

As illustrated in FIG. 15, even in a case in which the tubular body 30 having the opening portion 24 at the center is provided in the tube structure 12, the conditions of the invention are satisfied. Therefore, as can be seen from the simulation results, high transmission loss is obtained at 750 Hz that is the resonance frequency fr of the tubular body 30. Duct coupling occurs even at 600 Hz and 1000 Hz and high transmission loss is obtained.

Figure 16:
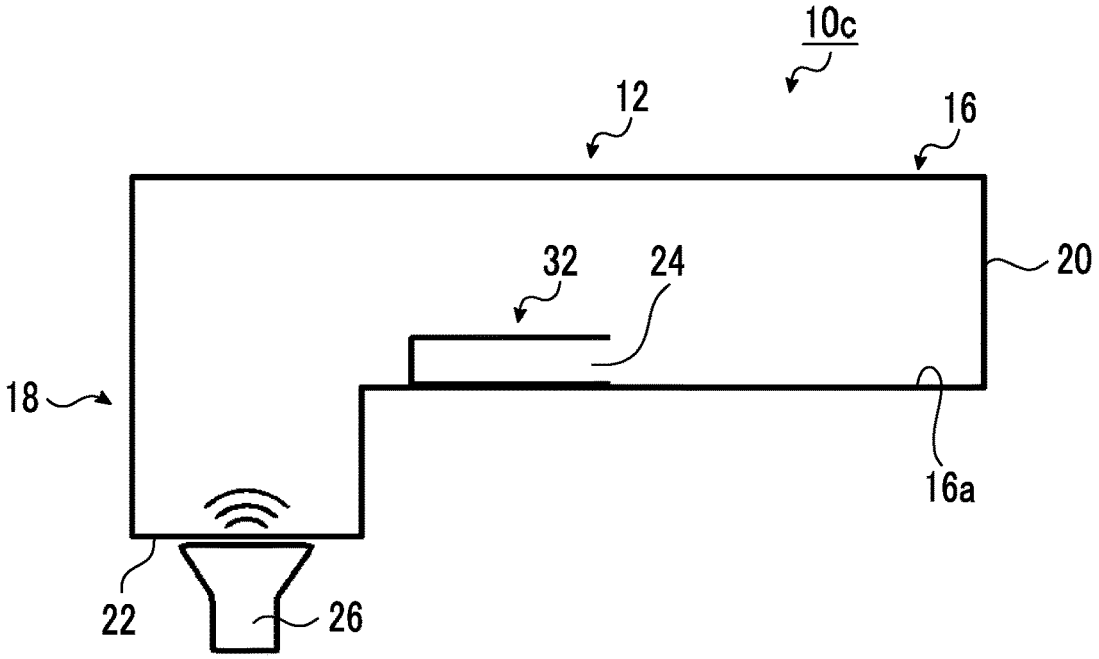
FIG. 16 is a cross-sectional view schematically illustrating an example of a soundproof system according to still another embodiment of the invention.

As in a soundproof system 10*c* illustrated in FIG. 16, a cylindrical body 32 having the opening portion 24 at a right end which is close to the opening end 20 of the tube structure 12 in FIG. 16 may be provided as the soundproof structure in the tube structure 12. Here, the dimensions are the same as the above-mentioned dimensions of the soundproof system 10 illustrated in FIG. 1 except that the opening portion 24 of the cylindrical body 32 is provided at the right end of the cylindrical body 32 in FIG. 16. In addition, instead of the cylindrical body 32 having the opening portion 24, a soundproof structure having a radiation surface at one end close to the opening end 20 of the tube structure 12 may be used.

In this configuration, the resonance frequency fr of the cylindrical body 32 is 750 Hz, the back length d of the cylindrical body 32 is 100 mm, and the distance Lb is 170 mm. The value of $|\theta 1-\theta 2|$ at 600 Hz is 0.66 and the value of $|\theta 1-\theta 2|$ at 1000 Hz is 0.92. Therefore, the value of $|\theta 1-\theta 2|$ satisfies the above-mentioned Expression (1).

Figure 17:
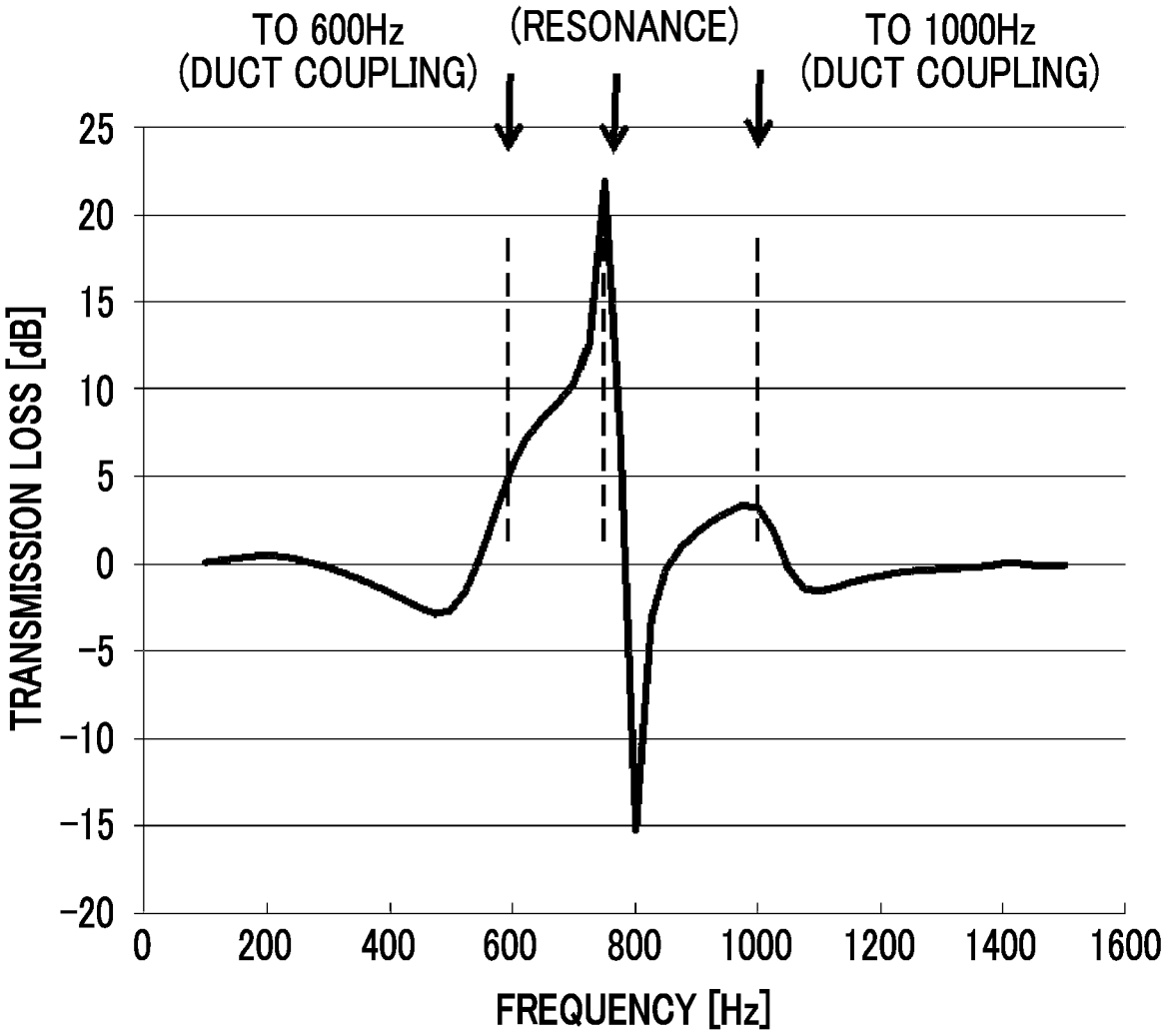
FIG. 17 is a graph illustrating the relationship between the transmission loss and frequency of the soundproof system illustrated in FIG. 16.

FIG. 17 is a graph illustrating the simulation results of the soundproof system 10*c* illustrated in FIG. 16 and illustrating the relationship between the transmission loss and frequency of the soundproof system 10*c*.

As illustrated in FIG. 17, even in a case in which the cylindrical body 32 having the opening portion 24 at the end close to the opening end 20 of the tube structure 12 is provided in the tube structure 12, the conditions of the invention are satisfied. Therefore, as can be seen from the simulation results, high transmission loss is obtained at 750 Hz that is the resonance frequency fr of the cylindrical body 32. Even at 600 Hz and 1000 Hz, duct coupling occurs and high transmission loss is obtained. That is, as can be seen from the simulation results, the duct coupling mode is formed and broadband transmission loss is obtained by a combination of the duct coupling mode and air column resonance.

In the soundproof system according to the invention, a plurality of soundproof structures, such as a plurality of tubular bodies, may be used. That is, it is preferable that the number of tubular bodies 14 which are the soundproof structures provided in the tube structure 12 is two or more.

Figure 18:
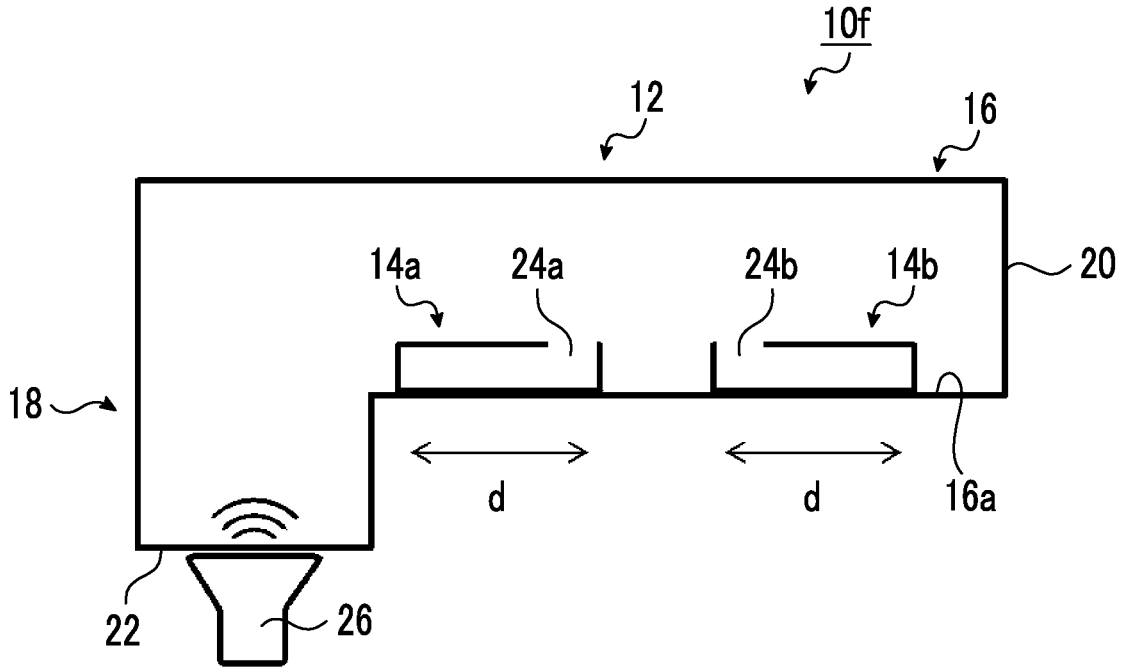
FIG. 18 is a cross-sectional view schematically illustrating an example of a soundproof system according to yet another embodiment of the invention.

For example, as in a soundproof system 10*f* illustrated in FIG. 18, two tubular bodies 14*a* and 14*b* having different lengths (back distances d) may be provided as the soundproof structures in the tube structure 12. Here, in the soundproof system 10*f* illustrated in FIG. 18, the tubular body 14*a* has an opening portion 24*a* provided on the side close to the opening end 20 of the tube structure 12 like the tubular body 14 illustrated in FIG. 1 and the tubular body 14*b* has an opening portion 24*b* that is provided on the side opposite to the opening end 20 of the tube structure 12 like the tubular body 14 illustrated in FIG. 11.

Figure 19:
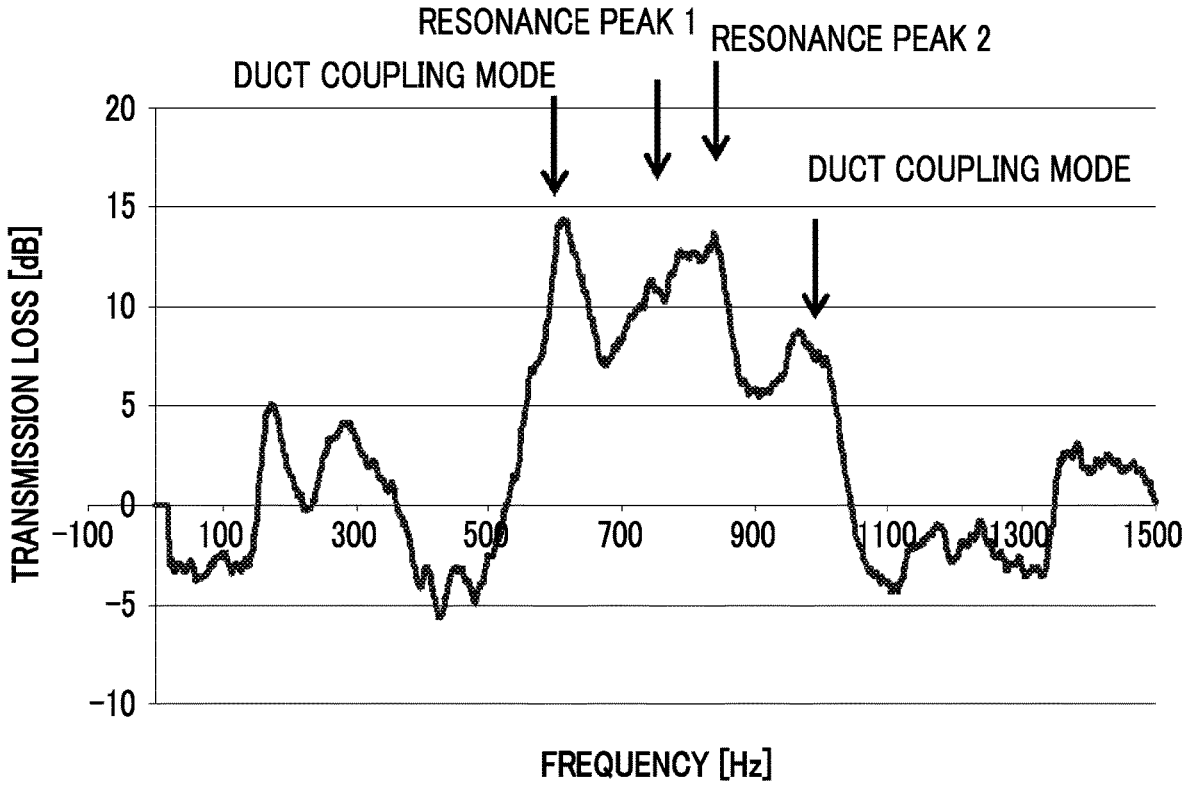
FIG. 19 is a graph illustrating the relationship between the transmission loss and frequency of the soundproof system illustrated in FIG. 18.

FIG. 19 is a graph illustrating the experiment results in a case in which dimensions are the same as the above-mentioned dimensions of the soundproof system 10 illustrated in FIG. 1 except that two tubular bodies 14*a* and 14*b* are provided in the tube structure 12 and illustrating the relationship between the transmission loss and frequency of the soundproof system 10*f*. In the case of the graph illustrated in FIG. 19, in the soundproof system 10*f* illustrated in FIG. 18, the back length d of the tubular body 14*a* is 100 mm, the opening width of the opening portion 24*a* is 20 mm, and the distance from the opening end 20 of the tube structure 12 to the position of the center of gravity of the opening portion 24*a* of the tubular body 14*a* is 185 mm. In addition, the back length d of the tubular body 14*b* is 112 mm, the opening width of the opening portion 24*b* is 20 mm, and the distance from the opening end 20 of the tube structure 12 to the position of the center of gravity of the opening portion 24*b* of the tubular body 14*b* is 130 mm.

In the tubular body 14*a*, as illustrated in FIG. 19, transmission loss caused by air column resonance occurs at 850 Hz.

In addition, at 600 Hz, $|\theta 1-\theta 2|$ is 0.33 [rad.] and transmission loss caused by the duct coupling mode occurs.

Further, at 1000 Hz, $|\theta 1-\theta 2|$ is 1.28 [rad.] and transmission loss caused by the duct coupling mode occurs.

In the tubular body 14*b*, similarly, as illustrated in FIG. 19, transmission loss caused by air column resonance occurs at 750 Hz.

In addition, at 1000 Hz, $|\theta 1-\theta 2|$ is 1.17 [rad.] and transmission loss caused by air column resonance occurs.

As can be seen from the above, transmission loss occurs in a plurality of frequency bands due to a combination of the resonance and duct coupling of multiple tubular bodies, which makes it possible to obtain transmission loss greater than 5 dB in a wide frequency range of 550 Hz to 1000 Hz.

As such, in a case in which two or two or more soundproof structures are provided in the tube structure, the soundproofing effect is high.

Figure 20:
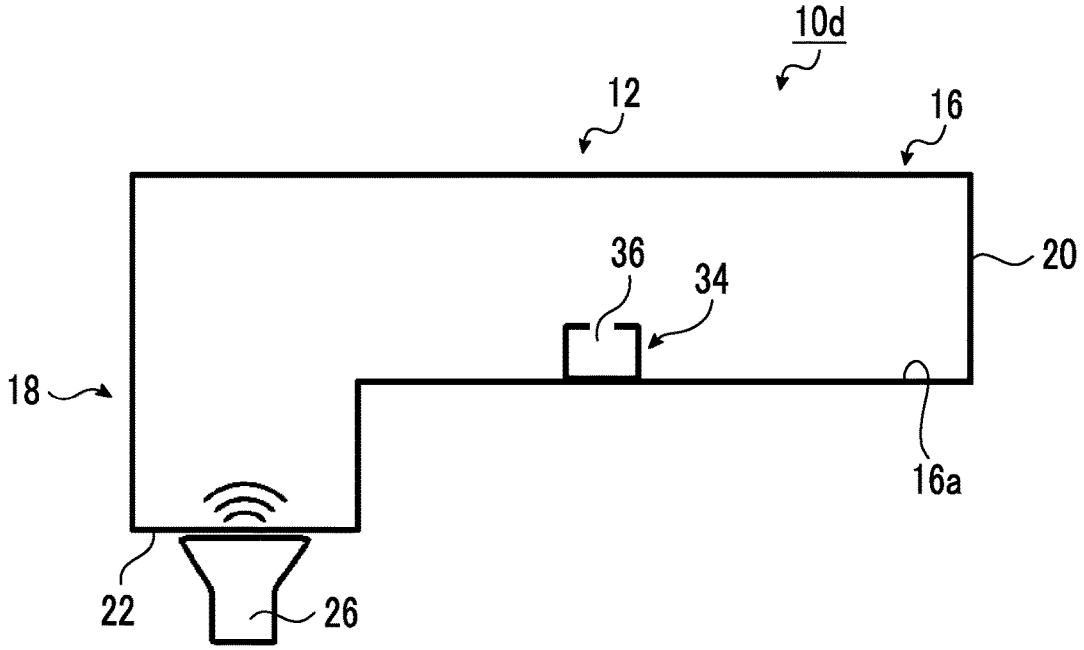
FIG. 20 is a cross-sectional view schematically illustrating an example of a soundproof system according to still yet another embodiment of the invention.

In the invention, as illustrated in FIG. 20, the soundproof structure may be a Helmholtz resonator 34. That is, as in a soundproof system 10*d* illustrated in FIG. 20, instead of the tubular body 14 illustrated in FIG. 1, one or more Helmholtz resonators 34 having an opening portion 36 may be provided in the tube structure 12.

Figure 21:
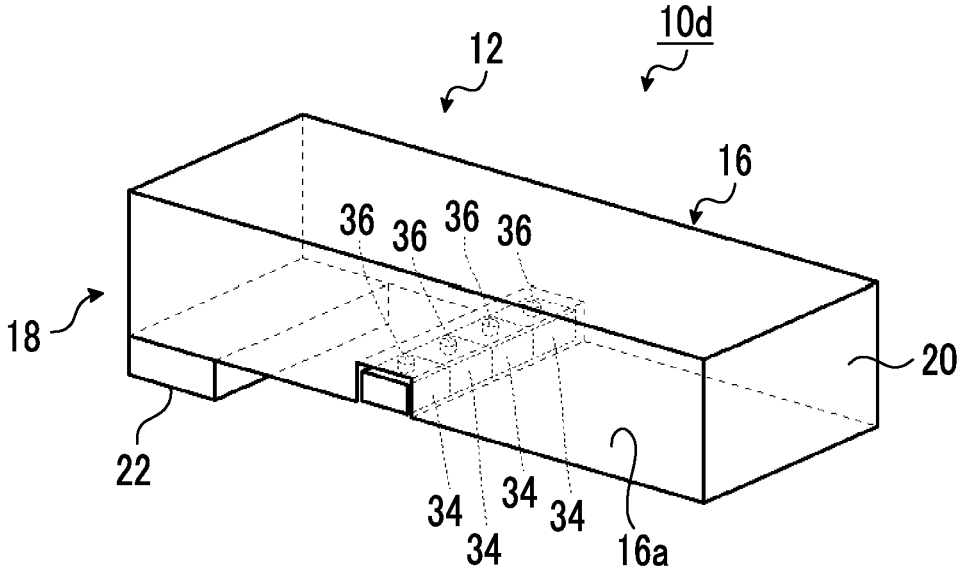
FIG. 21 is a graph illustrating an example of the soundproof system illustrated in FIG. 20.

In the soundproof system 10*d* illustrated in FIG. 21, four Helmholtz resonators 34 are arranged on the bottom 16*a* of the straight tube portion 16 of the tube structure 12 illustrated in FIG. 20. As illustrated in FIG. 21, the width of the four Helmholtz resonators 34 is equal to the width of the straight tube portion 16 of the tube structure 12.

Figure 22:
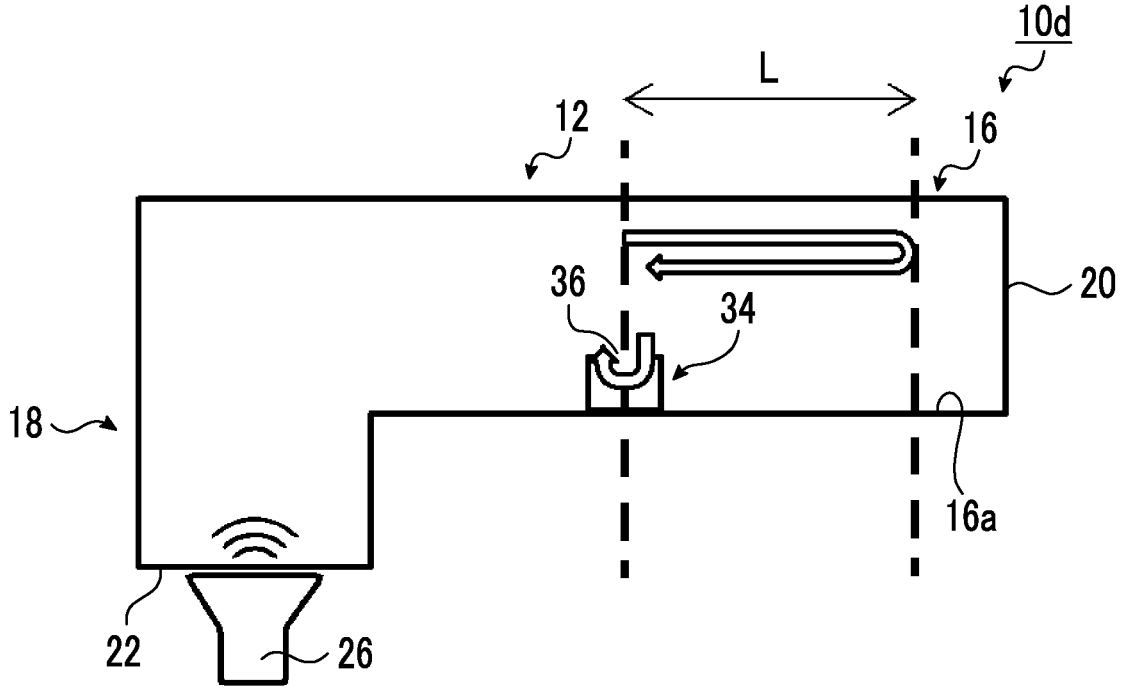
FIG. 22 is a cross-sectional view schematically illustrating the principle of sound insulation according to an embodiment of the invention in the soundproof system illustrated in FIG. 21.

As illustrated in FIG. 22, in the case of the soundproof system 10*d* using the Helmholtz resonator 34, similarly to the case of the tubular body 14 of the soundproof system 10 illustrated in FIG. 6, in a case in which sound passes through the tube structure 12, the sound waves flowing through the tube structure 12 are divided into sound that enters the Helmholtz resonator 34 which is the soundproof structure and sound that flows through the tube structure 12 without entering the soundproof structure.

The sound that has entered the Helmholtz resonator 34 comes out from the Helmholtz resonator 34 again and returns to the inside of the tube structure 12. In this case, a finite phase difference θ1 occurs between the sound that enters the Helmholtz resonator 34 and the sound that comes out from the Helmholtz resonator 34.

Here, the phase difference θ1 of the sound re-radiated from the Helmholtz resonator 34 can be calculated as follows with reference to mechanical acoustics (Corona Publishing Co., Ltd.) P 69:

$$\text{Phase difference } \theta 1 = \arg(r).$$

Here, r is represented as follows:

$$(C=1)$$

$$r = C\rho c S_c/(2ZS+\rho c S_c).$$

Further, the acoustic impedance Z (the real part is ignored for the sake of simplicity) of the Helmholtz resonator 34 can be represented by the following expression:

$$Z = j\omega\rho l_c + \rho c^2 S_c/(j\omega V_c).$$

Here, ρ is the density of the air, c is the speed of sound in the air, $l_c$ is the length ($l_c$=l+1.7r) of the opening portion 36 of the Helmholtz resonator 34 with the corrected opening end, l is the length of the opening portion 36, r is the radius of the opening portion 36, $S_c$ is the opening area ($S_c$=πr2) of the opening portion 36, $V_c$ is the internal volume of the Helmholtz resonator 34, and S is ¼ of the cross-sectional area of the tube structure 12 and the cross-sectional area of the Helmholtz resonator 34.

Here, in one Helmholtz resonator 34, the size of the inner space thereof is 40 mm (length)×40 mm (width)×20 mm (height), the opening diameter of the opening portion 36 is 8 mm, the thickness of a top plate in which the opening portion 36 is provided (the length of the opening portion 36) is 5 mm, and the thickness of the other plates is 1 mm. In addition, ρ is 1.205 [kg/m$^2$], c is 343 [m/S], l is 5 [mm], r is 4 [mm], and $V_c$ is 0.04×0.04×0.02 [m$^3$].

In this case, θ1 is 4.8 [rad.] at 1000 Hz.

In contrast, for the sound that flows through the tube structure 12 without entering the soundproof structure, as illustrated in FIG. 22, similarly to the case of the soundproof system 10 illustrated in FIG. 6, there is a mode (independent standing wave) defined by the structure of the tube structure 12, or the maximum value or the antinode A of sound pressure and the minimum value or the node N of sound pressure are formed by the interference between the sound waves reflected from the opening portion 36 of the Helmholtz resonator 34 and the sound waves that come out from opening portion 36. In this case, the sound that has flowed through the tube structure 12 without entering the soundproof structure returns again and passes through the soundproof structure, such as the Helmholtz resonator 34, in the opposite direction. In a case in which the distance between the position of the antinode A of the standing wave or the position where sound pressure has the maximum value (the position of the structure 12, for example, the position of the antinode A) and the position of the center of gravity of the opening portion 36 of the Helmholtz resonator 34 is L, the phase difference θ2 that occurs in a case in which sound travels to the antinode A of the standing wave (mode) or the position where sound pressure has the maximum value and returns from the position is 2π×2L/λ (=kL). Here, the phase difference θ2 is said to be the phase difference of the sound that returns to position of the center of gravity of the opening portion 36 without entering the Helmholtz resonator 34, as illustrated in FIG. 22.

Figure 23:
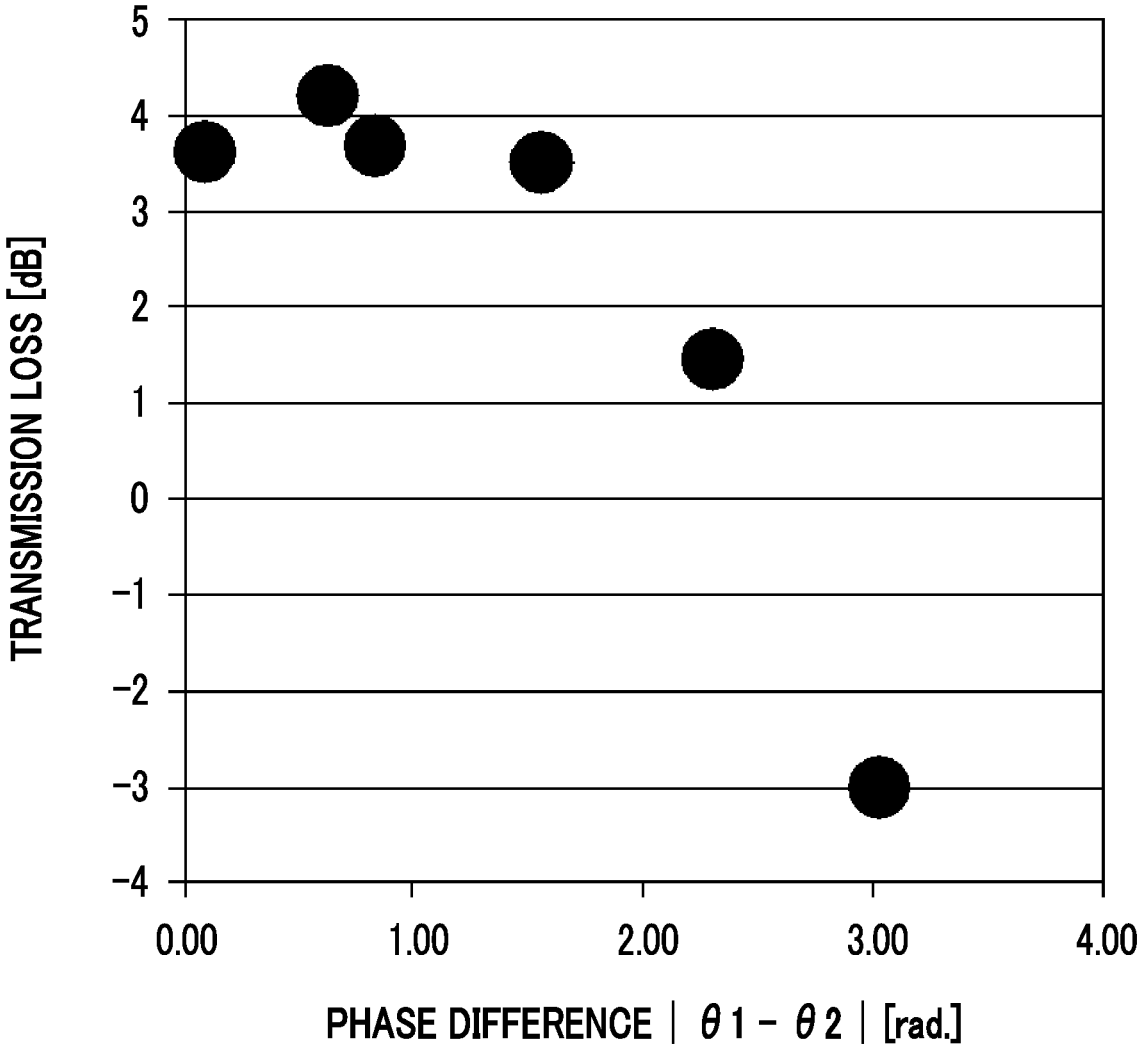
FIG. 23 is a graph illustrating the relationship between transmission loss and an absolute value of a difference between phase differences in the soundproof system illustrated in FIG. 21.

FIG. 23 is a graph illustrating transmission loss with respect to the absolute value |θ1−θ2| of the difference between the phase differences at 1000 Hz in the soundproof system 10*d* illustrated in FIG. 21.

As can be seen from FIG. 23, in a case in which |θ1−θ2|≤π/2 is satisfied in the above-mentioned Expression (1), high transmission loss has been achieved. That is, at 1000 Hz, the duct coupling mode is formed by the Helmholtz resonator 34.

Figure 24:
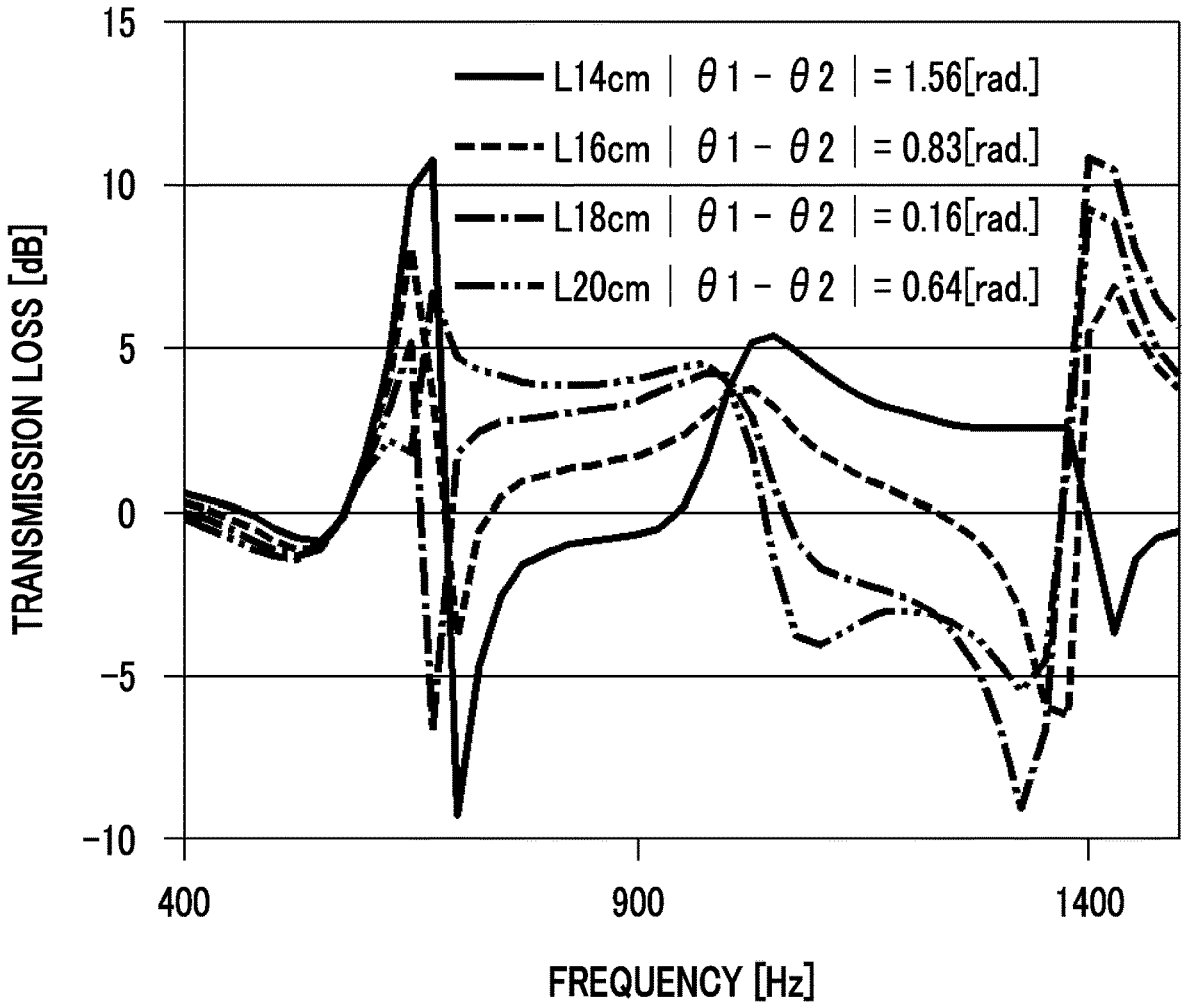
FIG. 24 is a graph illustrating the relationship between the transmission loss and frequency of the soundproof system illustrated in FIG. 21.

FIG. 24 is a graph illustrating a transmission loss spectrum with respect to the frequency in a case in which the distance L between the opening end 20 of the tube structure 12 and the position of the center of gravity of the opening portion 36 of the Helmholtz resonator 34 is changed from 14 cm to 20 cm at an interval of 2 cm.

As can be seen from FIG. 24, even in the soundproof system 10*d* using the Helmholtz resonator 34 as the soundproof structure, transmission loss occurs due to duct coupling in the vicinity of 1000 Hz in addition to the resonance frequency (in the vicinity of 650 Hz).

In the invention, a film-type resonator that is a structure formed by a film and a closed back space may be used as the soundproof structure.

The Helmholtz resonator 34 and the film-type resonator used in the invention are not particularly limited and may be a known Helmholtz resonator and a known film-type resonator, respectively.

In addition, in the invention, as in a soundproof system 10*e* illustrated in FIG. 25, a linear tube structure 12*a* may be used as the tube structure. In the soundproof system 10*e* according to the invention, a soundproof structure, such as the tubular body 14, is provided at an appropriate position on the inner bottom of the linear tube structure 12*a* to obtain the peak of transmission loss caused by air column resonance and the peak of transmission loss caused by the duct coupling mode similarly to the soundproof system 10 illustrated in FIG. 1.

Further, in the invention, as in a soundproof system 10*g* illustrated in FIG. 26, a linear tube structure 12*b* may be used as the tube structure, the right end of the linear tube structure 12*b* in FIG. 26 may be the opening end 20, the other end may be a closed end 38, and the sound source (speaker) 26 may be provided close to the closed end 38 in the tube structure 12*b*. In the soundproof system 10*g* according to the invention, a soundproof structure, such as the tubular body 14, is provided at an appropriate position on the inner bottom of the linear tube structure 12*b* to obtain the peak of transmission loss caused by air column resonance and the peak of transmission loss caused by the duct coupling mode similarly to the soundproof system 10 illustrated in FIG. 1.

In addition, the film-type resonator may be any type including a frame that has a through-hole portion, a vibratable film that is fixed to the frame so as to cover one opening surface of the hole portion, and a back member that is fixed to the frame so as to cover the other opening surface of the hole portion. In addition, one or more holes may be formed in the vibratable film or one or more weights may be provided in the vibratable film. Further, in the soundproof system using the film-type resonator, one film-type resonator or a plurality of film-type resonant bodies may be used.

The frame is formed so as to surround the through-hole portion in an annular shape, the film is fixed to the frame so as to cover one surface of the hole portion, and the membrane vibration node of the film and is supported by the frame. Therefore, the frame is a vibration node of the film fixed to the frame. Therefore, the frame has higher rigidity than the film. Specifically, it is preferable that the frame has high rigidity and mass per unit area. In addition, the frame and the film may be integrated with the same material, or different materials.

It is necessary to fix at least a part of the film to the end of the hole portion of the frame. It is preferable that the entire end of the film is fixed to the frame in terms of sound absorption in a low frequency region.

For example, the shape of the frame and the hole portion is not particularly limited and may be polygons including other quadrangles, such as a square, a rectangle, a rhombus, or a parallelogram, a triangle, such as a regular triangle, an isosceles triangle, or a right triangle, a regular polygon, such as a regular pentagon or a regular hexagon, a circle, or an ellipse. Alternatively, the shape may be an indefinite shape. In addition, it is preferable that the frame and the hole portion have the same shape. However, the frame and the hole portion may have different shapes.

The material forming the frame is not particularly limited as long as it can support the film, has strength suitable for application to the above-described soundproof target, and is resistant to the soundproof environment of the soundproof target. The material can be selected according to the soundproof target and the soundproof environment thereof. Examples of the material forming the frame include a resin material and an inorganic material. Specifically, examples of the resin material include: acetyl cellulose-based resins, such as triacetyl cellulose; polyester-based resins, such as polyethylene terephthalate (PET) and polyethylene naphthalate; olefin-based resins, such as polyethylene (PE), polymethylpentene, cycloolefin polymer, and cycloolefin copolymer; acryl-based resins, such as polymethyl methacrylate; and polycarbonate. In addition, examples of the resin material include polyimide, polyamideimide, polyarylate, polyetherimide, polyacetal, polyetheretherketone, polyphenylene sulfide, polysulfone, polybutylene terephthalate, and triacetyl cellulose. Further, examples of the resin material include carbon fiber reinforced plastic (CFRP), carbon fiber, and glass fiber reinforced plastic (GFRP).

Specifically, examples of the inorganic material include: glass, such as soda glass, potassium glass, and lead glass; ceramics, such as la-modified lead zirconate titanate (PLZT); quartz; and fluorite. In addition, metal materials, such as aluminum and stainless steel, may be used. Furthermore, metal materials, such as titanium, magnesium, tungsten, iron, steel, chromium, chromium molybdenum, nichrome molybdenum, and alloys thereof may be used. Moreover, combinations of the plurality of types of materials may be used as the material forming the frame.

The back member closes the back space of the film surrounded by the inner peripheral surface of the frame.

The back member is a plate-shaped member that faces the film and is attached to the other end of the hole portion of the frame such that the back space of the film formed by the frame is a closed space.

The plate-shaped member is not particularly limited as long as it can form a closed space on the back side of the film. It is preferable that the plate-shaped member is made of a material having higher rigidity than that forming the film. In addition, the plate-shaped member may be made of the same material as the film. In a case in which films are fixed to both openings of the hole portion of the frame, convex portions may be formed on the films on both sides or weights may be attached to the films.

Here, for example, the back member can be made of the same material as the frame. In addition, a method for fixing the back member to the frame is not particularly limited as long as it can form a closed space on the back side of the film. The same method as that fixing the film to the frame may be used.

Since the back member is a plate-shaped member for forming a closed space on the back side of the film with the frame, it may be integrated with the frame or may be formed integrally with the frame, using the same material.

The peripheral portion of the film is pressed and fixed to the frame so as to cover the hole portion of the frame.

In a case in which the material forming the film is a film-like material or a foil-like material, it needs to have strength suitable for application to the above-described soundproof target and to be resistant to the soundproof environment of the soundproof target.

Further, the material forming the film needs to vibrate such that the film absorbs or reflects the energy of sound waves to insulate sound. The material forming the film is not particularly limited as long as it has the above-mentioned characteristics and can be selected according to, for example, the soundproof target and the soundproof environment of the soundproof target.

The following resin materials that can form a film may be used as the material forming the film: polyethylene terephthalate (PET), polyimide, polymethyl methacrylate, polycarbonate, acrylic (polymethyl methacrylate: PMMA), polyamideimide, polyarylate, polyetherimide, polyacetal, polyether ether ketone, polyphenylene sulfide, polysulfone, polybutylene terephthalate, triacetyl cellulose, polyvinylidene chloride, low-density polyethylene, high-density polyethylene, aromatic polyamide, a silicone resin, ethylene-ethyl acrylate, vinyl acetate copolymer, polyethylene, chlorinated polyethylene, polyvinyl chloride, polymethylpentene, and polybutene. In addition, the following metal materials that can form foil may be used: aluminum, chromium, titanium, stainless steel, nickel, tin, niobium, tantalum, molybdenum, zirconium, gold, silver, platinum, palladium, iron, copper, and Permalloy. Further, the following materials that can form thin structures may be used: other materials forming fibrous films, such as paper and cellulose, non-woven fabrics, films containing nano-sized fibers, thinly processed urethane, porous materials such as Thinsulate, and carbon materials processed into thin film structures.

The film is fixed to the frame so as to cover at least one opening of the hole portion of the frame. That is, the film may be fixed to the frame so as to cover one opening, the other opening, or both openings of the hole portion of the frame.

A method for fixing the film to the frame is not particularly limited. Any method may be used as long as it fixes the film to the frame such that the film is a node of vibration. Examples of the method for fixing the film to the frame include a method using an adhesive and a method using a physical fixing tool.

In the method using an adhesive, the adhesive is applied onto a surface of the frame surrounding the hole portion and the film is placed on the surface and is fixed to the frame by the adhesive. Examples of the adhesive include epoxy-based adhesives (for example, Araldite (registered trademark) (manufactured by Nichiban Co., Ltd.)), cyanoacrylate-based adhesives (for example, Aron Alpha (registered trademark) (manufactured by Toa Gosei Co., Ltd.), etc.), and acrylic-based adhesives.

A method which interposes the film disposed so as to cover the hole portion of the frame between the frame and a fixing member, such as a rod, and fixes the fixing member to the frame with a fixing tool, such as a screw, can be given as an example of the method using a physical fixing tool.

In addition, the following structures may be used: a structure in which a frame and a film are separately provided and the film is fixed to the frame; and a structure in which a film and a frame made of the same material are integrated.

In the soundproof system according to the invention having the above-mentioned configuration, transmission loss can be obtained in a wide band by a combination of resonance and a duct coupling mode. That is, the soundproof structure according to the invention makes it possible to obtain the soundproofing effect in a wide band.

In the invention, it is preferable that an air column resonance tube, such as the tubular body 14, is used as the soundproof structure. The soundproof structure which is the air column resonance tube, such as the tubular body 14, has the opening portion 24 and a closed space and has an air column tube configuration.

It is generally known that the soundproof structure, such as the air column resonance tube, causes an air column resonance phenomenon. In a case in which the soundproof structure, such as the air column resonance tube, is provided in the tube structure as in the soundproofing system according to the invention, the transmission loss of the tube structure including the soundproof structure at the resonance frequency increases.

Therefore, in the invention, it is preferable that the soundproof structure is, for example, a soundproof structure causing the resonance phenomenon.

As such, in addition to the above-mentioned air column resonance tube, the above-mentioned Helmholtz resonator and the above-mentioned film-type resonator may be used as the soundproof structure causing the resonance phenomenon.

The soundproof system according to the invention is preferably configured such that both the air column resonance frequency and the duct coupling mode are obtained at the same time in order to increase the transmission loss of the tube structure in a wide band on the basis of the duct coupling mode and the principle of resonance. In this case, it is possible to achieve two or more increases in transmission loss based on different principles, such as (i) an increase in transmission loss due to air column resonance and (ii) an increase in transmission loss due to the duct coupling mode. As a result, it is possible to obtain transmission loss in a wide band. The technique according to the invention which obtains non-resonant transmission loss as well as transmission loss caused by resonance in the soundproof system is not easily reached from the related art.

In the soundproof system according to the invention, the arrangement of the tube structure and the soundproof structure in the tube structure is optimized to obtain a non-resonant transmission loss peak based on the duct coupling mode. In particular, in a case in which the duct coupling mode is used, the soundproof structure can be smaller than the resonator. In addition, as described above, transmission loss can be obtained in a wide band by the simultaneous use of the duct coupling mode and resonance.

The soundproof system according to the invention may be a single soundproof system including a single tube structure and a single soundproof structure provided in the tube structure. However, the soundproof system may not be a single soundproof system, but may be a soundproof system including a plurality of single soundproof systems each of which includes a plurality of tube structures and a plurality of soundproof structures provided in the tube structures.

The soundproof system including a plurality of single soundproof systems is characterized in that the natural mode of the tube structure, the position of the opening portion, and the back length of the soundproof structure are appropriately set to obtain resonant and non-resonant transmission loss peaks at the same time and to obtain transmission loss in a wide band without using a sound absorbing material as described above. Therefore, applicability is wide and high.

As described above, in the soundproof system according to the invention, in order to further broaden the transmission loss obtained in a wide band without using a sound absorbing material, a sound absorbing material may be provided in the tube structure or may be provided in the soundproof structure and/or on at least one of the outer surfaces of the soundproof structure.

That is, it is preferable that the sound absorbing material is provided in the tube structure. In addition, it is preferable that the sound absorbing material is provided in at least a part of the soundproof structure.

Figure 32:
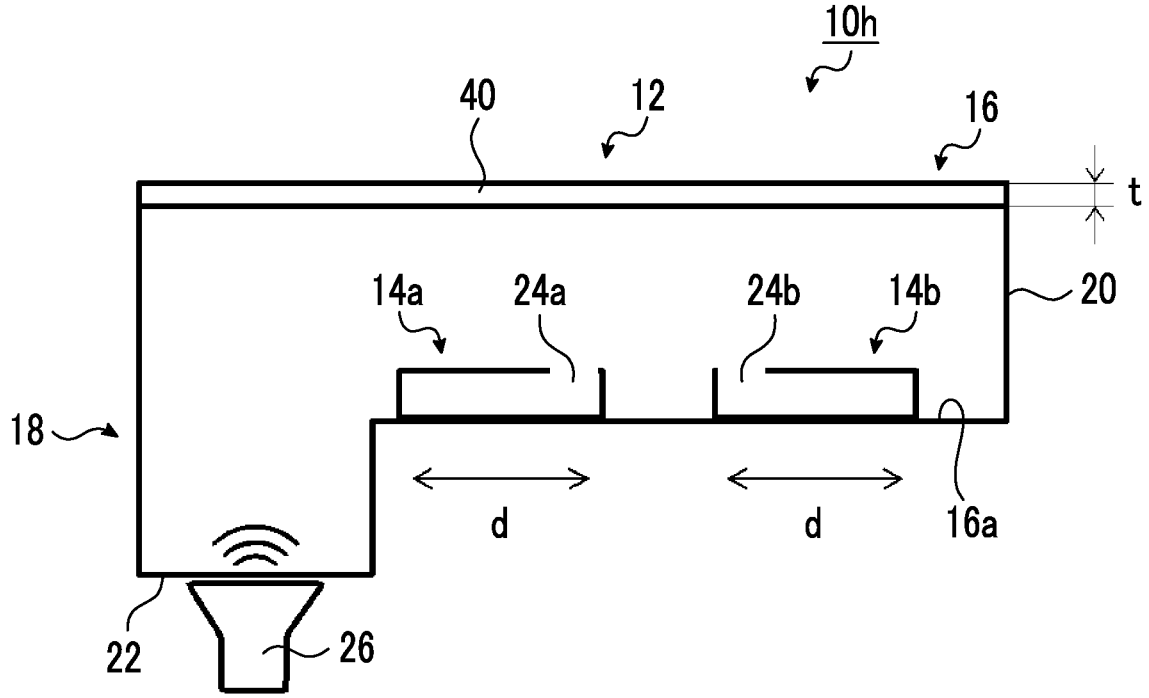
FIG. 32 is a cross-sectional view schematically illustrating an example of a soundproof system according to yet still another embodiment of the invention.

For example, as in a soundproof system **10*h* illustrated in FIG. 32, a sound absorbing material 40, such as urethane, may be attached to the inner upper surface (ceiling) of the tube structure 12 by an adhesive or a double-sided tape in the soundproof system 10*f* illustrated in FIG. 18. In addition, the above-mentioned known sound absorbing materials may be used as the sound absorbing material 40**.

In the soundproof system **10*h* illustrated in FIG. 32, it is preferable that the sound absorbing material 40 is provided on the entire inner upper surface of the tube structure 12. The sound absorbing material 40 may be provided in a part of the inner upper surface. Further, in the soundproof system 10*h* illustrated in FIG. 32, the sound absorbing material 40 is provided on the inner upper surface of the tube structure 12. However, the invention is not limited thereto. The sound absorbing material 40 may be provided on another surface or may be provided on a plurality of surfaces in the tube structure 12. In a case in which the sound absorbing material 40 is provided on another surface, it may be provided in at least a part of the surface. Of course, the sound absorbing material 40 may be provided in at least a part of the tubular bodies 14*a* and 14*b* which are the soundproof structures in the tube structure 12**.

Figure 33:
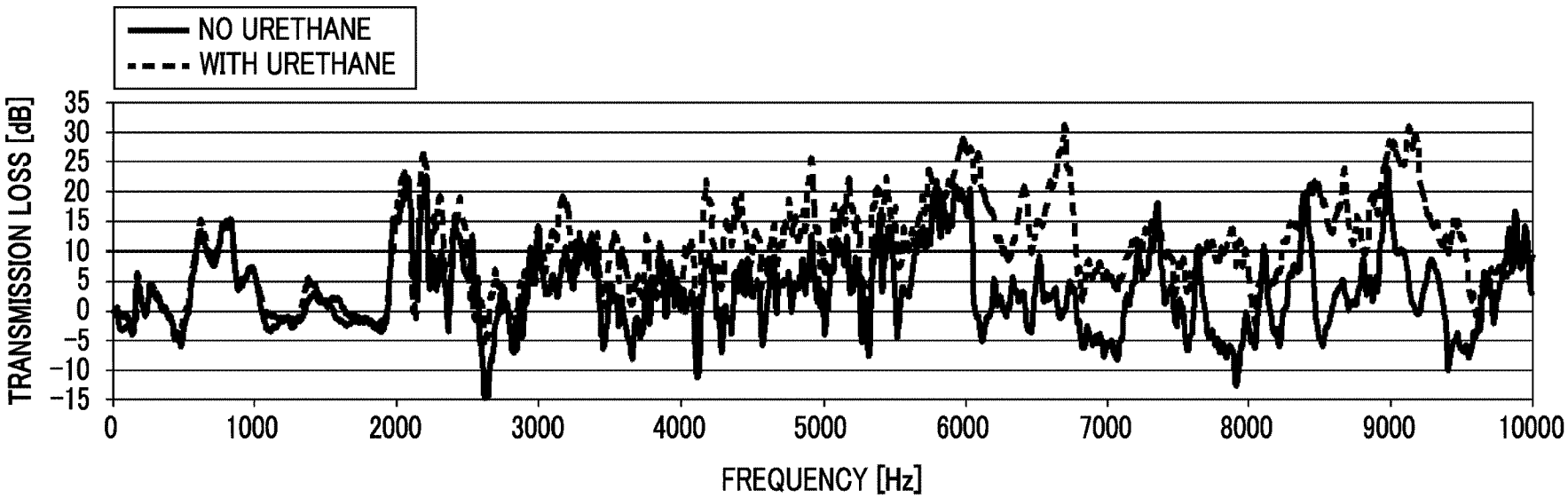
FIG. 33 is a graph illustrating the relationship between the transmission loss and frequency of the soundproof system illustrated in FIG. 32.

FIG. 33 is a graph illustrating the experiment results in which the dimensions are the same as the above-mentioned dimensions except that the sound absorbing material 40 is provided on the inner upper surface of the tube structure 12 in the soundproof system **10*f* illustrated in FIG. 18 and illustrating the relationship between the transmission loss and frequency of the soundproof system 10*h* illustrated in FIG. 32. In the case of the graph illustrated in FIG. 33, urethane is used as the sound absorbing material 40 and the sound absorbing material 40 has a size of 163 mm×394 mm which is the same as the size of the ceiling of the tube structure 12. In addition, the thickness of the sound absorbing material 40** is 10 mm.

The configuration in which the sound absorbing material 40 is provided in the tube structure 12 as in the soundproof system 10*h* illustrated in FIG. 32 makes it possible to obtain the effect of insulating sound with a higher frequency (for example, a frequency greater than 2 kHz) in a very wide frequency band (from 2 kHz to 10 kHz), in addition to a high soundproofing effect in a wide frequency band (for example, a frequency equal to or less than 2 kHz) including the above-mentioned low frequency band. Therefore, it is possible to cover the insulation of sound in most of the audible frequency range in addition to the insulation of sound with a low frequency in the invention.

The soundproof system 10*h* illustrated in FIG. 32 has two soundproof structures, that is, the tubular bodies 14*a* and 14*b* provided in the tube structure 12. However, the invention is not limited thereto. For example, the soundproof system 10*h* may have one tubular body or three or more tubular bodies.

In the soundproof system 10*h* illustrated in FIG. 32, the sound absorbing material 40 is attached to the inner upper surface of the tube structure 12. However, as in a soundproof system 10*i* illustrated in FIG. 34, a replacement mechanism 44 for replacing a sound absorbing material replacement member 42 including a sound absorbing material 40 illustrated in FIG. 35 may be provided on the inner upper surface of the tube structure 12 such that the sound absorbing material 40 can be replaced.

Figure 35:
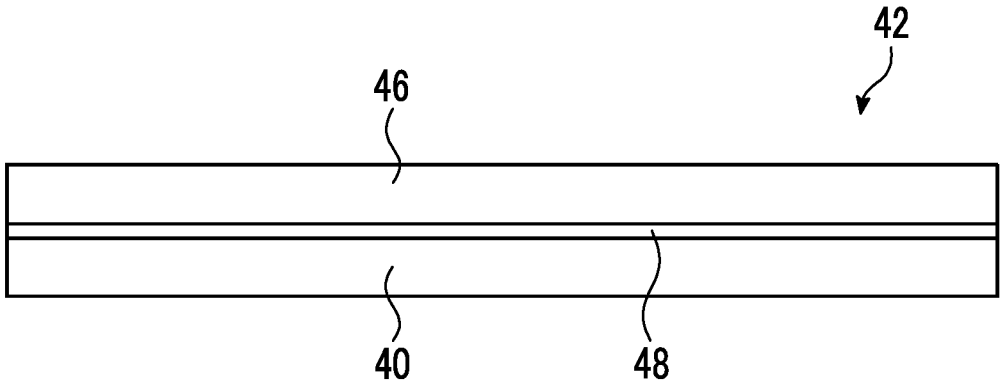
FIG. 35 is an enlarged cross-sectional view schematically illustrating an example of a sound absorbing material that can be replaced with respect to a tube structure of the soundproof system illustrated in FIG. 34.

As illustrated in FIG. 35, the sound absorbing material replacement member 42 is obtained by attaching and fixing the sound absorbing material 40 to one surface of an intermediate material 46, such as a plate, with an attachment material 48 such as an adhesive or a double-sided tape. Here, the intermediate material 46 may be any material as long as it can support the sound absorbing material 40 and can be inserted and fitted to or removed from the replacement mechanism 44 on the inner upper surface of the tube structure 12 such that the sound absorbing material 40 can be replaced (attached and detached).

Figure 34:
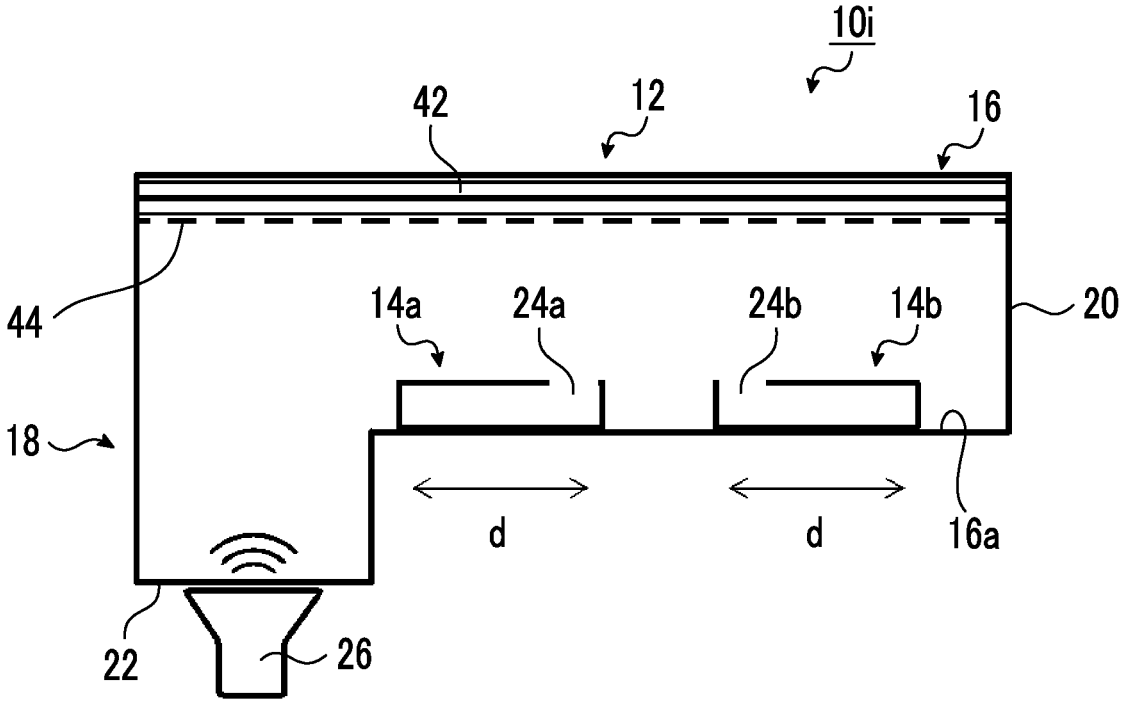
FIG. 34 is a cross-sectional view schematically illustrating an example of a soundproof system according to still yet another embodiment of the invention.

The replacement mechanism 44 provided on the inner upper surface of the tube structure 12 may be any mechanism as long as it has a structure in which the sound absorbing material replacement member 42 can be inserted and fitted or pulled out and extracted, with the sound absorbing material 40 facing the inner side of the tube structure 12 (that is, the lower side in FIG. 34). In addition, the replacement mechanism 44 may have a mesh-shaped support member that supports the surface of the sound absorbing material replacement member 42 facing the sound absorbing material 40 of the sound absorbing material 40 or a support frame that supports opposite ends of the sound absorbing material replacement member 42. Further, the replacement mechanism 44 may have, for example, a rail and a guide that guides the intermediate material 46 (preferably, both ends of the intermediate material 46) to which the sound absorbing material 40 of the sound absorbing material replacement member 42 is not attached.

In the soundproof system according to the invention, as described above, the sound absorbing material may be provided in at least a part of the inner surface and/or the outer surface of the soundproof structure provided in the tube structure.

Figure 36:
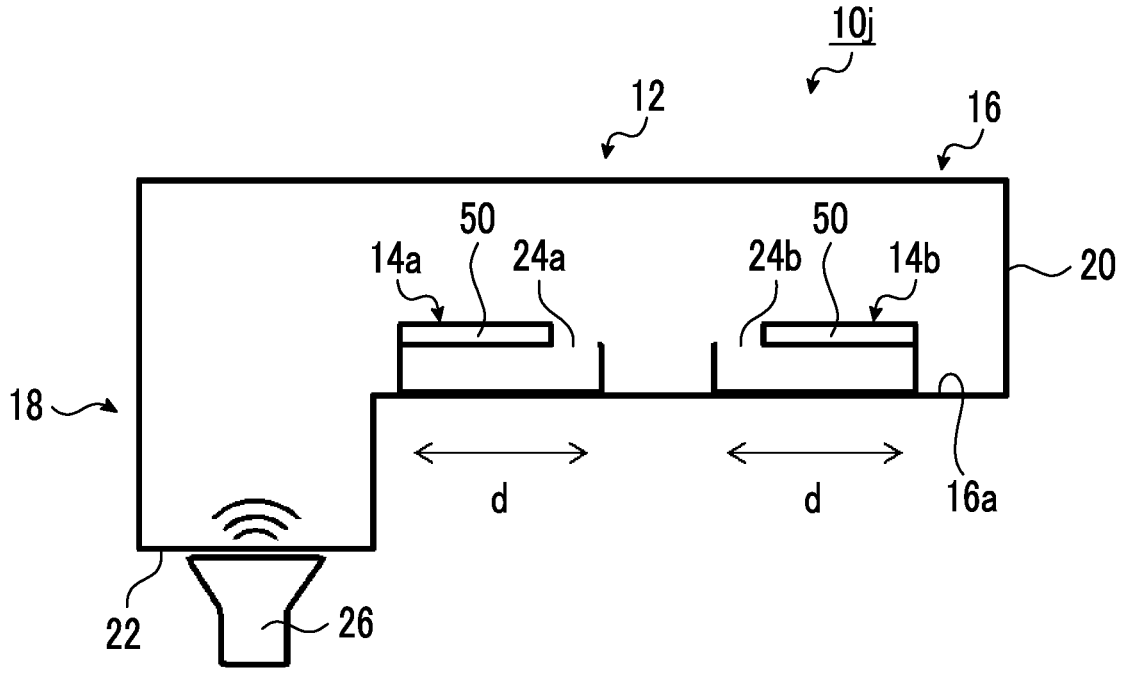
FIG. 36 is a cross-sectional view schematically illustrating an example of a soundproof system according to yet still another embodiment of the invention.

For example, as in a soundproof system 10*j* illustrated in FIG. 36, a sound absorbing material 50, such as urethane, may be attached to the outer upper surface of each of two tubular bodies 14*a* and 14*b* which are the soundproof structures provided in the tube structure 12 in the soundproof system 10*f* illustrated in FIG. 18 by an adhesive or a double-sided tape. In particular, in a case in which the two tubular bodies 14*a* and 14*b* which are the soundproof structures are incorporated into the tube structure 12 later, the sound absorbing material 50, such as urethane, may be integrated with the soundproof structures (tubular bodies 14*a* and 14*b*) as in the soundproof system 10*j* illustrated in FIG. 36. In particular, in a case in which the soundproof structure is attachable and detachable (replaceable), it is preferable that the soundproof structure and the sound absorbing material are integrated with each other. In this case, it is not necessary to provide the sound absorbing material 50, such as urethane, separately from the soundproof structure (tubular bodies 14*a* and 14*b*) provided in the tube structure 12, and the provision of the sound absorbing material 50 does not require a lot of time and effort. In addition, the above-mentioned known sound absorbing material can be used as the sound absorbing material 50.

In the soundproof system 10*j* illustrated in FIG. 36, it is preferable that the sound absorbing material 50 is provided on the entire outer upper surface of each of the two tubular bodies 14*a* and 14*b*. The sound absorbing material 50 may be provided in a part of the outer upper surface. For example, the sound absorbing material 50 may be provided on the entire outer upper surface of the two tubular bodies 14*a* and 14*b* may be provided on the entire outer upper surface and the other may be provided in a part of the outer upper surface. Alternatively, the sound absorbing material 50 may be provided in a part of the outer upper surface of each of the two tubular bodies 14*a* and 14*b* or may be provided on the outer upper surface of only one tubular body.

In addition, in the soundproof system 10*j* illustrated in FIG. 36, the sound absorbing material 50 is provided on the entire outer upper surface of each of the two tubular bodies 14*a* and 14*b*. However, the invention is not limited thereto. For example, the sound absorbing material 50 may be provided in at least a part of the inner surface and/or the outer surface of at least one of the two tubular bodies 14*a* and 14*b* which are the soundproof structures.

Figure 37:
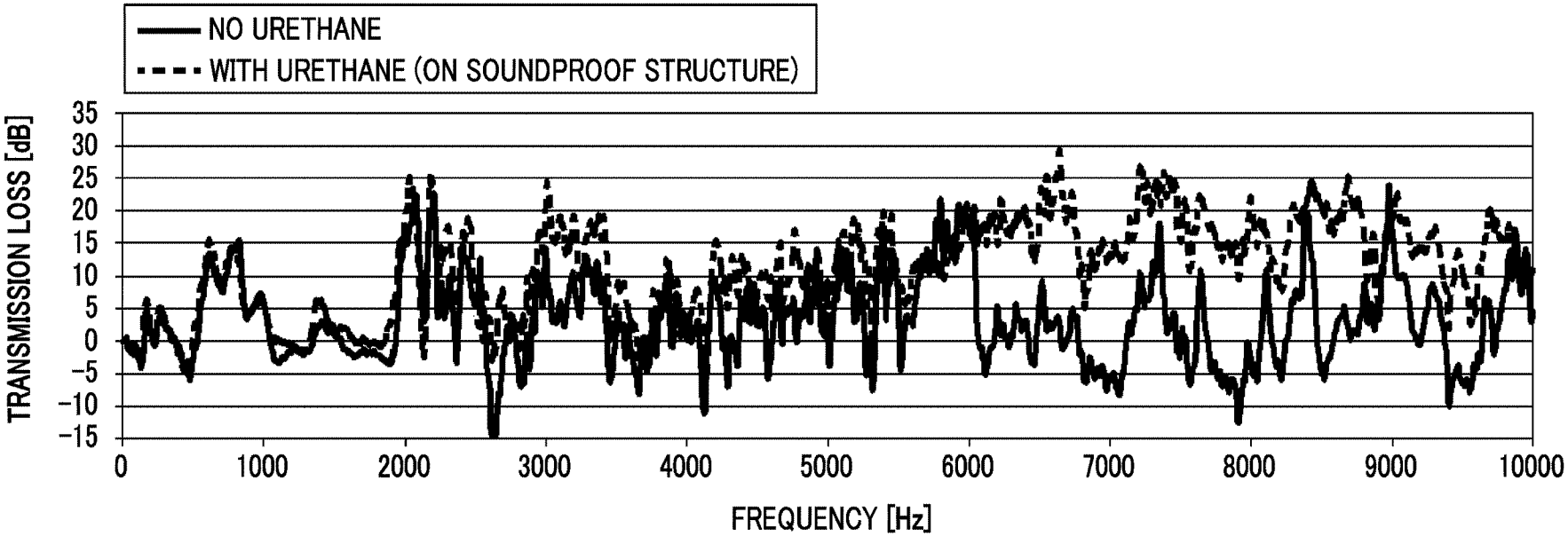
FIG. 37 is a graph illustrating the relationship between the transmission loss and frequency of the soundproof system illustrated in FIG. 35.

FIG. 37 is a graph illustrating the experiment results in which the dimensions are the same as the above-mentioned dimensions except that the sound absorbing material 50 is provided on the outer upper surface of each of the two tubular bodies 14*a* and 14*b* in the soundproof system 10*j* illustrated in FIG. 18 and illustrating the relationship between the transmission loss and frequency of the soundproof system 10*j* illustrated in FIG. 36. In the case of the graph illustrated in FIG. 37, urethane is used as the sound absorbing material 50 and the sound absorbing material 50 has a size of 163 mm×100 mm which is the same as the size of the outer upper surface of each of the two tubular bodies 14*a* and 14*b*. In addition, the thickness of the sound absorbing material 50 is 10 mm.

The configuration in which the sound absorbing material 50 is provided on the outer upper surface of each of the two tubular bodies 14*a* and 14*b* as in the soundproof system 10*j* illustrated in FIG. 36 makes it possible to obtain the effect of insulating sound with a higher frequency (for example, a frequency greater than 2 kHz) in a very wide frequency band (from 2 kHz to 10 kHz), in addition to a high soundproofing effect in a wide frequency band (for example, a frequency equal to or less than 2 kHz) including the above-mentioned low frequency band, similarly to the soundproof system 10*h* illustrated in FIG. 32. Therefore, it is possible to cover the insulation of sound in most of the audible frequency range in addition to the insulation of sound with a low frequency in the invention.

In the soundproof system according to the invention, preferably, it is possible to adjust the soundproofing characteristics of the soundproof structure provided in the tube structure (for example, the phase difference of sound entering the soundproof structure).

Figure 38:
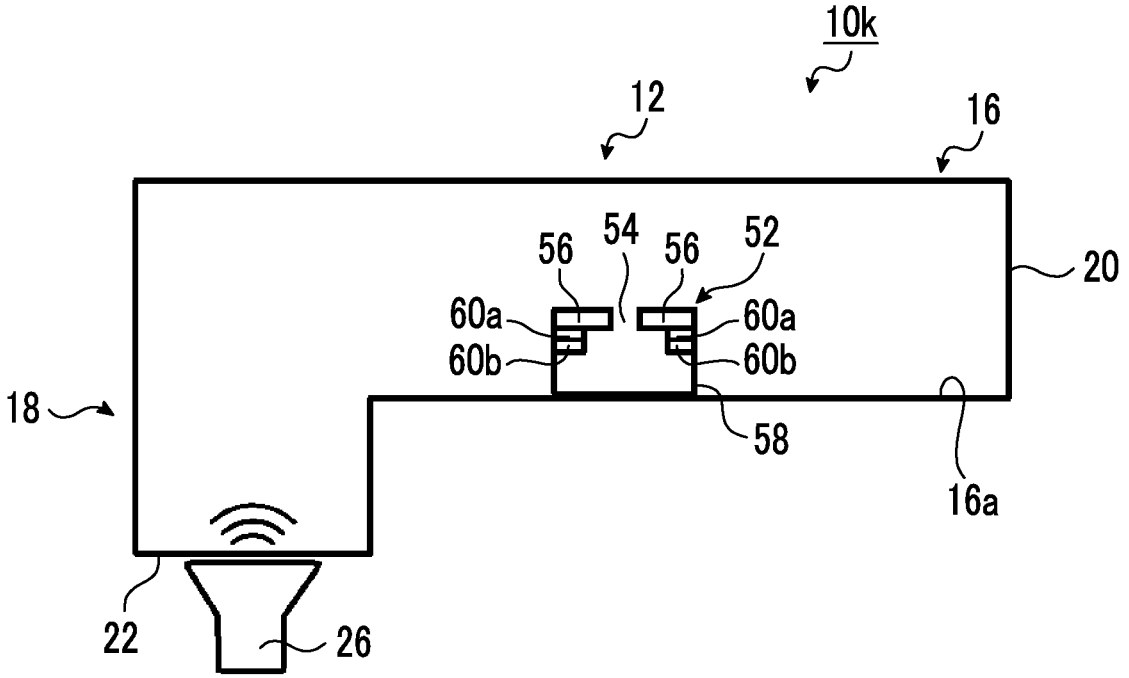
FIG. 38 is a cross-sectional view schematically illustrating an example of a soundproof system according to still yet another embodiment of the invention.

For example, as in a soundproof system 10*k* illustrated in FIG. 38, a cover 56 having an opening portion 54 of a Helmholtz resonator 52 which is a soundproof structure provided in the tube structure 12 may be replaced (attached and detached) with respect to a housing 58. In addition, the Helmholtz resonator 52 of the soundproof system 10*k* illustrated in FIG. 38 is configured by providing a cover having the opening portion 36 of the Helmholtz resonator 34 of the soundproof system 10*d* illustrated in FIG. 20 so as to be replaceable (attachable and detachable).

Figure 39:
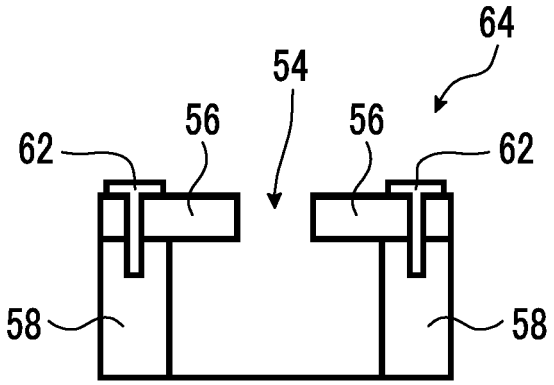
FIG. 39 is a cross-sectional view schematically illustrating an example of a replaceable soundproof structure of the soundproof system illustrated in FIG. 38.

As illustrated in FIG. 38, the Helmholtz resonator 52 may be configured by attaching and fixing a magnet 60*a* to the top of a rectangular side plate of an open surface of the housing 58 having a rectangular parallelepiped shape or a cubic shape with one open surface, attaching and fixing a magnet 60*b* having a different polarity to a position, which corresponds to the top of the rectangular side plate of the housing 58, in the rectangular cover 56 having the opening portion 54, and closely attaching and fixing a pair of magnets 60*a* and 60*b* having different polarities to each other in an airtight manner so as to be attachable and detachable. Alternatively, a Helmholtz resonator 64 may be configured by fastening the cover 56 to the rectangular side plate of the housing 58 with screws 62 such that it is attachably and detachably closely attached and fixed to the rectangular side plate in an airtight manner, as illustrated in FIG. 39, instead of one set of the magnets 60*a* and 60*b*. In the Helmholtz resonators 52 and 64, it is preferable that the closely attached and fixed portion between the cover 56 and the rectangular side plate of the housing 58 is airtightly sealed.

As such, the configuration in which the cover 56 with the opening portion 54 is replaceable makes it possible to form the Helmholtz resonator 52 or 64 having the opening portion 54 with a different size and to adjust the soundproofing characteristics (the phase difference of sound entering the Helmholtz resonator 52 or 64).

Figure 40:
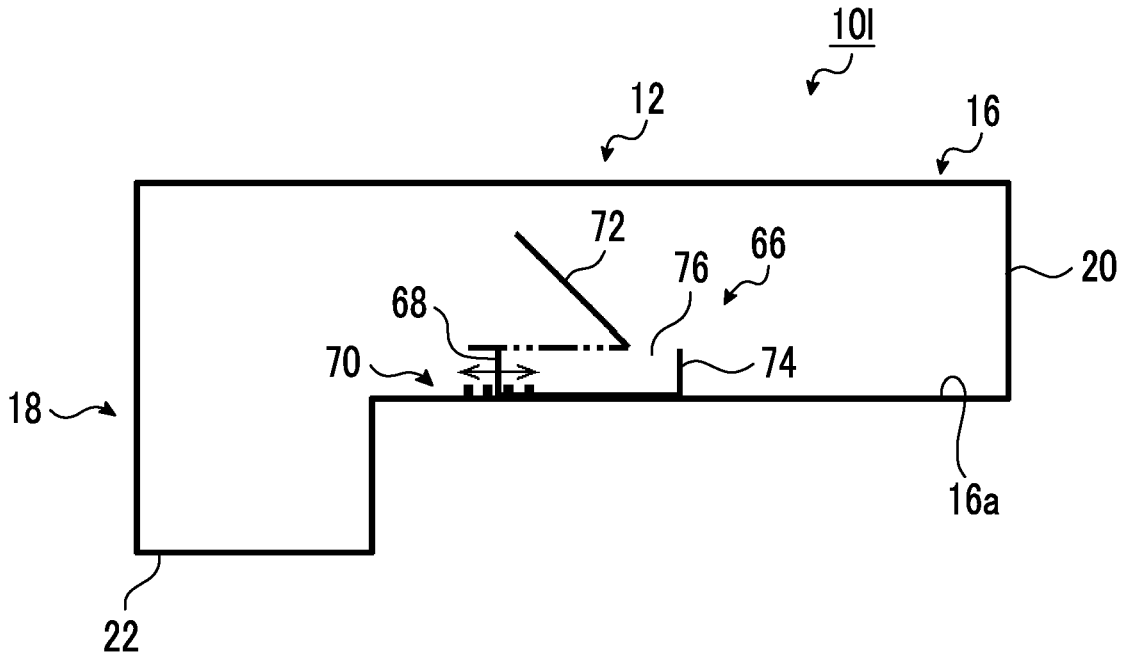
FIG. 40 is a cross-sectional view schematically illustrating an example of a soundproof system according to yet still another embodiment of the invention.

For example, as in a tubular body (air column resonance tube) 66 which is a soundproof structure provided in the tube structure 12 in a soundproof system 10*l* illustrated in FIG. 40, a plurality of grooves 70, to which a back plate 68 is fitted and fixed, may be provided in the longitudinal direction of the tubular body 66 and the length of the tubular body 66 may be adjusted by removing a top plate 72 and changing the position of the groove 70 for fixing the back plate 68. The tubular body 66 of the soundproof system 10*l* illustrated in FIG. 40 differs from the tubular body 14 of the soundproof system 10 illustrated in FIG. 1 in that the length of the tubular body 66 can be adjusted.

In the tubular body 66, a rectangular parallelepiped shape having an opening portion 76 is formed by the back plate 68, the top plate 72, and a housing main body 74. It is preferable that the back plate 68 and the top plate 72, the back plate 68 and the housing main body 74, and the top plate 72 and the housing main body 74 are closely attached and fixed to each other in an airtight manner by, for example, the above-mentioned one set of magnets having different polarities or the above-mentioned screws so as to be attachable and detachable. It is preferable that the closely attached and fixed portion is airtightly sealed.

As such, since the position of the back plate 68 can be adjusted, it is possible to form the tubular body (air column resonance tube) 66 having a different length and to adjust the soundproofing characteristics of the tubular body (the phase difference of sound entering the tubular body 66 through the opening portion 76).

The tube structure 12 according to the invention includes the straight tube portion 16 and the bent portion 18 that is bent from the straight tube portion 16 and forms a bent structure. Here, wind (air flow) and a sound wave flowing from the opening end 22 of the bent portion 18 of the tube structure 12 collides with a wall surface of the corner of the tube structure 12 (a ceiling surface of the straight tube portion 16 facing the opening end 22) and is reflected on the upstream side (the side of the opening end 22). Therefore, both the wind and the sound wave is less likely to flow through the tube structure 12 from the opening end 22 to the opening end 20 of the straight pipe portion 16 and it is difficult for the wind and the sound wave to pass through the tube structure 12.

For example, the following configuration is considered in order to ensure air ventilation: a configuration that gently changes the angle of the wall by processing the corner into a curved surface; or a configuration that changes the flow direction of wind by providing a rectifying plate at the corner.

However, in a case in which the corner is processed into a curved surface or the rectifying plate is provided at the corner, air ventilation is improved, but the transmittance of sound waves is also increased.

Figure 41:
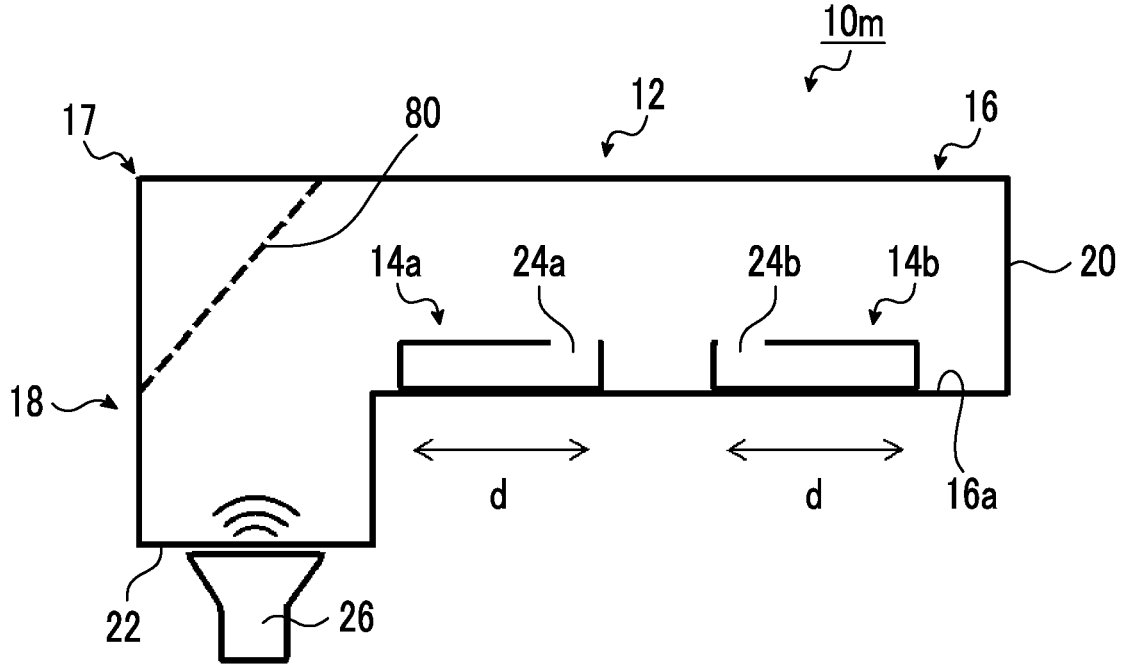
FIG. 41 is a cross-sectional view schematically illustrating an example of a soundproof system according to still yet another embodiment of the invention.
Figure 42:
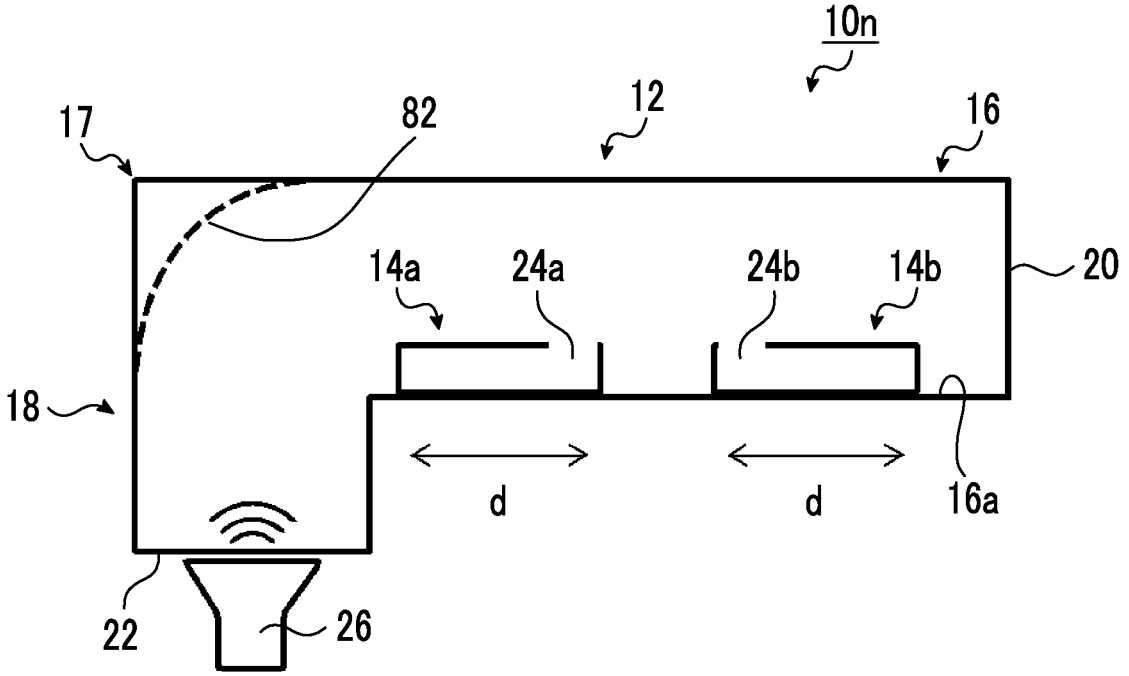
FIG. 42 is a cross-sectional view schematically illustrating an example of a soundproof system according to yet still another embodiment of the invention.

As in soundproof systems 10*m* and 10*n* illustrated in FIGS. 41 and 42, acoustic transmission walls 80 and 82 that do not allow wind to pass through or hardly allow wind to pass through and transmit sound waves are provided at a corner 17 of the tube structure 12. As illustrated in FIGS. 41 and 42, the tube structure 12 has the corner 17 that is bent at an angle of about 90°.

In the soundproof system 10*m* illustrated in FIG. 41, the acoustic transmission wall 80 is provided at the corner 17 of the tube structure 12 as an oblique wall that is inclined at an angle of about 45° with respect to the longitudinal direction of the bent portion 18 of the tube structure 12 on the incident side and the longitudinal direction of the straight tube portion 16 of the tube structure 12 on the emission side.

In the soundproof system 10*n* illustrated in FIG. 42, the acoustic transmission wall 82 is provided at the corner 17 of the tube structure 12 as a smooth curved surface (for example, an arc wall) that is convex with respect to the corner 17.

In FIGS. 41 and 42, the incident side is the side of the opening end 22 of the bent portion 18 and the emission side is the side of the opening end 20 of the straight tube portion 16.

In the soundproof systems 10*m* and 10*n* illustrated in FIGS. 41 and 42, since the acoustic transmission walls 80 and 82 transmit sound waves, the sound wave that is incident on the upstream side is transmitted through the acoustic transmission walls 80 and 82 at the corner 17 and is reflected from the wall surface of the tube structure 12 to the upstream side. That is, the characteristics of the original tube structure 12 without including the acoustic transmission walls 80 and 82 are maintained. In contrast, since the acoustic transmission walls 80 and 82 allow wind to pass through, the flow direction of wind from the upstream side is bent by the acoustic transmission walls 80 and 82 at the corner 17 and wind flows to the downstream side. As such, since the acoustic transmission walls 80 and 82 are provided at the corner 17, it is possible to improve air ventilation while maintaining the transmittance of sound at a low level.

A non-woven fabric having low density and a film having a low thickness and density may be used as the acoustic transmission walls 80 and 82. Examples of the non-woven fabric having low density include Stainless Steel Fiber Sheet (Tomifleck SS) manufactured by Tomoegawa Co., Ltd. and normal tissue paper. Examples of the film having a low thickness and density include various commercially available wrap films, silicone rubber films, and metal foil.

In the invention, as in a soundproof system 10*o* illustrated in FIG. 43, a linear tube structure 12*c* having a reduced diameter at the base end may be used as the tube structure. The tube structure 12*c* includes a straight tube portion 16 that has an opening end 20 as one end and has a rectangular shape in a cross-sectional view and a reduced tube portion 84 that has one end connected to the other end of the straight tube portion 16, has the opening end 22 as the other end, and has a rectangular shape in a cross-sectional view. In the soundproof system 10*o* according to the invention, a soundproof structure, such as the tubular body 14, is provided at an appropriate position on the inner bottom of the straight tube portion 16 of the tube structure 12*c*.

In the invention, as in a soundproof system 10*p* illustrated in FIG. 44, a T-shaped tube structure 12*d* may be used as the tube structure. The tube structure 12*d* includes a straight tube portion 16 that has the opening end 20 as one end and has a rectangular shape in a cross-sectional view and a tube portion 86 in which a central portion of a side surface is attached to the other end of the straight tube portion 16 and has a rectangular shape in a cross-sectional view. One end of the tube portion 86 is the opening end 22 and the other end thereof is a closed end 38. The tube portion 86 may be attached to the straight tube portion 16 at a right angle or at an oblique angle. In the soundproof system 10*p* according to the invention, a soundproof structure, such as the tubular body 14, is provided at an appropriate position on the inner bottom of the straight tube portion 16 of the tube structure 12*d*.

In the invention, as in a soundproof system 10*q* illustrated in FIG. 45, a crank-shaped tube structure 12*e* may be used as the tube structure. The tube structure 12*e* includes a straight tube portion 16 that has the opening end 20 as one end and has a rectangular shape in a cross-sectional view, a straight tube portion 88 that has the opening end 22 as the other end and has a rectangular shape in a cross-sectional view, and a bent portion 18 that connects the other end of the straight tube portion 16 and one end of the straight tube portion 88 and has a rectangular shape in a cross-sectional view. The bent portion 18 may be attached to the straight tube portions 16 and 88 at a right angle or at an oblique angle. In the soundproof system 10*q* according to the invention, a soundproof structure, such as the tubular body 14, is provided at an appropriate position on the inner bottom of the straight tube portion 16 or 88 of the tube structure 12*e*.

In the soundproof systems 10*o*, 10*p*, and 10*q* according to the invention, since the soundproof structure, such as the tubular body 14, is provided at an appropriate position on the inner bottom of the straight tube portion 16 or 88 of the tube structures 12*c*, 12*d*, and 12*e*, it is possible to obtain a transmission loss peak caused by air column resonance and a transmission loss peak caused by the duct coupling mode, similarly to the soundproof system 10 illustrated in FIG. 1.

EXAMPLES

The soundproof system according to the invention will be described in detail on the basis of examples.

First, the tube structure 12 illustrated in FIG. 2 was used, the resonance of the tube structure 12 was measured, and the natural frequency fm of the tube structure 12 was measured.

In the tube structure 12, the dimensions of the straight tube portion 16 of the tube structure 12 were 88 mm×163 mm (cross section)×394 mm (length) and the dimensions of the bent portion 18 were 64 mm×163 mm (cross section)×27 mm (length).

In a case in which the natural frequency fm of the tube structure 12 was measured, the sound source (speaker) 26 and the microphone 28 for measuring sound pressure were disposed with respect to the tube structure 12 as illustrated in FIGS. 4A and 4B (hereinafter, represented by FIG. 4A). The sound source 26 was provided so as to be closely attached to the opening end 22 of the bent portion 18 of the tube structure 12. The microphone 28 was provided at a position that was 500 mm away from the opening end 20 of the straight tube portion 16 of the tube structure 12 and was 500 mm away from the bottom 16*a* of the straight tube portion 16 of the tube structure 12 in the upward direction.

In a case in which the sound source 26 and the microphone 28 were provided at the positions, in each of a state in which the tube structure 12 was not provided as illustrated in FIG. 4A and a state in which the tube structure 12 was not provided, sound was generated from the sound source 26 and sound pressure was measured by the microphone 28. The transmission loss of the tube structure 12 was calculated from the measurement values. The results are illustrated in FIG. 5.

As the natural frequency (the natural mode frequency of the tube structure 12) at which transmission loss is the minimum, fm1, fm2, and fm3, • • • were specified from the results illustrated in FIG. 5.

Then, the tubular body 14 illustrated in FIG. 3 was used as the soundproof structure and the resonance frequency fr of the soundproof structure was calculated.

The tubular body 14 which had a back length (back distance) d of 100 mm, a height of 20 mm, and a width of 163 mm and in which the slit dimensions of the opening portion 24 were a slit width of 20 mm and a slit length of 163 mm was used.

In the determination of the resonance frequency fr of the tubular body 14 which was the soundproof structure, in a case in which the back length was d, the frequency calculated by fr [Hz]=v_air/d/4 (v_air is the sound speed) was defined as the resonance frequency fr [Hz] of the tubular body 14.

Then, the phase differences θ1 and θ2 according to the first embodiment of the invention were calculated.

The phase difference θ1 was defined and calculated as follows.

The phase difference θ1 means a phase difference between sound that is incident on the soundproof structure (tubular body 14) and sound that is re-radiated from the soundproof structure (tubular body 14). For example, in a case in which the tubular body 14 used here is a cylindrical structure, the approximate value of the phase difference θ1 was calculated from the length of the tubular body 14 by to the following expression:

$$\theta 1 = 2d \times (2\pi/\lambda).$$

The phase difference θ2 was defined and calculated as follows.

The phase difference θ2 was calculated by the following expression in a case in which the soundproof structure was the tubular body 14 and the distance from the position Op of the opening portion 24 to the position where sound pressure formed in the tube structure 12 had the maximum value in the tube structure 12 was L:

$$\theta 2=2L\times(2\pi/\lambda).$$

The difference Δθ (=|θ1−θ2|) between the phase differences θ1 and θ2 was calculated.

(Frequency Lower than Resonance)

Here, since the sound speed v_air at 20° C. was 343.5 m/s the back length d was 100 mm, fr≈850 Hz was determined.

In addition, the highest frequency fm satisfying fm<fr was 600 Hz and fma was 600 Hz ($\lambda_{fma}$=572 mm).

Then, the difference Δθ with respect to sound with $\lambda_{fma}$ (600 Hz) was calculated for various values La1. In this case, transmission loss was measured.

<Measurement of Maximum Value of Sound Pressure in Tube Structure 12>

The position (for example, the antinode A) where sound pressure at 600 Hz was the highest in the tube structure 12 was investigated by the measurement microphone 28 (type 4160n (¼ inch) manufactured by ACO Co., Ltd.) while the position of the leading end of the microphone located at a height of 10 mm from the bottom 16*a* of the tube structure 12 was shifted little by little from the opening end 20 to the back side. The result proved that the sound pressure had the maximum value at a position that was Lx=100 mm away from the opening end 20 of the tube structure 12.

<Measurement of Transmission Loss>

First, the measurement system illustrated in FIG. 4A was prepared.

Here, Lb is the distance between the position Op of the opening portion 24 of the tubular body 14 and the opening end 20 of the tube structure 12.

The measurement system illustrated in FIG. 6 measured sound pressure p2 using the same method as the measurement system illustrated in FIG. 4A.

The transmission loss is defined by the following expression:

$$\text{Transmission loss (TL) [dB]}=20\log 10(p1/p2)$$

(p1: sound pressure in a case in which the tubular body 14 is absent (see FIG. 4A), p2: sound pressure in a case in which the tubular body 14 is provided (see FIG. 6)).

Then, transmission loss with respect to various values of La1 (Examples 1 to 4 and Comparative Examples 1 to 3) was measured.

Table 1 shows the measured transmission loss in Examples 1 to 4 and Comparative Examples 1 to 3, together with the distance Lb, the distance Lx, the distance La1, the phase difference θ1, the phase difference θ2, and the difference Δθ=|θ1−θ2|.

The distance La1 is the distance between the position of the opening portion 24 of the tubular body 14 and the position which is closest to the position of the opening portion 24 in the same direction as the flow direction of sound at the frequency fma and where sound pressure has the maximum value in the tube structure 12. It is difficult to define the distance La1 in a case in which the maximum value is absent in the same direction as the flow direction of sound. In Table 1, the distance between the closest position where sound pressure has the maximum value and the position of the opening portion 24 of the tubular body 14 is illustrated as a value in a case in which the flow direction of sound is the positive direction. Therefore, in Table 1, some values are negative values.

TABLE 1

| Distance Lb [mm] | Distance Lx [mm] | La1(=Lb − Lx) [mm] | θ1 [rad.] | θ2 [rad.] | \|θ1 − θ2\| | Transmission loss dB (fm = 600 Hz) | |
|---|---|---|---|---|---|---|---|
| 30 | 100 | −70 | 2.20 | −1.54 | 3.74 | 0.86 | Comparative Example 1 |
| 50 | | −50 | 2.20 | −1.10 | 3.30 | 2.84 | Comparative Example 2 |
| 70 | | −30 | 2.20 | −0.66 | 2.86 | 4.66 | Comparative Example 3 |
| 130 | | 30 | 2.20 | 0.66 | 1.54 | 6.79 | Example 1 |
| 150 | | 50 | 2.20 | 1.10 | 1.10 | 8.88 | Example 2 |
| 170 | | 70 | 2.20 | 1.54 | 0.66 | 8.64 | Example 3 |
| 185 | | 85 | 2.20 | 1.87 | 0.33 | 8.36 | Example 4 |

White noise was emitted from the sound source 26 (speaker (FE103En manufactured by FOSTEX COMPANY)) provided close to one opening end 22 of the tube structure 12 in which the tubular body 14 which was a soundproof structure was not provided and sound pressure p1 was measured by the measurement microphone 28 (type 4160n (¼ inch) manufactured by ACO Co., Ltd.).

Then, the tubular body 14 which was a soundproof structure was provided in the tube structure 12. As a result, the measurement system illustrated in FIG. 6 was configured. Here, the distance between the position Op of the opening portion 24 of the tubular body 14 and the position (for example, the antinode A) where the sound pressure had the maximum value was set to La1 [mm].

The definition of La1 is as follows:

$$La1=Lb-Lx(100\text{ mm}).$$

The results in Table 1 proved that, in Examples 1 to 4 satisfying the above-mentioned Expression (1) which was a requirement of the invention, the transmission loss of sound with 600 Hz was larger than that in Comparative Examples 1 to 3 that did not satisfy the above-mentioned Expression (1).

Figure 27:
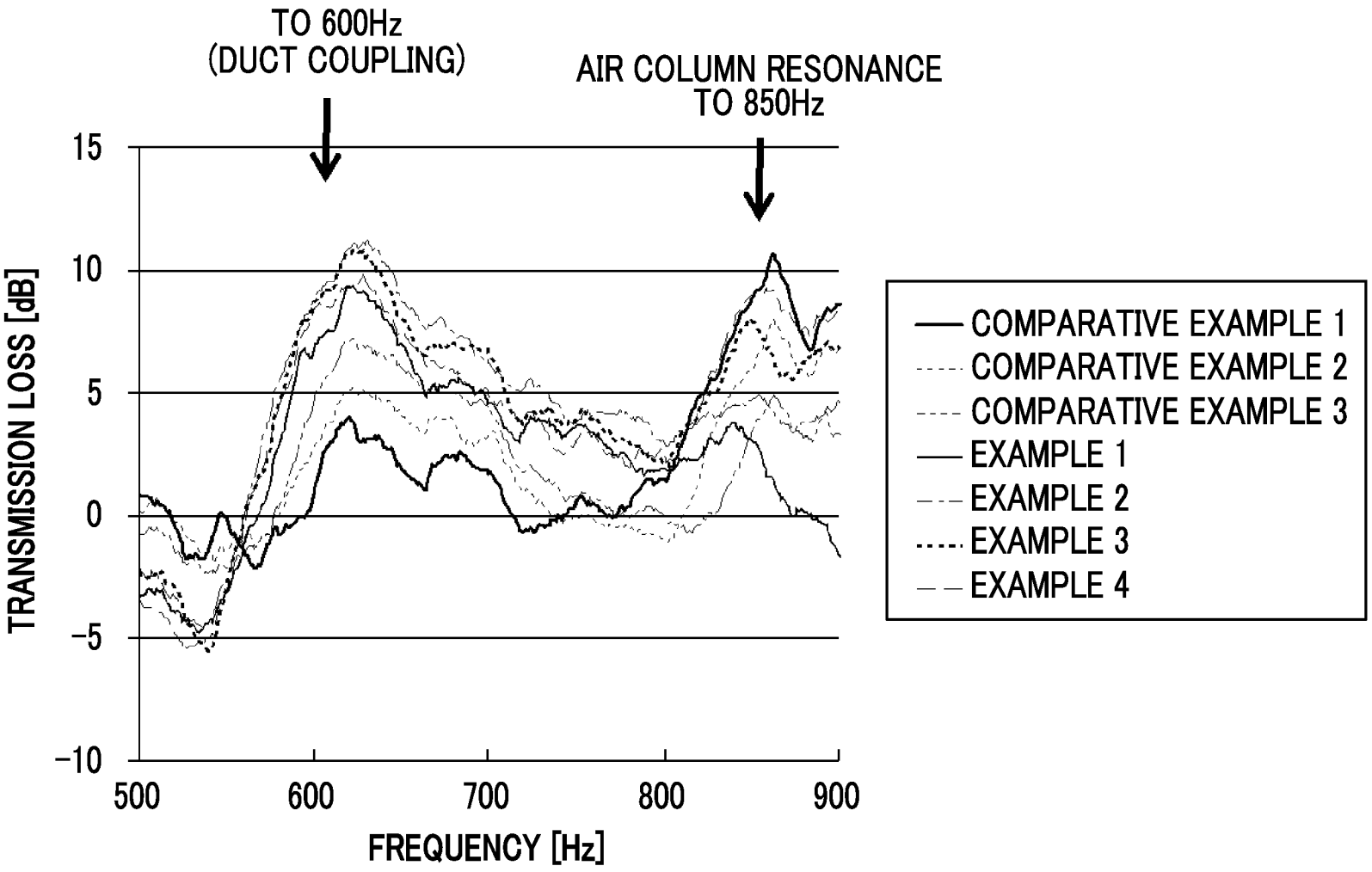
FIG. 27 is a graph illustrating the relationship between the transmission loss and frequency of soundproof systems according to Examples 1 to 4 of the invention and Comparative Examples 1 to 3.
Figure 29:
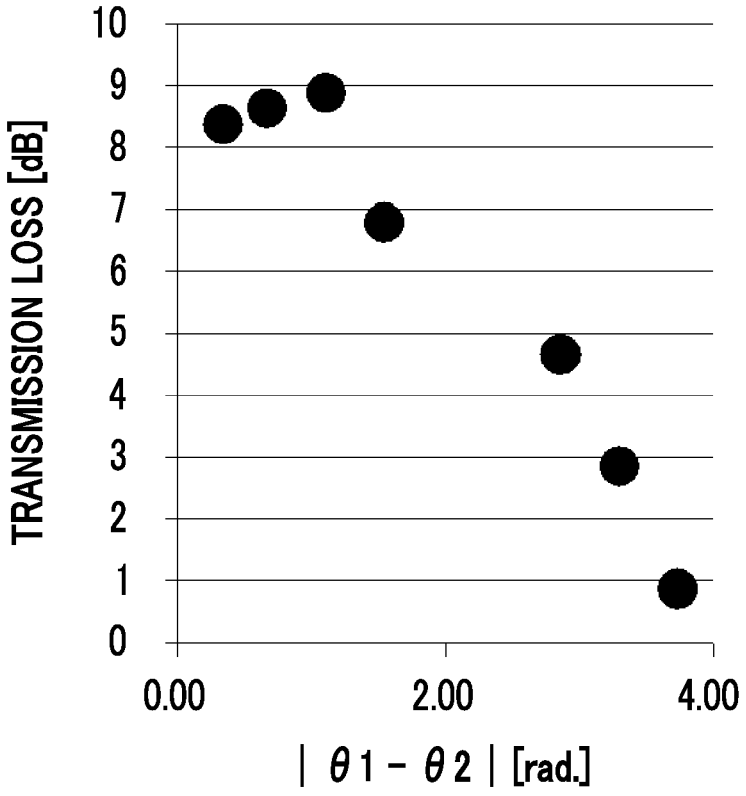
FIG. 29 is a graph illustrating the relationship between transmission loss and an absolute value of a difference between phase differences in the soundproof systems according to Examples 1 to 4 of the invention and Comparative Examples 1 to 3.

FIG. 27 illustrates the dependence of transmission loss on the frequency in Examples 1 to 4 and Comparative Examples 1 to 3. FIG. 29 illustrates the relationship between transmission loss and the difference Δθ=|θ1−θ2| between the phase difference θ1 and the phase difference θ2 in Examples 1 to 4 and Comparative Examples 1 to 3.

As can be seen from FIG. 27 and FIG. 29, in Examples 1 to 4 satisfying the above-mentioned Expression (1) that is a requirement of the invention, transmission loss at a frequency of around 600 Hz is larger than that in Comparative Examples 1 to 3 that do not satisfy the above-mentioned Expression (1). In addition, as can be seen from FIG. 27 and FIG. 29, in Examples 1 to 4, as an additional effect, a high transmission loss of 3 dB or more is obtained at a frequency of around 850 Hz (=fr) which is the resonance frequency as well as at 600 Hz.

As can be seen from this, in Examples 1 to 4 satisfying the requirements of the invention, high transmission loss can be obtained at a plurality of frequencies.

In this case, the results show that, since the back length d of the tubular body 14 which is a cylindrical structure satisfies $d<\lambda_{fma}/4$, it is possible to obtain high transmission loss even though the cylindrical structure has a smaller size than the soundproof structure based on air column resonance.

Then, the back length d of the tubular body 14 was set to 112 mm and the same measurement as described above was performed. The resonance frequency fr≈750 Hz was determined from the measurement results.

In addition, the highest frequency fm satisfying fm<fr was specified to be 600 Hz and fma was set to 600 Hz.

In this case, the results are illustrated in Table 2.

TABLE 2

| Distance Lb [mm] | Distance Lx [mm] | La1(=Lb − Lx) [mm] | θ1 [rad.] | θ2 [rad.] | \|θ1 − θ2\| | Transmission loss dB (fm = 600 Hz) | |
|---|---|---|---|---|---|---|---|
| 30 | 100 | −70 | 2.46 | −1.539 | 4.00 | 5.36 | Comparative Example 4 |
| 50 | | −50 | 2.46 | −1.099 | 3.56 | 6.93 | Comparative Example 5 |
| 150 | | 50 | 2.46 | 1.099 | 1.36 | 10.80 | Example 5 |
| 170 | | 70 | 2.46 | 1.539 | 0.92 | 9.60 | Example 6 |
| 190 | | 90 | 2.46 | 1.978 | 0.48 | 8.50 | Example 7 |

The results in Table 2 proved that, in Examples 5 to 7 satisfying the above-mentioned Expression (1) which was a requirement of the invention, the transmission loss of sound with 600 Hz was larger than that in Comparative Examples 4 and 5 that did not satisfy the above-mentioned Expression (1).

Figure 28:
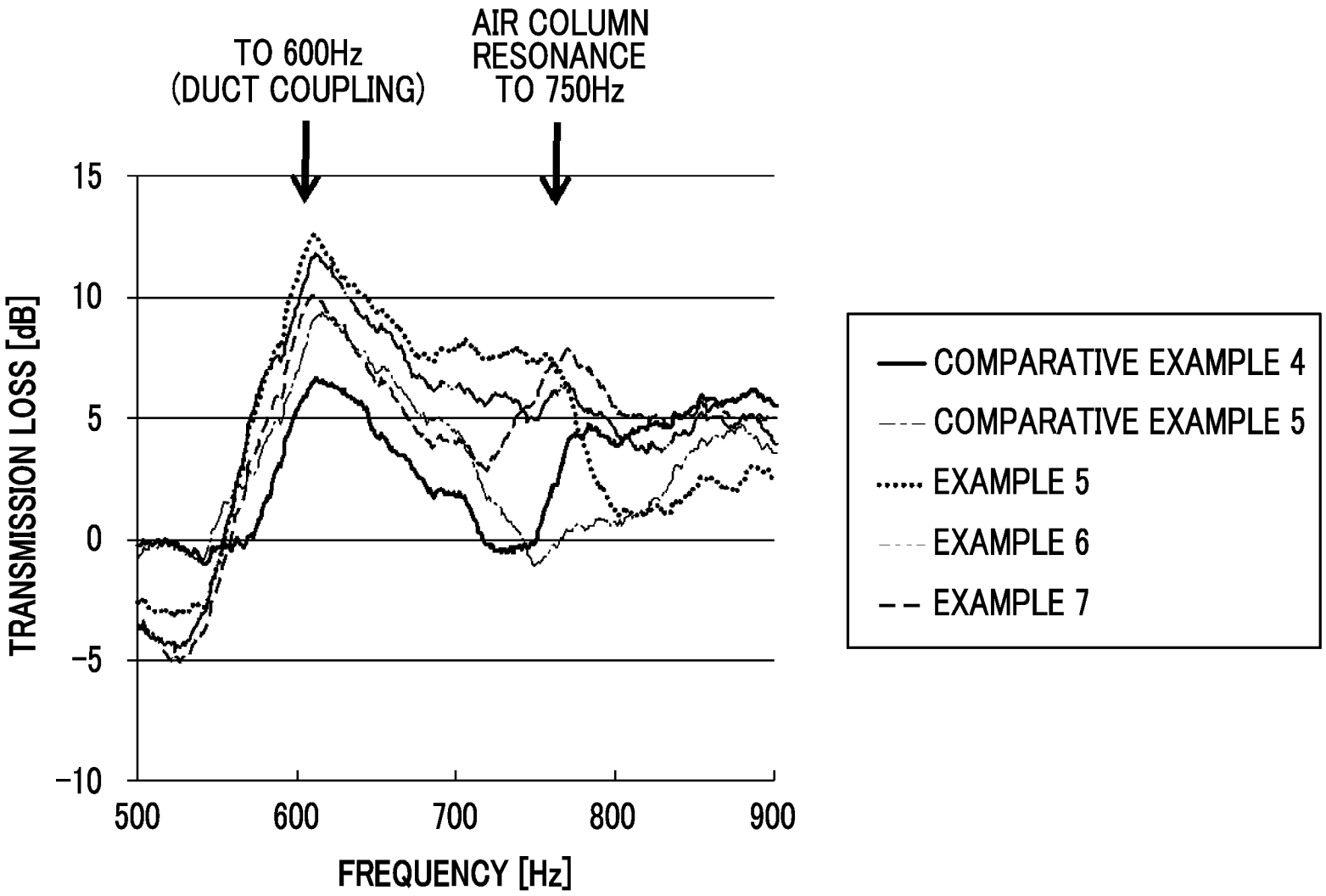
FIG. 28 is a graph illustrating the relationship between the transmission loss and frequency of soundproof systems according to Examples 5 to 7 of the invention and Comparative Examples 4 and 5.

FIG. 28 illustrates the dependence of transmission loss on the frequency in Examples 5 to 7 and Comparative Examples 4 and 5.

As can be seen from FIG. 28, in Examples 5 to 7 satisfying the above-mentioned Expression (1) which is a requirement of the invention, transmission loss at a frequency of around 600 Hz is larger than that in Comparative Examples 4 and 5 that do not satisfy the above-mentioned Expression (1). In addition, as can be seen from FIG. 28, in Examples 5 to 7, as an additional effect, a high transmission loss of 3 dB or more is obtained at a frequency of around 750 Hz (=fr) which is the resonance frequency as well as at 600 Hz.

The above-mentioned results show that, in a case in which the requirements of the invention are satisfied, it is possible to increase the transmission loss of sound with a frequency lower than the resonance frequency.

(Frequency Higher Than Resonance)

First, fr≈850 Hz is determined in a case in which the back length d is 100 mm.

In contrast, fr≈750 Hz is determined in a case in which the back length d is 112 mm.

In any case, the lowest frequency fm satisfying fm>fr was 1000 Hz and fmb was set to 1000 Hz.

Then, in any case, the difference Δθ for sound with 1000 Hz was calculated with respect to various values of La2. In this case, transmission loss was measured.

<Measurement of Maximum Value of Sound Pressure in Tube Structure 12>

The position (for example, the antinode A) where the pressure of sound with 1000 Hz was the highest in the tube structure 12 was investigated by the measurement microphone 28 (type 4160n (¼ inch) manufactured by ACO Co., Ltd.) while the position of the leading end of the microphone located at a height of 10 mm from the bottom 16*a* of the tube structure 12 was shifted little by little from the opening end 20 to the back side. The result proved that the sound pressure had the maximum value at a position that was Lx=50 mm away from the opening end 20 of the tube structure 12.

<Measurement of Transmission Loss>

First, the measurement system illustrated in FIG. 4A was prepared.

White noise was emitted from the sound source 26 (speaker (FE103En manufactured by FOSTEX COMPANY)) provided close to one opening end 22 of the tube structure 12 in which the tubular body 14 which was a soundproof structure was not provided and sound pressure p1 was measured by the measurement microphone 28 (type 4160n (¼ inch) manufactured by ACO Co., Ltd.).

Then, the tubular body 14 which was a soundproof structure was provided in the tube structure 12. As a result, the measurement system illustrated in FIG. 6 was configured. Here, the distance between the position Op of the opening portion 24 of the tubular body 14 and the position (for example, the antinode A) where the sound pressure had the maximum value was set to La2 [mm].

The definition of La2 is as follows:

$$La2=Lb-Lx(50\text{ mm}).$$

Here, Lb is the distance between the position Op of the opening portion 24 of the tubular body 14 and the opening end 20 of the tube structure 12.

The measurement system illustrated in FIG. 6 measured sound pressure p2 using the same method as the measurement system illustrated in FIG. 4A.

The transmission loss is defined by the following expression:

$$\text{Transmission loss (TL) [dB]}=20\log 10(p1/p2)$$

(p1: sound pressure in a case in which the tubular body 14 is absent (see FIG. 4A), p2: sound pressure in a case in which the tubular body 14 is provided (see FIG. 6)).

Then, transmission loss with respect to various values of La2 (Examples 8 and 9 and Comparative Example 6 and 7 in a case in which d is 100 mm and Examples 10 and 11 and Comparative Examples 8 and 9 in a case in which d is 112 mm) was measured.

Table 3 shows the measured transmission loss in Examples 8 and 9 and Comparative Examples 6 and 7, together with the distance Lb, the distance Lx, the distance La1, the phase difference θ1, the phase difference θ2, and the difference Δθ=|θ1−θ2|.

Table 4 shows the measured transmission loss in Examples 10 and 11 and Comparative Examples 8 and 9, together with the distance Lb, the distance Lx, the distance La1, the phase difference θ1, the phase difference θ2, and the difference Δθ=|θ1−θ2|.

TABLE 3

| Distance Lb [mm] | Distance Lx [mm] | La2(=Lb − Lx) [mm] | θ1 [rad.] (1000 Hz) | θ2 [rad.] (1000 Hz) | \|θ1 − θ2\| (1000 Hz) | Transmission loss dB (fm = 600 Hz) | |
|---|---|---|---|---|---|---|---|
| 70 | 50 | 20 | 3.66 | 0.73 | 2.93 | 4.78 | Comparative Example 6 |
| 90 | | 40 | 3.66 | 1.47 | 2.20 | 2.75 | Comparative Example 7 |
| 170 | | 120 | 3.66 | 4.40 | 0.73 | 5.06 | Example 8 |
| 185 | | 135 | 3.66 | 4.95 | 1.28 | 7.31 | Example 9 |

TABLE 4

| Distance Lb [mm] | Distance Lx [mm] | La2(=Lb − Lx) [mm] | θ1 [rad.] (1000 Hz) | θ2 [rad.] (1000 Hz) | \|θ1 − θ2\| (1000 Hz) | Transmission loss dB (fm = 600 Hz) | |
|---|---|---|---|---|---|---|---|
| 90 | 50 | 40 | 4.10 | 1.47 | 2.64 | 1.55 | Comparative Example 8 |
| 110 | | 60 | 4.10 | 2.20 | 1.91 | 0.75 | Comparative Example 9 |
| 170 | | 120 | 4.10 | 4.40 | 0.29 | 2.05 | Example 10 |
| 190 | | 140 | 4.10 | 5.13 | 1.03 | 2.90 | Example 11 |

The results in Tables 3 and 4 proved that, in Examples 8 and 9 and Examples 10 and 11 satisfying the above-mentioned Expression (1) which was a requirement of the invention, the transmission loss of sound with 1000 Hz was larger than that in Comparative Examples 6 and 7 and Comparative Examples 8 and 9 that did not satisfy the above-mentioned Expression (1).

Figure 30:
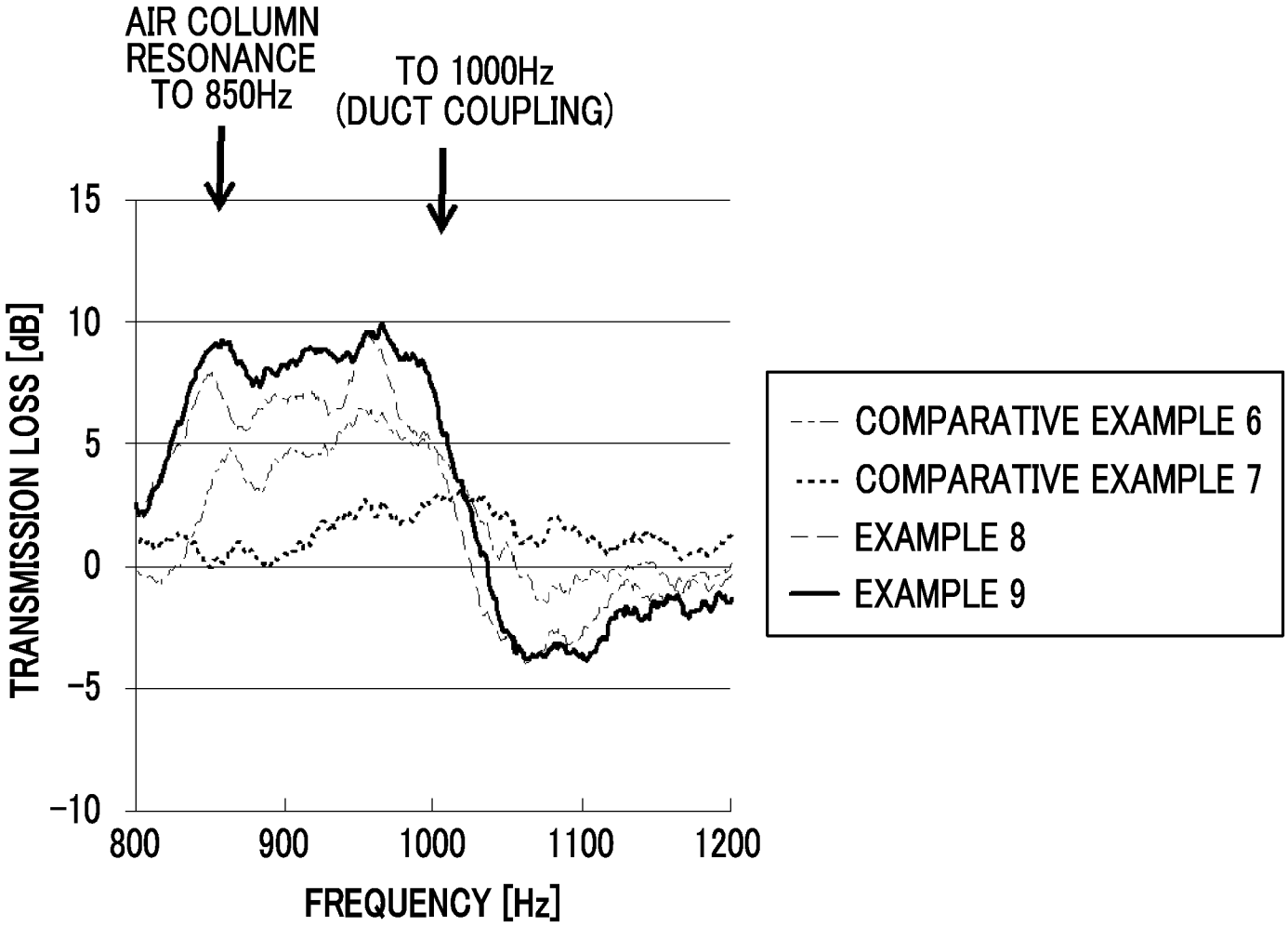
FIG. 30 is a graph illustrating the relationship between the transmission loss and frequency of soundproof systems according to Examples 8 and 9 of the invention and Comparative Examples 6 and 7.
Figure 31:
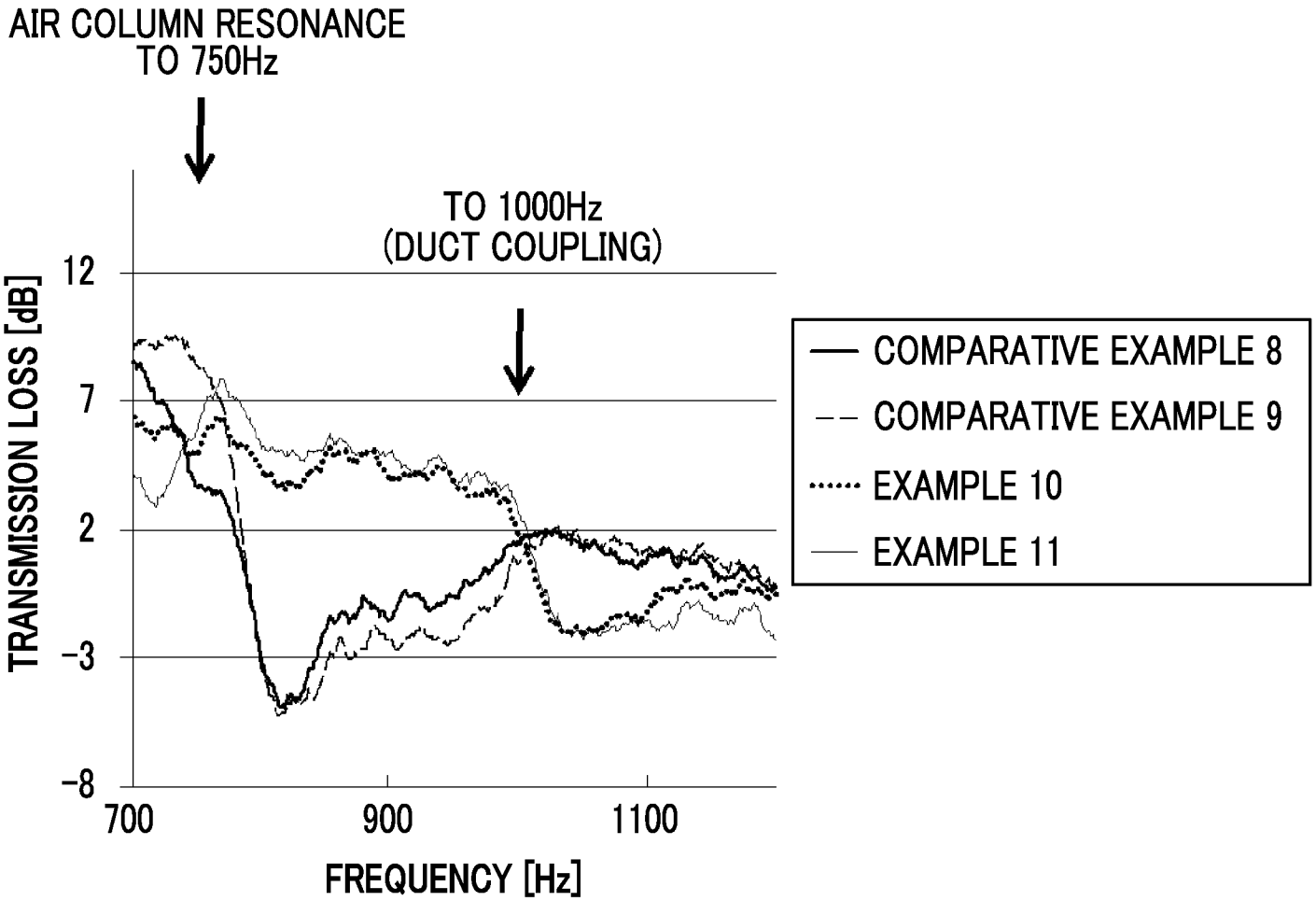
FIG. 31 is a graph illustrating the relationship between the transmission loss and frequency of soundproof systems according to Examples 10 and 11 of the invention and Comparative Examples 8 and 9.

FIG. 30 illustrates the dependence of transmission loss on the frequency in Examples 8 and 9 and Comparative Examples 6 and 7. FIG. 31 illustrates the dependence of transmission loss on the frequency in Examples 10 and 11 and Comparative Examples 8 and 9.

As can be seen from FIG. 30 and FIG. 31, in Examples 8 and 9 and Examples 10 and 11 satisfying the above-mentioned Expression (1) that is a requirement of the invention, transmission loss at a frequency of around 1000 Hz is larger than that in Comparative Examples 6 and 7 and Comparative Examples 8 and 9 that do not satisfy the above-mentioned Expression (1). In addition, as can be seen from FIG. 30, in Examples 8 and 9, as an additional effect, a high transmission loss of 3 dB or more is obtained at a frequency of around 850 Hz (=fr) which is the resonance frequency as well as at 1000 Hz.

As can be seen from this, in Examples 8 and 9 and Examples 10 and 11 satisfying the requirements of the invention, high transmission loss can be obtained at a plurality of frequencies.

The above-mentioned results show that the transmission loss of sound with a frequency higher than resonance which does not correspond to the resonance frequency in addition to the resonance frequency is increased by satisfying the requirements of the invention.

The effect of the invention is apparent from the above.

The soundproof system according to the invention has been described in detail above with reference to various embodiments and examples. The invention is not limited to the embodiments and the examples and various modifications and changes of the invention can be made without departing from the scope and spirit of the invention.

EXPLANATION OF REFERENCES

10, 10*a*, 10*b*, 10*c*, 10*d*, 10*e*, 10*f*, 10*g*, 10*h*, 10*i*, 10*j*, 10*k*, 10*l*, 10*m*, 10*n*: soundproof system
12, 12*a*, 12*b*: tube structure
14, 14*a*, 14*b*, 30, 66: tubular body
16: straight tube portion
16*a*: bottom
17: corner
18: bent portion
20, 22: opening end
24, 24*a*, 24*b*, 36, 54, 76: opening portion
26: sound source (speaker)
28: microphone
32: cylindrical body
34, 52, 64: Helmholtz resonator
38: closed end
40, 50: sound absorbing material
42: sound absorbing material replacement member
44: replacement mechanism
46: intermediate material
48: attachment material
56: cover
58: housing
60*a*, 60*b*: magnet
62: screw
68: back plate
70: groove
72: top plate
74: housing main body
80, 82: acoustic transmission wall

What is claimed is:

1. A soundproof system comprising:

a tube structure having one or more opening ends; and a soundproof structure, wherein the soundproof structure has an opening portion or a radiation surface on which sound is incident or from which sound is radiated, the opening portion or the radiation surface of the soundproof structure is provided in the tube structure, the following Expression (1) is satisfied in a case in which a phase difference between sound incident on the soundproof structure and sound re-radiated from the soundproof structure is defined a phase difference as θ1 [rad.]; for one or more maximal values of pressure of sound forming a sound pressure distribution in the tube structure, a distance between the opening portion or the radiation surface of the soundproof structure and a position where the sound pressure has a maximal value in the tube structure is L [mm]; a wavelength of the sound incident on the soundproof structure is λ [mm]; and a phase difference θ2 [rad.] is defined as 2π×2L/λ:

$$|\theta 1-\theta 2|\leq\pi/2 \quad (1)$$

the soundproof structure is a tubular body having the opening portion, and the following Expression (2) is satisfied in a case in which the tubular body has a resonance frequency fr [Hz], a distance between the opening portion of the tubular body and a position where the sound pressure has the maximal value and which is closest to the opening portion in the same direction as a flow direction of sound at a highest frequency fma [Hz] among frequencies at which transmission loss is minimal in a transmission loss spectrum of the tube structure and which are lower than the resonance frequency fr, in the tube structure is La1 [mm], and a wavelength at the frequency fma is $\lambda_{fma}$ [mm]:

$$0\leq La1\leq\lambda_{fma}/4 \quad (2).$$

2. The soundproof system according to claim 1, wherein the sound forming the sound pressure distribution in the tube structure has the same frequency or wavelength as the sound incident on the soundproof structure.

3. The soundproof system according to claim 1, wherein the soundproof structure is a resonator with respect to a sound wave.

4. The soundproof system according to claim 1, wherein the maximal value is an antinode of a standing wave of sound formed by the tube structure.

5. The soundproof system according to claim 1, wherein the tube structure has resonance and satisfies the above-mentioned Expression (1) at a frequency where the resonance occurs.

6. The soundproof system according to claim 1, wherein the above-mentioned Expression (1) is satisfied at a frequency different from a resonance frequency of the tubular body.

7. The soundproof system according to claim 6, wherein transmission loss is maximal at the frequency satisfying the above-mentioned Expression (1).

8. A soundproof system comprising:

a tube structure having one or more opening ends; and a soundproof structure, wherein the soundproof structure is a tubular body having an opening portion on which sound is incident or from which sound is radiated, the opening portion is provided in the tube structure, and the following Expression (2) is satisfied in a case in which the tubular body has a resonance frequency fr [Hz], a distance between the opening portion of the tubular body and a position where sound pressure has a maximal value and which is closest to the opening portion in the same direction as a flow direction of sound at a highest frequency fma [Hz] among frequencies at which transmission loss is minimal in a transmission loss spectrum of the tube structure and which are lower than the resonance frequency fr, in the tube structure is La1 [mm], and a wavelength at the frequency fma is $\lambda_{fma}$ [mm]:

$$0\leq La1\leq\lambda_{fma}/4 \quad (2).$$

9. The soundproof system according to claim 8, wherein, in a case in which a back length of the tubular body is defined as d, the following Expression (3) is satisfied:

$$d<\lambda_{fma}/4 \quad (3).$$

10. The soundproof system according to claim 8, wherein the opening portion of the tubular body is provided within the wavelength $\lambda_{fma}$ from the opening end of the tube structure.

11. The soundproof system according to claim 1, wherein the following Expression (4) is satisfied in a case in which the tubular body has a resonance frequency fr [Hz], a distance between the opening portion of the tubular body and a position where the sound pressure has a maximal value and which is closest to the opening portion in the same direction as a flow direction of sound at a lowest frequency fmb [Hz] among frequencies at which transmission loss is minimal in a transmission loss spectrum of the tube structure and which are higher than the resonance frequency fr, in the tube structure is La2 [mm], and a wavelength at the frequency fmb is $\lambda_{fmb}$ [mm]:

$$\lambda_{fmb}/4\leq La2\leq\lambda_{fmb}/2 \quad (4).$$

12. A soundproof system comprising:

a tube structure having one or more opening ends; and a soundproof structure, wherein the soundproof structure is a tubular body having an opening portion on which sound is incident or from which sound is radiated, the opening portion is provided in the tube structure, and the following Expression (4) is satisfied in a case in which the tubular body has a resonance frequency fr [Hz], a distance between the opening portion of the tubular body and a position where sound pressure has a maximal value and which is closest to the opening portion in the same direction as a flow direction of sound at a lowest frequency fmb [Hz] among frequencies at which transmission loss is minimal in a transmission loss spectrum of the tube structure and which are higher than the resonance frequency fr, in the tube structure is La2 [mm], and a wavelength at the frequency fmb is $\lambda_{fmb}$ [mm]:

$$\lambda_{fmb}/4\leq La2\leq\lambda_{fmb}/2 \quad (4).$$

13. The soundproof system according to claim 12, wherein the opening portion of the tubular body is provided within the wavelength $\lambda_{fmb}$ from the opening end of the tube structure.

14. The soundproof system according to claim 1, wherein the opening portion of the tubular body is located at a position different from a node of a standing wave of sound formed by the tube structure.

15. The soundproof system according to claim 1, wherein the opening portion or the radiation surface of the soundproof structure is provided within the wavelength $\lambda$ from the opening end of the tube structure.

16. The soundproof system according to claim 1, wherein the soundproof structure is included in the tube structure.

17. The soundproof system according to claim 1, further comprising:

a sound absorbing material that is provided in the tube structure.

18. The soundproof system according to claim 1, wherein, in a case in which the soundproof structure has a resonance frequency fr [Hz], $fr \leq 1000$ Hz is satisfied.

* * * * *